US005212055A

United States Patent [19]

Morigaki et al.

[11] Patent Number: 5,212,055

[45] Date of Patent: May 18, 1993

[54] SILVER HALIDE COLOR PHOTOGRAPHIC MATERIALS CONTAINING IMAGE STABILIZER AND ANTI-STAINING AGENT AND COLOR PHOTOGRAPHS CONTAINING THE SAME

[75] Inventors: Masakazu Morigaki; Nobuo Seto; Kozo Aoki, all of Kanagawa, Japan

[73] Assignee: Fuji Photo Film Co., Ltd., Kanagawa, Japan

[21] Appl. No.: 553,839

[22] Filed: Jul. 18, 1990

[30] Foreign Application Priority Data

Jul. 18, 1989 [JP] Japan ..... 1-185579

[51] Int. Cl.[5] ..... G03C 1/34; G03C 7/38

[52] U.S. Cl. ..... 430/551; 430/558; 430/607

[58] Field of Search ..... 430/558, 551, 607

[56] References Cited

U.S. PATENT DOCUMENTS 4,713,317 12/1987 Nakamura et al. ..... 430/551

FOREIGN PATENT DOCUMENTS 298321 1/1989 European Pat. Off. .

0355660 2/1990 European Pat. Off. ..... 430/551

*Primary Examiner*—Lee C. Wright

*Attorney, Agent, or Firm*—Sughrue, Mion, Zinn, Macpeak & Seas

[57] ABSTRACT

A silver halide color photographic material comprising a support having thereon at least one light-sensitive silver halide emulsion layer comprising a dispersion of silver halide grains in a binder, wherein the silver halide emulsion layer contains (a) at least one coupler represented by formula (I), (b) at least one compound represented by the formula (II), and (c) at least one compound represented by formula (III), and the photographic material contains (d) at least one compound represented by formulae (IV), (V) or (VI):

(I)

wherein R, Y, Za, Zb and Zc each is as defined in the specification;

(II)

wherein $R_1$, $R_2$, $R_5$ and $R_6$, and $R_7$ each is as defined in the specification (III)

wherein $R_{11}$, $R_{12}$ and $R_{13}$, $R_{14}$, $R_{15}$, $R_{16}$ and $R_{17}$ each is as defined in the specification;

(IV)

(V)

wherein $R_{21}$, $R_{22}$ A, B, X, $Y_1$ and n each is as defined in the specification; and (VI)

$R_{30}$ and Z is as defined in the specification; and a photograph containing (i) a magenta dye derived from the magenta coupler represented by formula (I), (ii) a compound represented by formula (II), a compound represented by formula (III), and at least one compound represented by formula (IV), (V) or (VI).

27 Claims, No Drawings

SILVER HALIDE COLOR PHOTOGRAPHIC MATERIALS CONTAINING IMAGE STABILIZER AND ANTI-STAINING AGENT AND COLOR PHOTOGRAPHS CONTAINING THE SAME

FIELD OF THE INVENTION

This invention relates to silver halide color photographic materials and, more particularly, it relates to silver halide color photographic materials which have excellent spectral absorption characteristics, and in which the storage properties of the dye image obtained and the white backgrounds are markedly improved, and color photographs having the same properties.

BACKGROUND OF THE INVENTION

In general, the colored image obtained on subjecting a silver halide color photographic material to photographic processing is comprised of azomethine dyes or indoaniline dyes which have been formed by the reaction of a coupler with the oxidized product of a primary aromatic amine developing agent.

Brilliant dyes with little subsidiary absorption are required to provide color photographic images which have good color reproduction, and the dyes which are obtained from the pyrazoloazole magenta couplers disclosed, for example, in U.S. Pat. Nos. 3,061,432, 4,500,630, JP-B-47-27411, JP-A-59-171956, JP-A-60-33552, JP-A-60-43659 and *Research Disclosure* No. 24626 in particular are more useful than the 5-pyrazolone azomethine dyes which have subsidiary absorbance in the vicinity of 400 to 450 nm. (The terms "JP-A" and "JP-B" as used herein signify an "unexamined published Japanese patent application" and an "examined Japanese patent publication", respectively.)

However, when these pyrazoloazole magenta couplers are used in silver halide color photographic materials, their light fastness is very poor when compared with that of the 5-pyrazolone magenta couplers, and there is a further problem that pronounced magenta colored staining occurs on storage after development processing, as a result of the presence of processing bath components which remain in the photographic material after development processing.

The inventors have discovered that anti-color fading agents which have a specified structure are effective for improving light fastness, as described, for example, in U.S. Pat. Nos. 4,588,679, 4,735,893 and European Patent 218,266. On the other hand, it has been discovered that compounds which bond chemically with the aromatic amine developing agents or the oxidized product of these materials which remain in the photographic materials after development processing and form an essentially colorless product as disclosed, for example, in European Patent (Laid Open) Nos. 230,048, 228,655, 255,722, 258,662 and 277,589, and U.S. Pat. No. 4,704,350, are effective for preventing the occurrence of magenta colored staining. Moreover, the joint use of the anti-color fading agents and anti-color staining agents has been proposed in European Patent (Laid Open) No. 298,321.

Storage properties have been improved to a remarkable degree by using these techniques.

However, although the improvement of the light fastness of the pyrazoloazole magenta image is greatly improved in the high color density regions, the improvement in the low color density regions is not so great as in the high color density regions, and it is known that the difference in the extent of the improvement in light fastness between the two color density regions becomes wider when anti-color staining agents are also used. Hence, color fading and ageing of the image proceeds, in particular, in the low color density regions; the yellow, magenta, cyan tri-color balance changes; and there is the disadvantage that fading of the low density regions of the magenta image can be observed visually. In addition, there is a clear need to increase the anti-color staining effect as described earlier, and thus provide for long term storage.

SUMMARY OF THE INVENTION

An object of the present invention is to provide silver halide color photographic materials which have excellent spectral absorption characteristics, good color reproduction, and in which the light fastness of the dye image is markedly improved.

Another object of the present invention is to provide silver halide color photographic materials in which the rate of color fading due to light of the dye image is the same for all color densities, and in which the color balance of the residual dye image is unchanged.

A further object of the present invention is to provide silver halide color photographic materials in which there is little yellow staining in the white backgrounds on irradiation with light and storage under warm and humid conditions.

Another object of the present invention is to provide color photographic materials in which color staining due to processing bath components which remain in the photographic materials after development processing, and especially residual color developing agents, is prevented to a marked extent.

Still another object of the present invention is to provide color photographic materials in which there is a marked improvement in storage properties irrespective of the running state of the processing baths, the use of reduced amounts of washing water or no water washing bath, the use of processing baths from which large amounts of processing bath components from essentially benzyl alcohol free color development baths are introduced into the photosensitive material, or other changes in the processing bath composition such as processing baths which provide load to color development.

An additional object of the present invention is to provide a color photograph which have good color reproduction, which have excellent light fastness and which exhibit little staining.

As a result of various investigations, the inventors have now discovered that these and other objects of the present invention can be attained by a silver halide color photographic material comprising a support having thereon at least one light-sensitive silver halide emulsion layer comprising a dispersion of silver halide grains in a hydrophilic colloid, wherein the silver halide emulsion layer contains (a) at least one coupler represented by formula (I), (b) at least one compound represented by the formula (II), and (c) at least one compound represented by formula (III), and the photographic material contains (d) at least one compound selected from the group consisting of compounds represented by formulae (IV), (V) or (VI) in at least one of said silver halide emulsion layer and the light-insensitive layer(s) adjacent thereto:

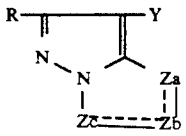

(I)

wherein R represents a hydrogen atom or a substituent group; Za, Zb and Zc each represents a methine group, a substituted methine group, =N— or —NH—; and Y represents a hydrogen atom, a coupling-off group capable of being eliminated in a coupling reaction with the oxidized product of a developing agent, or a non-coupling-off substituent group; couplers having at least two moieties may be formed via R, Y or a substituted methine group represented by Za, Zb or Zc, and when Y is a non-coupling-off substituent group, any of Za, Zb or Zc is a methine group or a substituted methine group which is substituted with a coupling-off group capable of being eliminated in a coupling reaction with the oxidized product of a developing agent;

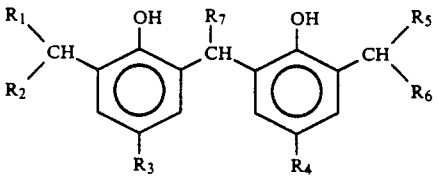

(II)

wherein $R_1$, $R_2$, $R_5$ and $R_6$, which may be the same or different, each represents a hydrogen atom, an alkyl group, an alkenyl group or an aryl group, and $R_1$ and $R_2$ or $R_5$ and $R_6$ may be linked to form a 5-membered to 7-membered ring; $R_3$ and $R_4$ each represents a hydrogen atom or an alkyl group or an aryl group; and $R_7$ represents a hydrogen atom or an alkyl group, provided that the total number of carbon atoms in $R_1$, $R_2$, $R_3$, $R_4$, $R_5$ and $R_6$ is at most 30;

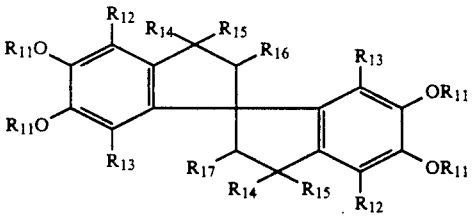

(III)

wherein $R_{11}$ represents an alkyl group, an alkenyl group or an aryl group; $R_{12}$ and $R_{13}$, which may be the same or different, each represents a hydrogen atom, an alkyl group, an alkenyl group, an aryl group, an acylamino group, a mono-alkylamino group, a di-alkylamino group, $—OR_{18}$, $—SR_{18}$ or a halogen atom; $R_{14}$, $R_{15}$, $R_{16}$ and $R_{17}$, which may be the same or different, each represents a hydrogen atom, an alkyl group or an aryl group; and $R_{18}$ has the same definition as those for $R_{11}$;

$$R_{21}\text{-}(A)_n\text{-}X \quad \text{(IV)}$$

$$R_{22}—\underset{\underset{B}{|}}{C}=Y_1 \quad \text{(V)}$$

wherein $R_{21}$ and $R_{22}$ each represents an aliphatic group, an aromatic group or a heterocyclic group; X represents a group capable of being eliminated by reaction with an, aromatic amine developing agent; A represents a group capable of reacting with an aromatic amine developing agent to form a chemical bond; n is 1 or 0 provided that n is 0 when X is a halogen atom; B represents a hydrogen atom, an aliphatic group, an aromatic group, a heterocyclic group, an acyl group or a sulfonyl group; and $Y_1$ represents a group capable of promoting the addition of an aromatic amine developing agent to the compound represented by formula (V); provided that $R_{21}$ and X in formula (IV) and $Y_1$ and $R_{22}$ or B in formula (V), may be linked to form a ring; compounds having at least two moieties may be formed via $R_{21}$ or X in formula (IV) and $R_{22}$, B Or $Y_1$ in formula (V); and $$R_{30}—Z \quad \text{(VI)}$$

wherein $R_{30}$ represents an aliphatic group, an aromatic group or a heterocyclic group; and Z represents a nucleophilic group or a group capable of decomposing in the photographic material to release a nucleophilic group; compounds having at least two moieties may be formed via $R_{30}$ or Z.

DETAILED DESCRIPTION OF THE INVENTION

In the present invention, compounds represented by formula (II) or (III) are image stabilizers and compounds represented by formula (IV), (V) or (VI) are anti-staining agents. When the stabilizer and the anti-staining agent are used in combination in a photographic material containing a magenta coupler represented by formula (I), effects of use these compounds are obtained synergistically more remarkably.

In the present invention an acyl, sulfonyl (in the case where the group is a monovalent group) and sulfinyl (in the case where the group is a monovalent group) groups or moieties include an aliphatic and aromatic acyl, sulfonyl and sulfinyl groups or moieties. Additionally, in the present invention an aliphatic group include a straight chain, branched chain and cyclo alkyl group, an alkenyl group and an alkinyl group, and these groups may be further substituted. Furthermore, a heterocyclic group or moiety includes a 5- to 7-membered ring group or moiety containing at least one of N, S and O atoms as hetero atom.

Of the couplers represented by formula (I), those represented by formula (Ia), (Ib), (Ic), (Id) and (Ie) are preferred:

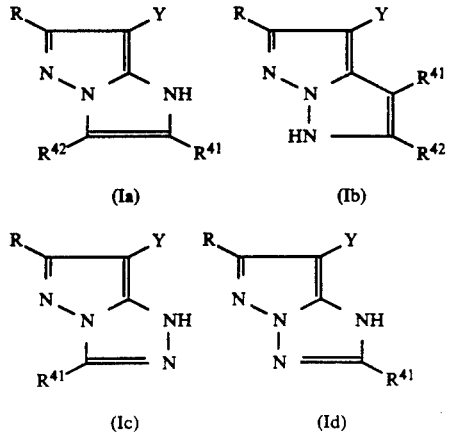

(Ia) (Ib) (Ic) (Id)

-continued

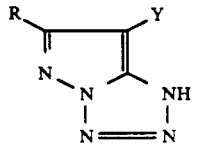

(Ie)

The substituent group in formulae (Ia) to (Ie) are now described in greater detail. R has the same meanings as R in formula (I). R, $R^{41}$ and $R^{42}$, which may be the same or different, each represents a hydrogen atom or a substituent. Examples of the substituent includes aliphatic groups, aromatic groups, heterocyclic groups which bonds via a carbon atom, or coupling-off groups.

The aliphatic groups are straight chain, branched chain or cyclic alkyl groups (for example methyl, ethyl, isopropyl, t-butyl, cyclohexyl), alkenyl groups (for example, vinyl, allyl) or alkinyl groups, and these may be further substituted with substituent groups. The aromatic groups are carbocyclic aromatic groups (for example, phenyl, naphthyl) or heterocyclic aromatic groups (for example, furyl, thienyl, pyrazolyl, pyridyl, indolyl), and they may be single ring systems or condensed ring systems (for example, benzofuryl, phenanthrizinyl). Moreover, these aromatic groups may have substituent groups.

The heterocyclic groups which bond via a carbon atom are preferably groups which have a from three to ten membered ring structure comprised of atoms selected from carbon atoms, oxygen atoms, nitrogen atoms, sulfur atoms, and hydrogen atoms, and the heterocyclic ring itself may be saturated or unsaturated, and it may be substituted further with substituent groups (for example, chromanyl, pyrrolidyl, pyrrolinyl, morpholinyl).

The coupling-off group which can be eliminated in a coupling reaction with the oxidized product of a developing agent. The coupling-off group is a group in which the coupling active carbon atom and a aliphatic group, aromatic group, heterocyclic group, aliphatic, aromatic or heterocyclic sulfonyl group, or an aliphatic, aromatic or heterocyclic carbonyl group are bonded via an oxygen, nitrogen or sulfur atom; a halogen atom and an aromatic azo group. In the case of the heterocyclic ring it may be bonded via the abovedescribed hetero atom in the heterocyclic ring. The aliphatic groups, aromatic groups or heterocyclic groups which are contained within these coupling-off groups may be substituted with the substituent groups. The aliphatic group, the aromatic group and the heterocyclic group may be unsubstituted or substituted with groups selected, for example, from alkyl groups, aryl groups, heterocyclic groups, alkoxy groups (for example, methoxy, 2-methoxyethoxy), aryloxy groups (for example, 2,4-di-tert-amylphenoxy, 2-chlorophenoxy, 4-cyanophenoxy), alkenyloxy groups (for example, 2-propenyloxy), acryl groups (for example, acetyl, benzoyl), $R^{43}OCO$—, $R^{43}COO$—, $R^{43}OSO_2$— and $R^{43}SO_2O$— wherein $R^{43}$ represents an alkyl group or an aryl group (for example, butoxycarbonyl, phenoxycarbonyl, acetoxy, benzoyloxy, butoxysulfonyl, toluenesulfonyloxy), amido groups (for example, acetylamino, methanesulfonamido), carbamoyl groups (for example, dimethylcarbamoyl, ethylcarbamoyl), sulfamoyl groups (for example, butylsulfamoyl), imido groups (for example, succinimido, hydantoinyl), ureido groups (for example, phenylureido, dimethylureido), aliphatic or aromatic sulfonyl groups (for example, methanesulfonyl, phenylsulfonyl), aliphatic or aromatic thio groups (for example, ethylthio, phenylthio), hydroxyl groups, cyano groups, carboxyl groups, nitro groups, sulfo groups, and halogen atoms. R, $R^{41}$ and $R^{42}$ may also be $R^{44}O$—, $$R^{44}-\underset{\underset{O}{\|}}{C}-,\ R^{44}\underset{\underset{O}{\|}}{C}O-,$$

$R^{44}S$—, $R^{44}$—SO—, $R^{44}SO_2$, $R^{44}SO_2NH$, $$R^{44}-\underset{\underset{O}{\|}}{C}NH-,\ R^{44}NH-,\ R^{44}O\underset{\underset{O}{\|}}{C}NH-,$$

a hydrogen atom, a halogen atom, a cyano group or an imido group. $R^{44}$ represents an alkyl group, an aryl group or a heterocyclic group.

R, $R^{41}$ and $R^{42}$ may also be carbamoyl groups, sulfamoyl groups, ureido groups or sulfamoyl amino groups, and the nitrogen atoms in these groups may be substituted with any substituent groups for R, $R^{41}$ and $R^{42}$. Among the substituent groups the alkyl groups, branched alkyl groups, aryl groups, alkoxy groups, aryloxy groups and ureido groups, for example, are preferred.

Y has the same meaning as defined in formula (I), i.e., is a hydrogen atom, a coupling-off group or a non-coupling-off substituent group that includes the aliphatic group, the aromatic group and the heterocyclic group having a bonding via a carbon atom, which are defined for R, $R^{41}$ and $R^{42}$.

When Y represents a coupling-off group which can be eliminated in a coupling reaction with the oxidized product of a developing agent (referred to herein as a "coupling-off group"), the coupling-off group is a group in which the coupling active carbon atom and an aliphatic group, aromatic group, heterocyclic group, aliphatic, aromatic or heterocyclic sulfonyl group, or an aliphatic, aromatic or heterocyclic carbonyl group are bonded via an oxygen, nitrogen or sulfur atom; a halogen atom and an aromatic azo group. The aliphatic groups, aromatic groups or heterocyclic groups which are contained within these coupling-off groups may be substituted with the substituent groups described for R, $R^{41}$ and $R^{42}$.

Specific examples of coupling-off groups include halogen atoms (for example, fluorine, chlorine, bromine), alkoxy groups (for example, ethoxy, dodecyloxy, methoxyethoxy, carboxypropyloxy, methylsulfonylethoxy), aryloxy groups (for example, 4-chlorophenoxy, 4-methoxyphenoxy, 4-carboxyphenoxy), acyloxy groups (for example, acetoxy, tetradecanoyloxy, benzoyloxy), aliphatic or aromatic sulfonyloxy groups (for example, methanesulfonyloxy, toluenesulfonyloxy), acylamino groups (for example, dichloroacetylamino, heptafluorobutyrylamino), aliphatic or aromatic sulfonamido groups (for example, methanesulfonamido, p-toluenesulfonamido), alkoxycarbonyloxy groups (for example, ethoxycarbonyloxy, benzyloxycarbonyloxy), aryloxycarbonyloxy groups (for example, phenoxycarbonyloxy), aliphatic, aromatic or heterocyclic thio groups (for example, ethylthio, phenylthio, tetrazolylthio), carbamoylamino groups (for example, N-methylcarbamoylamino, N-phenylcarbamoylamino), five or six membered nitrogen containing heterocyclic groups (for example, imidazolyl, pyrazolyl, triazolyl, tetrazolyl, 1,2-dihydro-2-oxo-1-pyridyl), imido groups (for example, succinimido, hydantoinyl) and aromatic azo groups (for example, phenylazo). The coupling leaving groups in this present invention may contain photographically useful groups, such as development inhibitors, development accelerators and desilvering accelerators. Among these groups a halogen atom and an arylthio group are preferred.

The couplers may have at least two moieties derived from the above-described couplers. These couplers are formed by bonding at least two moieties at R, Y, $R^{41}$ or $R^{42}$ in formula (Ia), (Ib), (Ic), (Id) or (Ie). Examples of such couplers include bis-compounds, dimers and higher polymers.

Of the couplers represented by formulae (Ia) to (Ie), those represented by formula (Ic) and (Id) are preferred.

Specific examples of couplers represented by formula (I) are indicated below, but the present invention is not to be construed as being limited thereto.

M-1

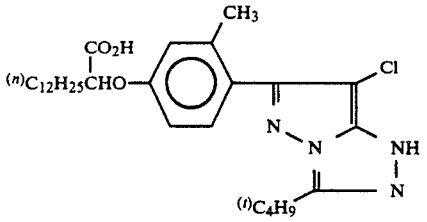

M-2

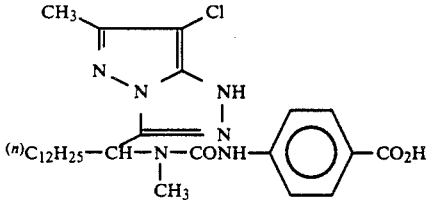

M-3

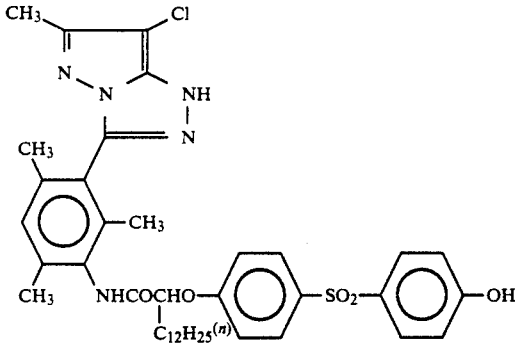

M-4

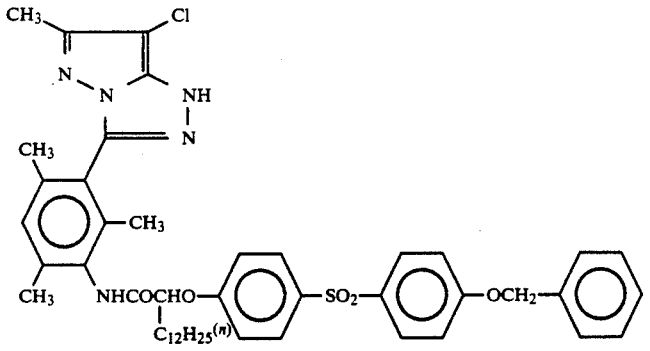

M-5

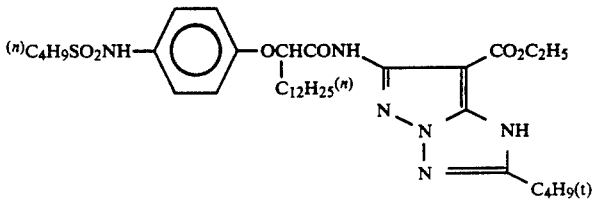

-continued
M-6
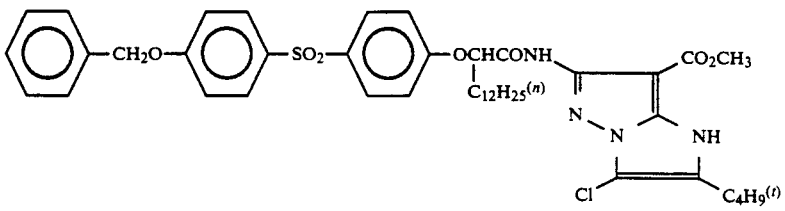
M-7
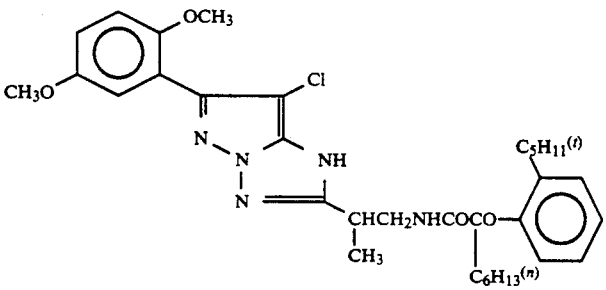
M-8
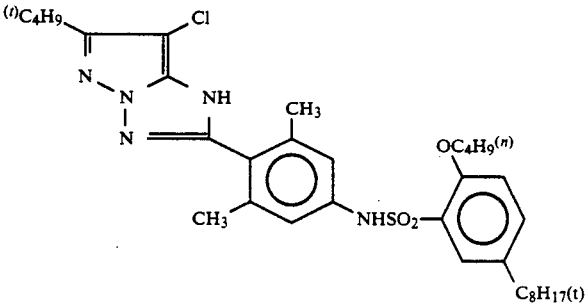

| Compound | R | $R^{41}$ | Y |
|---|---|---|---|
| | | 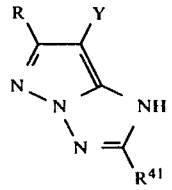 | |
| M-9 | $CH_3$— | 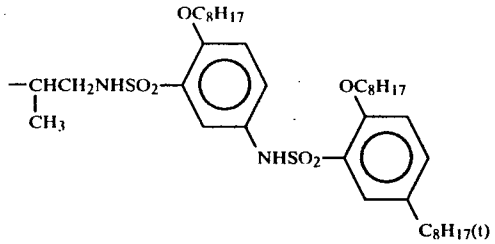 | Cl |
| M-10 | $CH_3$— | 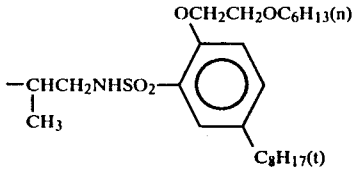 | Cl |
| M-11 | $(CH_3)_3C$— | 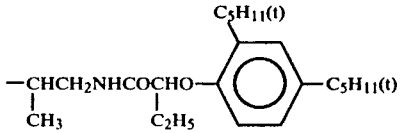 | 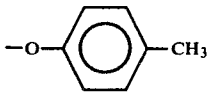 |
| M-12 | 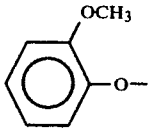 | 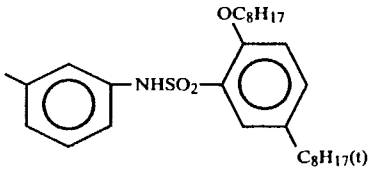 | 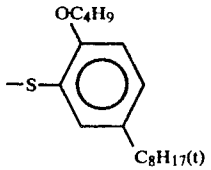 |

-continued
| Compound | R | $R^{41}$ | Y |
|---|---|---|---|
| M-13 | $CH_3$— | 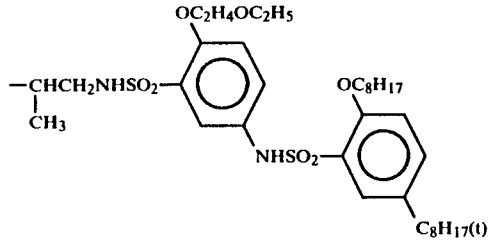 | Cl |
| M-14 | $CH_3$— | 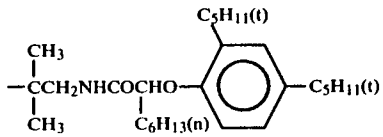 | Cl |
| M-15 | $CH_3$— | 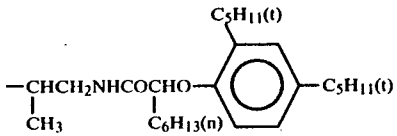 | Cl |
| M-16 | $CH_3$— | 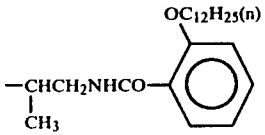 | Cl |
| M-17 | $CH_3$— | 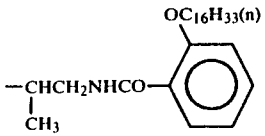 | Cl |

-continued
| Compound | R | $R^{41}$ | Y |
|---|---|---|---|
| M-18 | 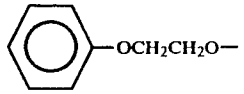 | 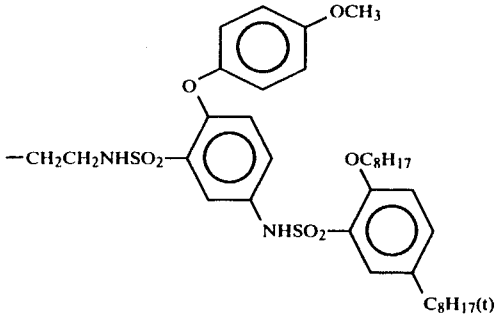 | 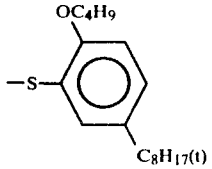 |
| M-19 | $CH_3CH_2O$— | same as in M-18 | same as in M-18 |
| M-20 | 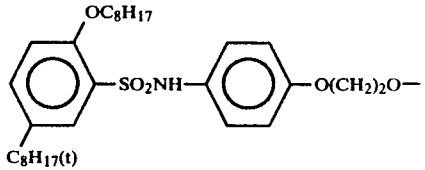 | 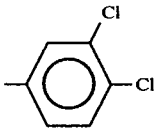 | same as in M-19 |
| M-21 | 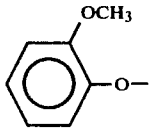 | 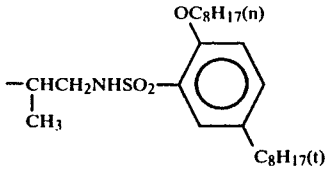 | Cl |
| | 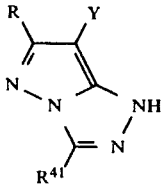 | | |
| M-22 | $CH_3$— | 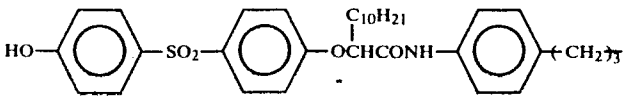 | Cl |

-continued

| Compound | R | $R^{41}$ | Y |
|---|---|---|---|
| M-23 | same as in M-22 | $(n)C_6H_{13}$ \ $CHCH_2SO_2\text{-}(CH_2)_2\text{-}$ / $(n)C_8H_{17}$ | same as in M-22 |
| M-24 | $CH_3$ \ $CH-$ / $CH_3$ | $OC_4H_9$; $SO_2\text{-}(CH_2)_3\text{-}$; $C_8H_{17}(t)$ | same as in M-23 |
| M-25 | $\text{-}(CH-CH_2)_{50}\text{-}(CH_2-C)_{50}\text{-}$; $COOCH_2CH_2OCH_3$; $CH_3$; $CONH-$ (Suffixes of the parenthesis show molar ratio) | $CH_3-CH-$; $CH_2NHSO_2CH_3$ | Cl |
| M-26 | $-O-$ | $OC_8H_{17}$; $(CH_2)_2NHSO_2-$; $C_8H_{17}(t)$ | Cl |
| M-27 | $CH_3-$ | $CH_3$; $CH_3$; $CH_3$; $NHCOCHO-$; $(n)C_{10}H_{21}$; $-SO_2-$; $-OCH_2-$ | Cl |

-continued
| Compound | R | $R^{41}$ | Y |
|---|---|---|---|
| M-28 | $(CH_3)_3C-$ | 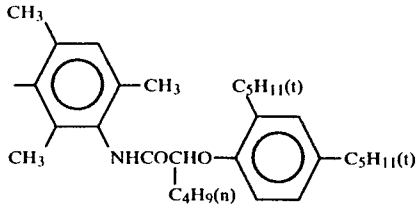 | Cl |
| M-29 | 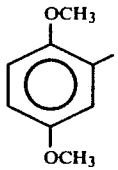 | 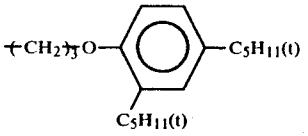 | Cl |
| M-30 | $CH_3-$ | 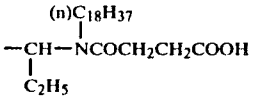 | Cl |

M-31

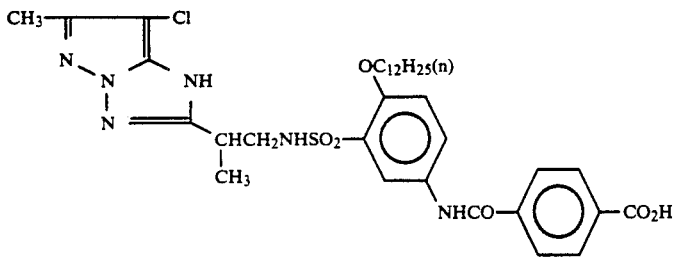

M-32

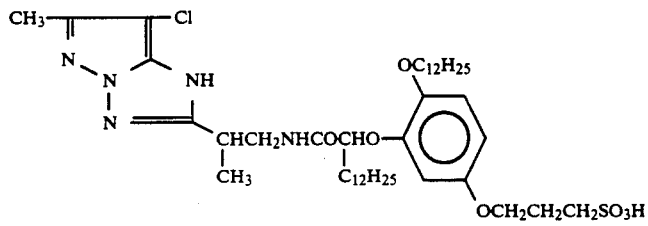

M-33

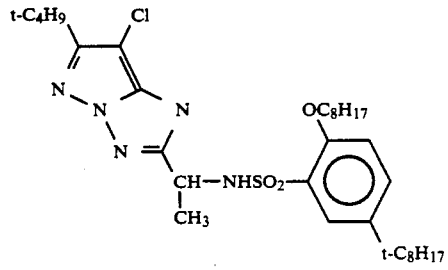

M-34

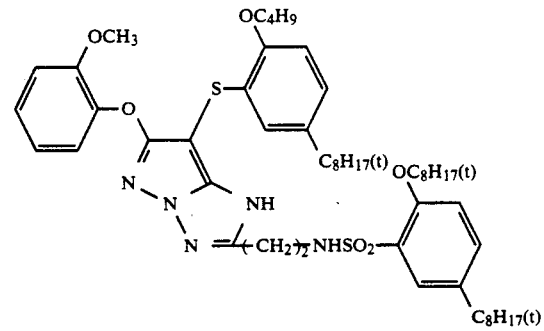

Specific examples of pyrazoloazole magenta couplers represented by formula (I) which can be used in this present invention, and methods for their preparation are disclosed, for example, in JP-A-59-162548, JP-A-60-43659, JP-A-59-171956, JP-A-60-33552, JP-A 60-172982, JP-A-61-292143, JP-A-63-231341, JP-A-63-291058, and U.S. Pat. Nos. 3,061,432 and 4,728,598.

The compounds represented by formula (II) are now described in greater detail.

In formula (II), $R_1$, $R_2$, $R_5$ and $R_6$, which may be the same or different, each represents a hydrogen atom, an alkyl group (a straight chain, branched chain or cyclic alkyl group, for example, methyl, ethyl, isopropyl, tert-butyl, octyl, decyl, hexadecyl, octadecyl, cyclohexyl, benzyl), an alkenyl group (for example, vinyl, allyl, oleyl, cyclohexenyl), or an aryl group example, phenyl, naphthyl). $R_1$ and $R_2$, and $R_5$ and $R^6$, may be linked to form a five to seven membered ring. This ring may be a saturated or unsaturated hydrocarbyl or heterocyclic ring (with N, O, or S, for example, as hetero atoms).

$R_3$ and $R^4$, which may be the same or different, each represents a hydrogen atom, an alkyl group (a linear chain, branched or cyclic alkyl group, for example, methyl, ethyl, isopropyl, tert-butyl, octyl, decyl, hexadecyl, octadecyl, cyclohexyl, benzyl) or an aryl group (for example, phenyl, naphthyl). $R_7$ represents a hydrogen atom or an alkyl group (a straight chain, branched chain or cyclic alkyl group, for example methyl, ethyl, propyl, iso-propyl, butyl, tert-butyl, octyl, decyl, hexadecyl, octadecyl, cyclohexyl, benzyl).

The alkyl groups, alkenyl groups and aryl groups represented by $R_1$ to $R_7$ may be further substituted with substituent groups. Examples of such substituent groups include alkyl groups, aryl groups, alkenyl groups, alkinyl groups, alkoxy groups, alkenoxy groups, aryloxy groups, alkylthio groups, alkenylthio groups, arylthio groups, heterocyclic groups, heterocyclic oxy groups, heterocyclic thio groups, hydroxy groups, halogen atoms, a nitro group, a cyano group, mono- or di-alkylamino groups, acylamino groups, sulfonamido groups, imido groups, carbamoyl groups, sulfamoyl groups, ureido groups, alkoxycarbonylamino groups, aryloxycarbonyl amino groups, sulfo groups, carboxyl groups, sulfonyl groups, sulfinyl groups, silyl groups, silyloxy groups, phosphonyl groups, amino groups, phosphonyloxy groups, acyl groups, acyloxy groups, sulfonyloxy groups and $R_8OCO$—, and $R_8OSO_2$ wherein $R_8$ represents an alkyl group or an aryl group.

Among the compounds represented by formula (II), those represented by formula (IIa) below are preferred:

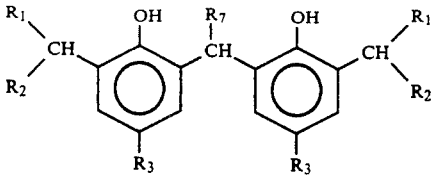

(IIa)

In this formula, $R_1$, $R_2$, $R_3$ and $R_7$ have the same definition as in formula (II).

Those compounds represented by formula (IIa) in which $R_3$ is an alkyl group are preferred.

The most preferred of these compounds are represented by formula (IIb):

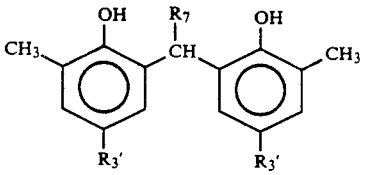

(IIb)

In formula (IIb), $R_3'$ represents an alkyl group. $R_7$ represents a hydrogen atom or an alkyl group (which preferably has from 1 to 20 carbon atoms).

Those compound represented by formula (IIb) in which $R_3'$ is a methyl group are especially good in respect of the effect of this present invention.

Specific examples of compounds wrepresented by formula (II) are indicated below, but the invention is not to be construed as being limited to these examples.

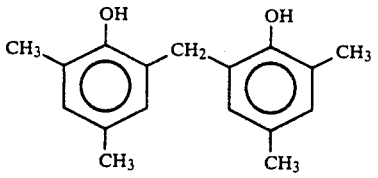

(II-1)

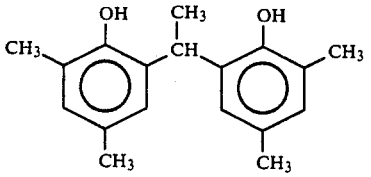

(II-2)

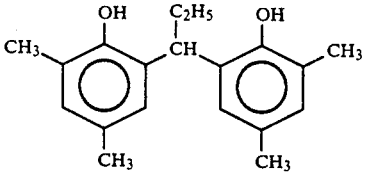

(II-3)

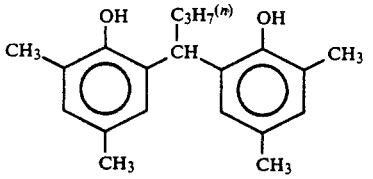

(II-4)

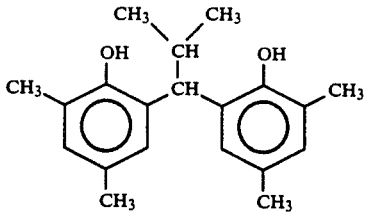

(II-5)

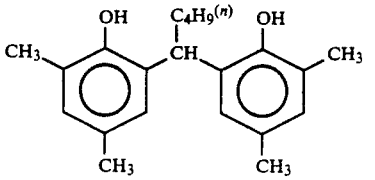

(II-6)

-continued
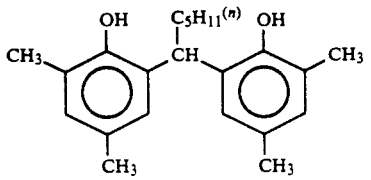
(II-7)
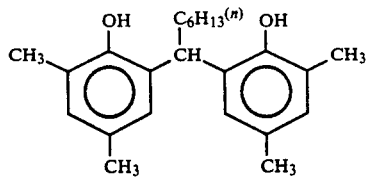
(II-8)
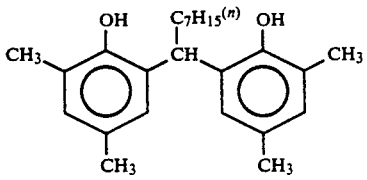
(II-9)
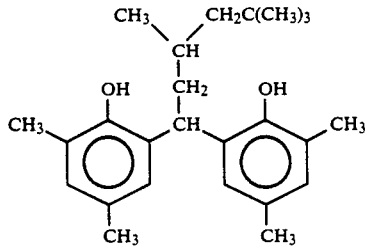
(II-10)
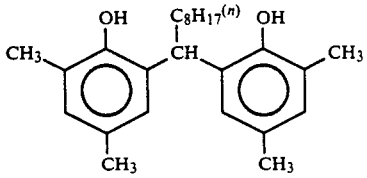
(II-11)
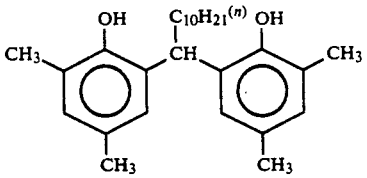
(II-12)
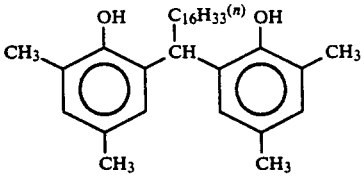
(II-13)
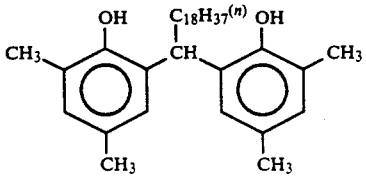
(II-14)

-continued
(II-15)
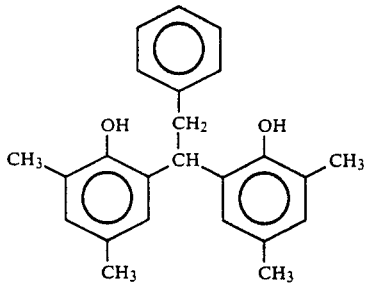
(II-16)
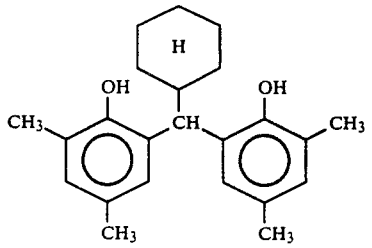
(II-17)
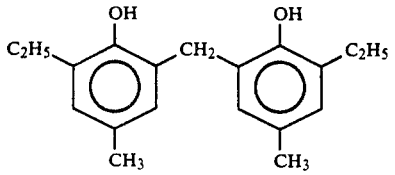
(II-18)
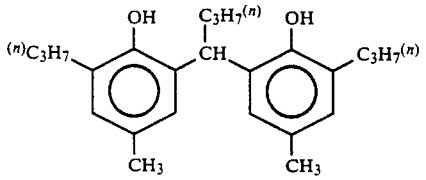
(II-19)
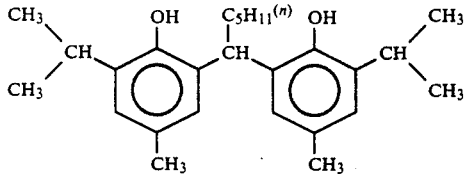
(II-20)
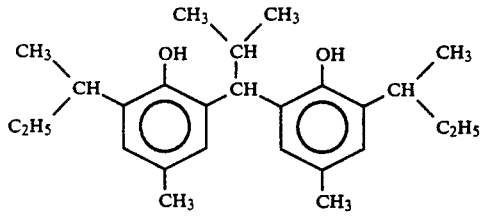
(II-21)
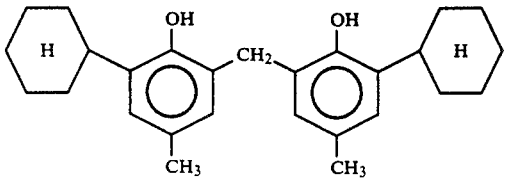

-continued
(II-22)
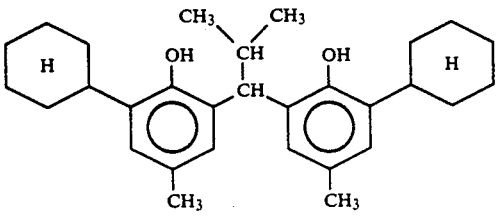
(II-23)
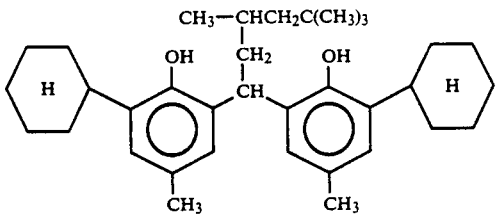
(II-24)
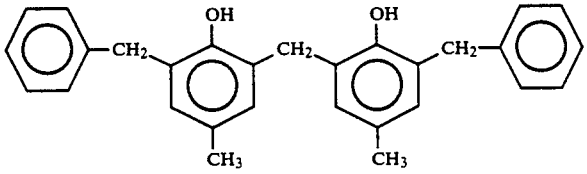
(II-25)
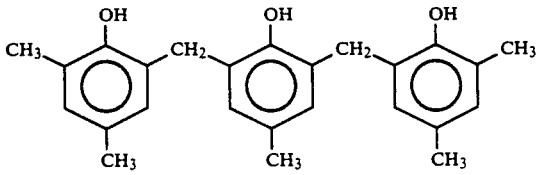
(II-26)
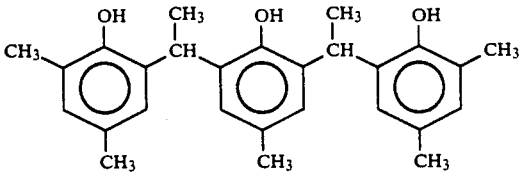
(II-27)
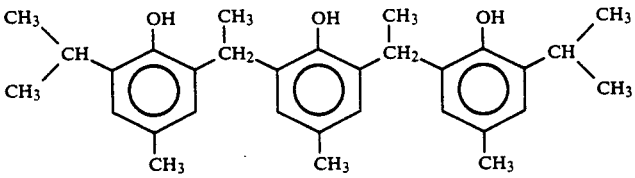
(II-28)
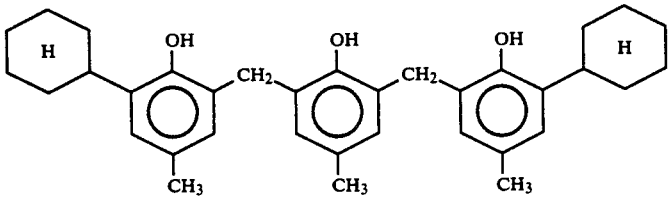
(II-29)
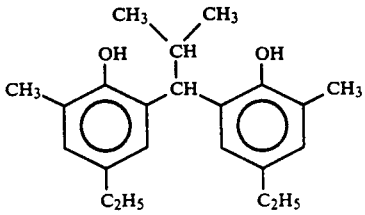

-continued
(II-30)
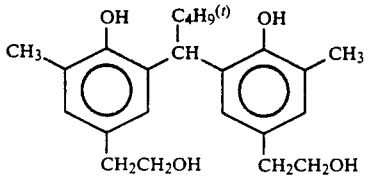
(II-31)
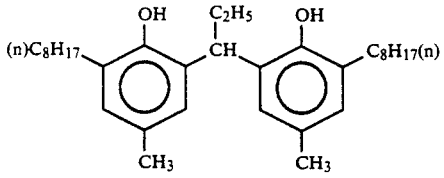
(II-32)
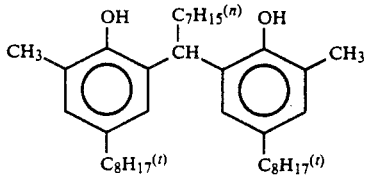
(II-33)
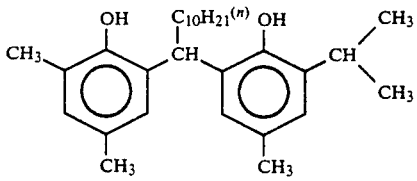
(II-34)
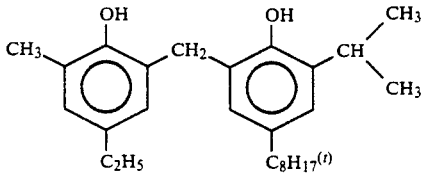
(II-35)
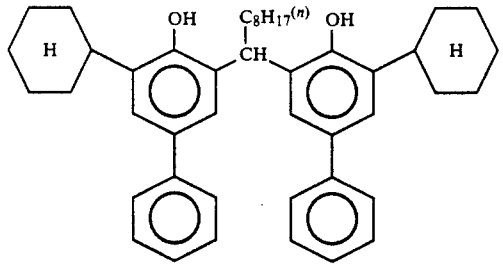
(II-36)
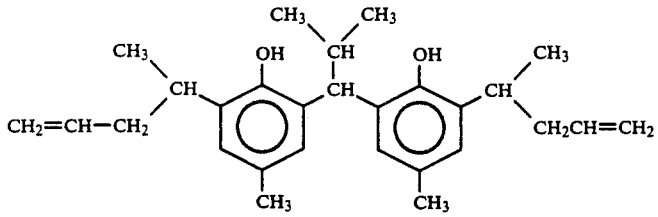
(II-37)
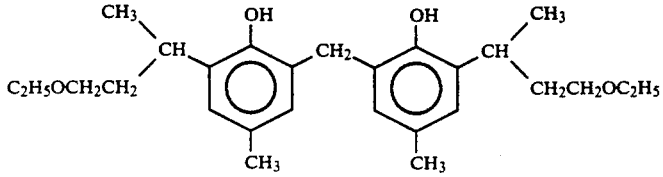

-continued

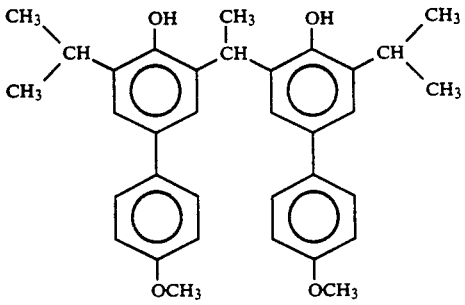

(II-38)

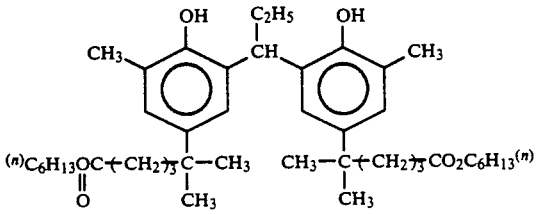

(II-39)

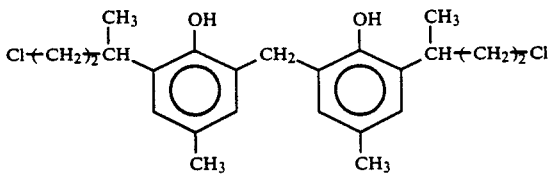

(II-40)

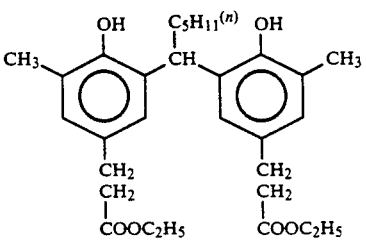

(II-41)

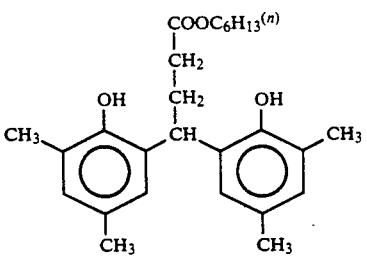

(II-42)

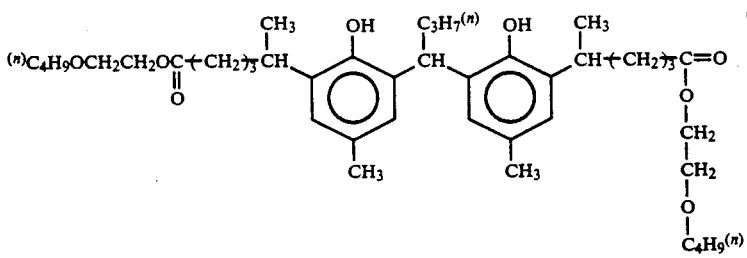

(II-43)

Compounds represented by formula (II) of the present invention can be prepared, for example, using the methods disclosed in British Patent 788,794, West German Patent 1,965,017, *J. Am. Chem. Soc.*, 74, 3410 (1952) and ibid, 75, 5579 (1953), and methods based upon these methods.

The compounds represented by formula (III) are now described in greater detail.

In formula (III) $R_{11}$ represents an alkyl group preferably having from 1 to 25 carbon atoms (a straight chain, branched chain or cyclic alkyl group, for example, methyl, ethyl, propyl, isopropyl, butyl, tertbutyl, hexyl, octyl, decyl, dodecyl, hexadecyl, octadecyl, cyclohexyl, benzyl), an alkenyl group (for example, vinyl, allyl, octadecenyl, cyclohexenyl), or an aryl group (for example, phenyl naphthyl). $R_{12}$ and $R_{13}$, which may be the same or different, each represents a hydrogen atom, an alkyl group (a straight chain, branched chain or cyclic alkyl group, for example, methyl, ethyl, isopropyl, butyl, sec-butyl, tert-butyl, hexyl, decyl, octadecyl, cyclohexyl, benzyl), and alkenyl group (for example, vinyl, allyl, octadecenyl, cyclohexenyl), an aryl group (for example, phenyl, naphthyl), an acylamino group (for example, acetylamino, propionylamino, benzamino), a mono- or di-alkylamino group or a cycloalkyl amino group (for example, N-ethylamino, N,N-diethylamino, N,N-dihexylamino, piperidino, morpholino, N-cyclohexylamino, N (tertbutyl)amino) —$OR_{11}$, —$SR_{11}$ or a halogen atom (for example, fluorine, chlorine, bromine). $R_{14}$, $R_{15}$, $R_{16}$ and $R_{17}$, which may be the same or different, each represents a hydrogen atom, an alkyl group (a straight chain, branched chain or cyclic alkyl group, for example, methyl, ethyl, propyl, isopropyl, butyl, tert-butyl, hexyl, octyl, decyl, octadecyl, cyclohexyl, benzyl) or an aryl group (for example, phenyl, naphthyl).

Of the groups defined for $R_{11-17}$ the alkyl groups, alkenyl groups and aryl groups may be substituted with substituent groups, and examples of suitable substituent groups include alkyl groups, aryl groups, alkenyl groups, alkinyl groups, alkoxy groups, alkenoxy groups, aryloxy groups, alkylthio groups, alkenylthio groups, arylthio groups, heterocyclic groups, heterocyclic oxy groups, heterocyclic thio groups, hydroxyl groups, halogen atoms, a nitro group, a cyano group, mono- or di-alkylamino groups, acylamino groups, sulfonamido groups, imido groups, carbamoyl groups, sulfamoyl groups, ureido groups, urethane groups, sulfo groups, carboxyl groups, sulfonyl groups, sulfinyl groups, silyl groups, silyloxy groups, a phosphonyl group, an amino group, a phosphonyloxy group, acyl groups, acyloxy groups, sulfonyloxy groups, $R_{18}OCO$— and $R_{18}OSO_2$— (wherein $R_{18}$ represents an alkyl group or an aryl group).

Those compounds represented by formula (III) in which $R_{11}$ l is an alkyl group and $R_{12}$ and $R_{13}$ are hydrogen atoms, alkyl groups, alkoxy groups or alkylthio groups are preferred from the viewpoint of the effect of the present invention.

$R_{14}$ to $R_{17}$ each is preferably a hydrogen atom or an alkyl group having from 1 to 3 carbon atoms.

Specific examples of compounds represented by formula (III) are indicated below, but the invention is not to be construed as being limited to these examples.

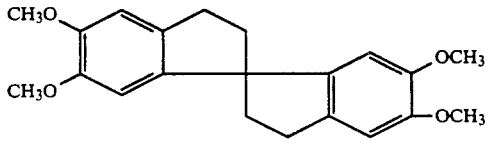

(III-1)

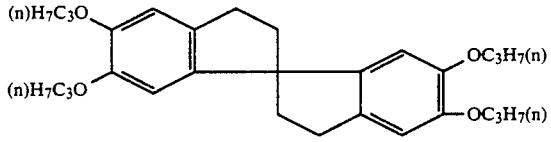

(III-2)

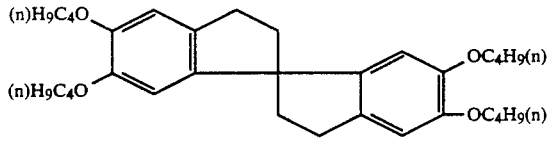

(III-3)

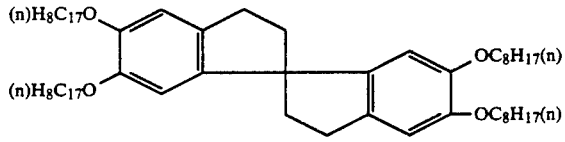

(III-4)

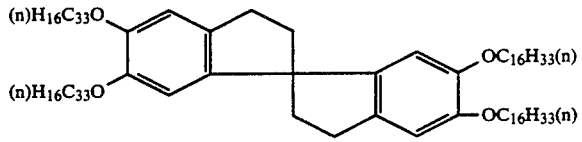

(III-5)

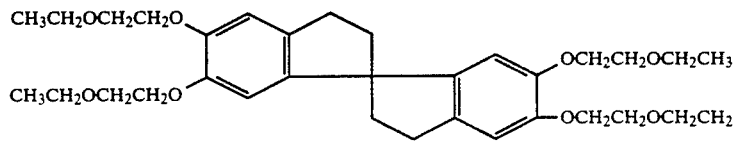

(III-6)

-continued
(III-7)
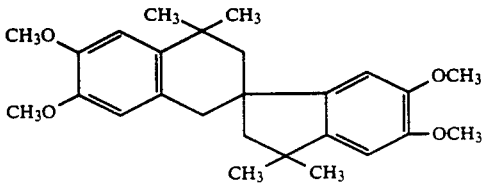
(III-8)
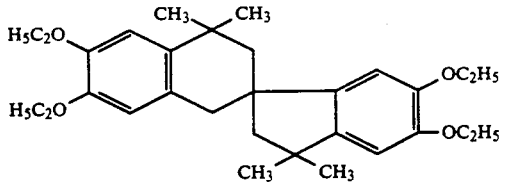
(III-9)
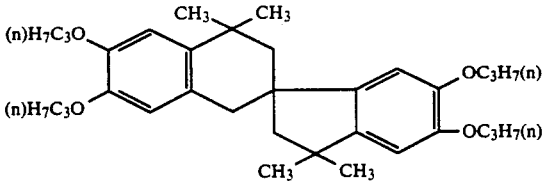
(III-10)
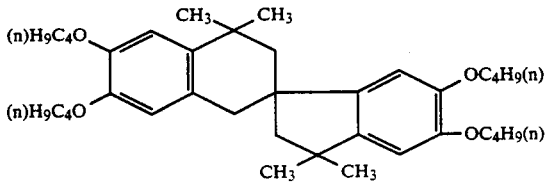
(III-11)
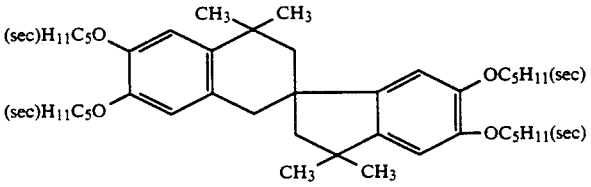
(III-12)
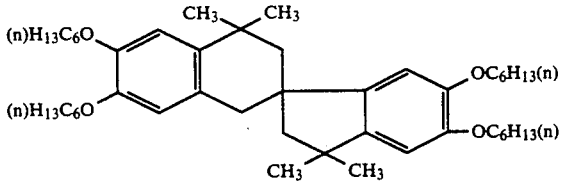
(III-13)
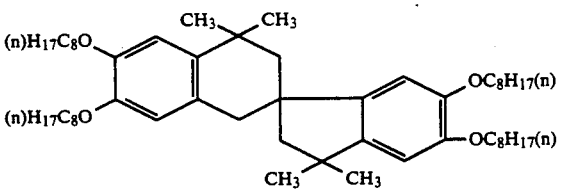
(III-14)
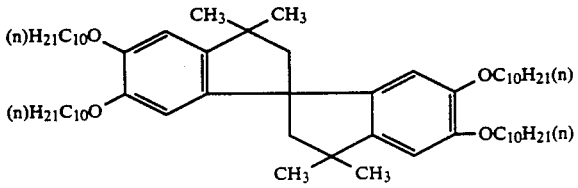

-continued
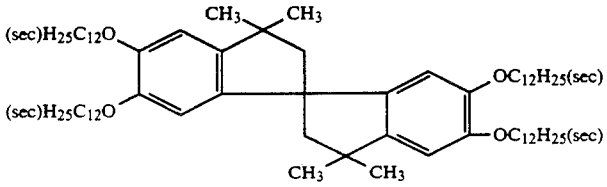
(III-15)
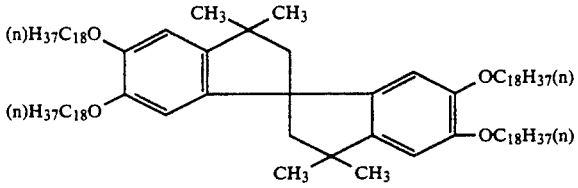
(III-16)
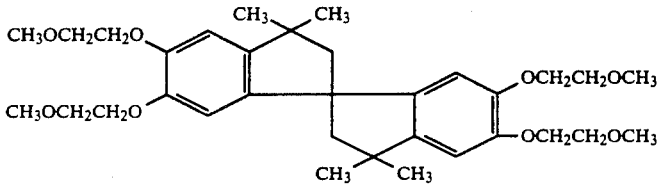
(III-17)
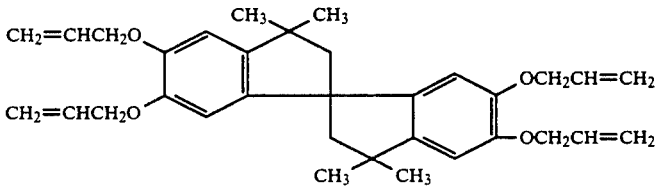
(III-18)
(III-19)
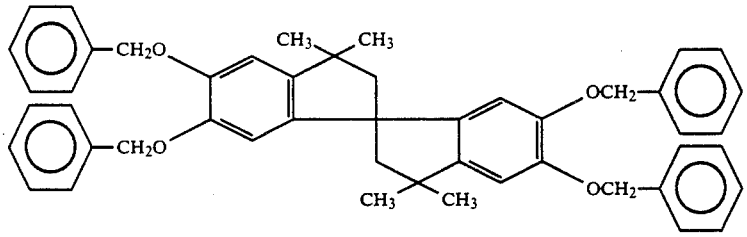
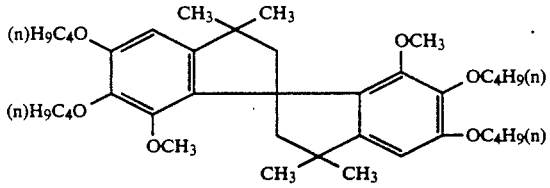
(III-20)
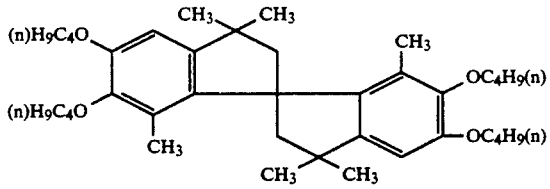
(III-21)
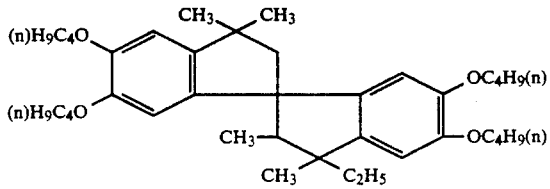
(III-22)

-continued

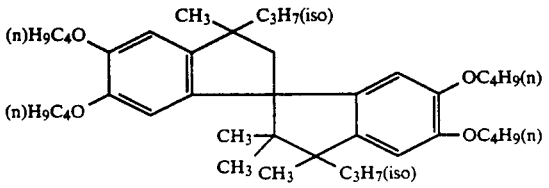

(III-23)

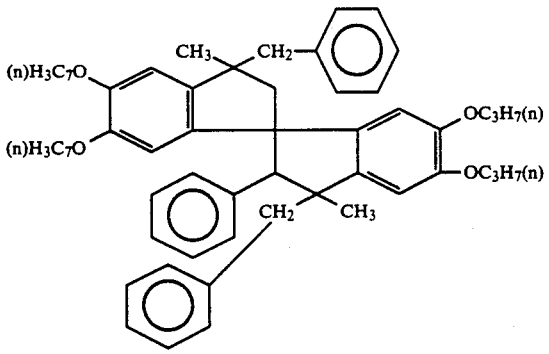

(III-24)

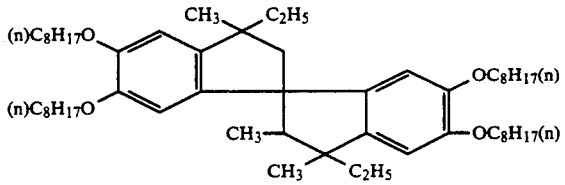

(III-25)

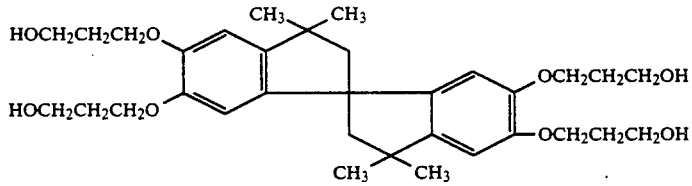

(III-26)

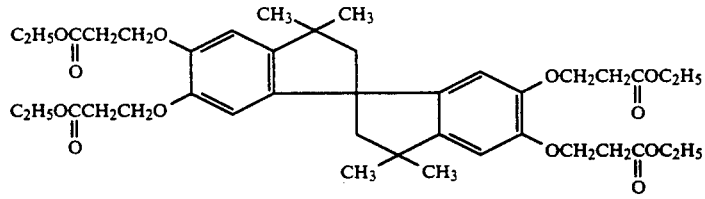

(III-27)

The compounds represented by formula (III) can be prepared using the method disclosed in U.S. Pat. 4,360,589.

The compounds represented by formulae (IV), (V) and (VI) are now described in greater detail.

The compounds represented by formulae (IV) and (V) are preferably compounds of which the second order reaction rate constant $k_2$ (80° C.) with p-anisidine measured using the method described in JP-A-63-158545 (corresponding to European Patent 258,662) is within the range of 1.0 l/mol·sec to $1\times10^{-5}$ l/mol·sec. The compounds represented by formula (VI) are preferably compounds wherein Z is a group derived from a nucleophilic functional group of which the Pearson nucleophilicity $^{n}CH_3I$ value (R. G. Pearson et al., *J. Am. Chem. Soc.*, 90, 319 (1968) is at least 5.

The combined use of (i) at least one of compounds represented by formula (IV) or (V) and (ii) at least one of compounds represented by formula (VI) is preferred. The preferred molar ratio of (i) and (ii) is 10:1 to 1:10, more preferably 5:1 to 1:2.

Each of the compounds represented by formulae (IV), (V) and (VI) is now described in greater detail.

The aliphatic groups represented by $R_{21}$, $R_{22}$, B and $R_{30}$ are straight chain, branched chain or cyclic alkyl groups, alkenyl groups or alkinyl groups, and these may be further substituted with substituent groups. The aromatic groups represented by $R_{21}$, $R_{22}$, B and $R_{30}$ may be carbocyclic aromatic groups (for example, phenyl, naphthyl) or heterocyclic aromatic groups (for example, furyl, thienyl, pyrazolyl, pyridyl, indolyl), and they may be single ring systems or condensed ring systems (for example, benzofuryl, phenanthrizinyl). Moreover, these aromatic groups may have substituent groups.

The heterocyclic groups represented by $R_{21}$, $R_{22}$, B and $R_{30}$ are preferably groups which have a from three to ten membered ring structure comprised of atoms selected from carbon atoms, oxygen atoms, nitrogen atoms, sulfur atoms, and hydrogen atoms, and the heterocyclic ring itself may be saturated or unsaturated, and it may be substituted further with substituent groups (for example, chromanyl, pyrrolidyl, pyrrolinyl, morpholinyl).

X in formula (IV) represents a group which is eliminated on reaction with an aromatic amine developing agent, and it is preferably a halogen or a group which is bonded to A via an oxygen atom, a sulfur atom or a nitrogen atom (for example, 2-pyridyloxy, 2-pyrimidyloxy, 4-pyrimidyloxy, 2-(1,2,3-triazine)oxy, 2-benzimidazolyl, 2-imidazolyl, 2-thiazolyl, 2-benzthiazolyl, 2-furyloxy, 2-thiophenyloxy, 4-pyridyloxy 3-isooxazolyloxy, 3-pyrazolidinyloxy, 3-oxo-2-pyrazolonyl, 2-oxo-1-pyridinyl, 4-oxo-1-pyridinyl, 1-benzimidazolyl, 3-pyrazolyloxy, 3H-1,2,4-oxadiazolin-5-oxy, aryloxy, alkoxy, alkylthio, arylthio, substituted N-oxy; these groups may be substituted). n is O where X represents a halogen atom.

A in formula (IV) represents a group which reacts with an aromatic amine developing agent and forms a chemical bond, and it contains a group which contains an atom which has a low electron density, for example,

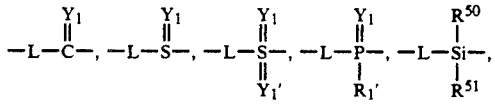

wherein L represents a single bond, an alkylene group,

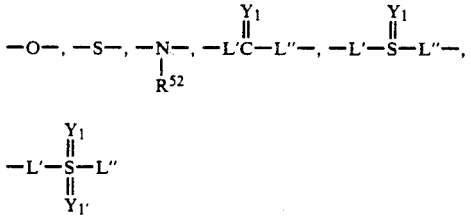

(for example, carbonyl group, sulfonyl group, sulfinyl group, oxycarbonyl group, phosphoryl group, thiocarbonyl group, aminocarbonyl group, silyloxy group).

$Y_1$ has the same definition as $Y_1$ in general formula (V), and $Y_1'$ has the same definition as $Y_1$.

$R^{50}$ and $R^{51}$, which may be the same or different, each represents —L'''—$R_{21}$. $R^{52}$ a hydrogen atom, an aliphatic group (for example, methyl, isobutyl, tertbutyl, vinyl, benzyl, octadecyl, cyclohexyl), an aromatic group (for example, phenyl, pyridyl, naphthyl), a heterocyclic group (for example, piperidinyl, pyranyl, furanyl, chromanyl), an acyl group (for example, acetyl, benzoyl) or a sulfonyl group (for example, methanesulfonyl, benzenesulfonyl).

L', L'' and L''', which may be the same or different, each represents —O—, —S— or

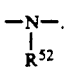

L''' may also represent a single bond.

Among these groups, A is preferably a divalent group represented by

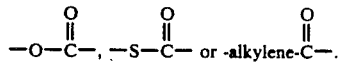

Those compounds represented by formula (IV) which are represented by formulae (IV-a), (IV-b), (IV-c) or (IV-d) are preferred, and they are compounds which react with p-anisidine with a second order reaction rate constant $k_2$ (which is measured in the same manner as described hereinabove at 80° C.) within the range from $1\times10^{-1}$ l/mol·sec to $1\times10^{-5}$ l/mol·sec:

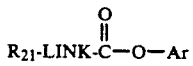

(IV-a)

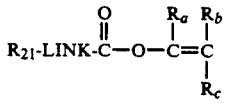

(IV-b)

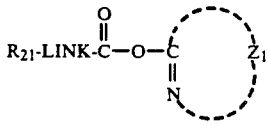

(IV-c)

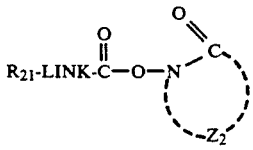

(IV-d)

In these formulae, $R_{21}$ has the same definition as $R_{21}$ in formula (IV). Link represents a single bond or —O—. Ar represents an aromatic group which includes those defined for $R_{21}$, $R_{22}$ and B. However, the group which is released as a result of the reaction with an aromatic amine developing agent is preferably not a hydroquinone derivative, a catechol derivative or a group which is useful as a photographic reducing agent. Ra, Rb and Rc, which may be the same or different, each represents a hydrogen atom or an aliphatic group, aromatic group or heterocyclic group which has the same definition as those defined for $R_{21}$, $R_{22}$ and B. Ra, Rb and Rc may represent alkoxy groups, aryloxy groups, heterocyclic oxy groups, alkylthio groups, arylthio groups, heterocyclic thio groups, amino groups, alkylamino groups, acyl groups, amido groups, sulfonamido groups, sulfonyl groups, alkoxycarbonyl groups, a sulfo group, a carboxyl group, a hydroxyl group, acyloxy groups, ureido groups, alkoxycarbonylamino groups, aryloxycarbonylamino groups, carbamoyl groups or sulfamoyl groups. Here, Ra and Rb or Rb and Rc may be linked to form a five to seven membered heterocyclic ring, and this heterocyclic ring may be substituted with at least one substituent group: it may take the form of a spiro ring or a bicyclo ring: or it may be condensed with an aromatic ring. $Z_1$ and $Z_2$ represent groups of non-metal atoms which are necessary for forming a five to seven membered heterocyclic ring, and this ring may be substituted with at least one substituent group: it may take the form of a spiro or bicyclo ring: or it may be condensed with an aromatic ring. These groups and rings may be substituted.

When in formula (IV-a) in particular, Ar is a carbocyclic aromatic group, the substituents thereon can be adjusted to adjust the second order rate constant $k_2$ with p-anisidine (80° C.) to within the range from $1\times10^{-1}$ l/mol·sec to $1\times10^{-5}$ l/mol·sec, preferably from $1\times10^{-2}$ l/mol·sec to $1\times10^{-4}$ l/mol·sec. Although it depends on the type of group for $R_{21}$, the sum of the Hammett $\sigma$-values for the substituent groups is preferably at least 0.2, more desirably at least 0.4, and most desirably at least 0.6. $R_{21}$ is preferably an aliphatic group, an aromatic group or a heretocyclic group.

In those cases where a compound represented by general formula (IV-a) to (IV-d) is added during the manufacture of a photographic material, the compound itself preferably has at least 13 carbon atoms in total. The compound is preferably one which is not decomposed during development processing. $Y_1$ in general formula (V) is preferably an oxygen atom, a sulfur atom, =N—$R_{24}$ or

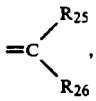

wherein $R_{24}$, $R_{25}$ and $R_{26}$, which may be the same or different, each represents a hydrogen atom, aliphatic groups (for example, methyl, isopropyl, tert-butyl, vinyl, benzyl, octadecyl, cyclohexyl), aromatic groups (for example, phenyl, pyridyl, naphthyl), heterocyclic groups (for example, piperidyl, pyranyl, furanyl, chromanyl), acyl groups (for example, acetyl, benzoyl), or sulfonyl groups (for example, methanesulfonyl, benzenesulfonyl), and $R_{25}$ and $R_{26}$ may be linked to form a ring structure. These groups and rings may be substituted.

Among compounds represented by formulae (IV) and (V) those compounds which are represented by formula (IV) are especially preferred. Among these compounds, those represented by formula (IV-a) or formula (IV-c) are more preferred, and those represented by formula (IV-a) are most preferred.

Z in general formula (VI) represents a nucleophilic group or a group capable of dissociating in the photographic material to release the nucleophilic group. For example, nucleophilic groups in which the atom which chemically bonds directly with the oxidized product of an aromatic amine developing agent is an oxygen atom, a sulfur atom or a nitrogen atom (for example, group which are derived from amine compounds, azide compounds, hydrazine compounds, mercapto compounds, sulfide compounds, sulfinic acid compounds, cyano compounds, thiocyano compounds, thiosulfate compounds, selenium compounds, halide compounds, carboxy compounds, hydroxamic acid compounds, active methylene compounds, phenol compounds, or nitrogen heterocyclic compounds) are known.

Those compounds of formula (VI) which are represented by formula (VI-a) are preferred:

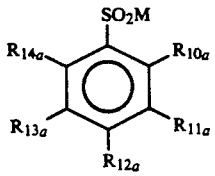

(VI-a)

In this formula, M represents an atom or group of atoms which is an inorganic counter ion (for example, Li, Na, K, Ca, or Mg ion), organic counter ion (for example, triethylammonium, methylammoium, ammonium), or is

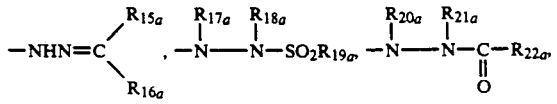

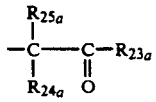

or hydrogen atom, wherein $R_{15a}$ and $R_{16a}$, which may be the same or different, each represents a hydrogen atom, an aliphatic group, an aromatic group or a heterocyclic group. $R_{15a}$ and $R_{16a}$ may be linked to form a five to seven membered ring, preferably a hydrocarbon ring Or a heterocyclic ring. $R_{17a}$, $R_{18a}$, $R_{20a}$ and $R_{21a}$, which may be the same or different, each represents a hydrogen atom, an aliphatic group, an aromatic group, a heterocyclic group, an acyl group, an alkoxycarbonyl group, a sulfonyl group, a ureido group, an alkoxycarbonylamino group, or an aryloxycarbonylamino group, provided that at least one of $R_{17a}$ and $R_{18a}$, and at least one of $R_{20a}$ and $R_{21a}$ represents a hydrogen atom. $R_{19a}$ and $R_{22a}$ represent a hydrogen atom, aliphatic groups, aromatic groups or heterocyclic groups. $R_{19a}$ may also represent an alkylamino group, an arylamino group, an alkoxy group, an aryloxy group, an acyl group, an alkoxycarbonyl group or an aryloxycarbonyl group. Here, at least two of the groups represented by $R_{17a}$, $R_{18a}$ and $R_{19a}$ may be linked to form a five to seven membered ring, and at least two of the groups represented by $R_{20a}$, $R_{21a}$ and $R_{22a}$ may be linked to form a five to seven membered ring. $R_{23a}$ represents a hydrogen atom, an aliphatic group, an aromatic group or a heterocyclic group: and $R_{24a}$ represents a hydrogen atom, an aliphatic group, an aromatic group, a halogen atom, an acyloxy group or a sulfonyl group. $R_{25a}$ represents a hydrogen atom or a hydrolyzable group.

$R_{10a}$, $R_{11a}$, $R_{12a}$, $R_{13a}$ and $R_{14a}$, which may be the same or different, each represents a hydrogen atom, an aliphatic group (for example, methyl, isopropyl, tertbutyl, vinyl, benzyl, octadecyl, cyclohexyl), an aromatic group (for example, phenyl, pyridyl, naphthyl), a heterocyclic group (for example, piperidyl, pyranyl, furanyl, chromanyl), a halogen atom (for example, chlorine, bromine), —$SR_{26a}$, —$OR_{26a}$,

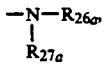

an acyl group (for example, acetyl, benzoyl), an alkoxycarbonyl group (for example, methoxycarbonyl, butoxycarbonyl, cyclohexyloxycarbonyl, octyloxycarbonyl), an aryloxycarbonyl group (for example, phenyloxycarbonyl, naphthyloxycarbonyl), a sulfonyl group (for example, methanesulfonyl, benzenesulfonyl), a sulfonamido group (for example, methanesulfonamido, benzenesulfonamido), a sulfamoyl group, a ureido group, an alkoxycarbonylamino group, an aryloxycarbonylamino group, a carbamoyl group, a sulfo group, a carboxyl group, a nitro group, a cyano group, an alkoxalyl group (for example, methoxalyl, isobutoxalyl, oxtyloxalyl, benzoyloxalyl), an aryloxalyl group (for example, phenoxalyl, naphthoxalyl), a sulfonyloxy group (for example, methanesulfonyloxy, benzenesulfonyloxy),

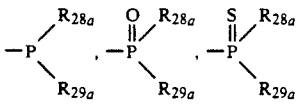

or a formyl group, wherein $R_{26a}$ and $R_{27a}$, which may be the same or different, each represents a hydrogen atom, an aliphatic group, an aromatic group, an acyl group or a sulfonyl group, and $R_{28a}$ and $R_{29a}$, which may be the same or different, each represents a hydrogen atom, an aliphatic group, an aromatic group, an alkoxy group or an aryloxy group. These groups and rings may be substituted.

Compounds represented by formula (VIa) in which the total sum of the Hammet $\alpha$-values of the benzene substituent groups with respect to the $-SO_2M$ group is at least 0.5 are preferred from the view point of the effect of the present invention.

Compounds having at least two moieties may be formed via $R_{21}$ or X in formula (IV), $R_{22}$, B or $Y_1$ in formula (V) and $R_{30}$ or Z in formula (VI). Examples of such compounds include bis-compounds, dimers or higher polymers.

Specific examples of these compounds are indicted below, but the present invention is not to be construed as being limited by these examples.

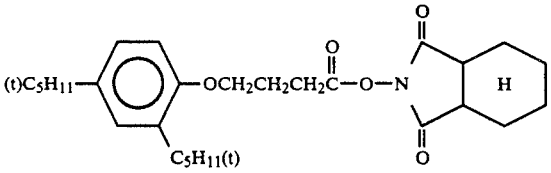

(Ia-1)

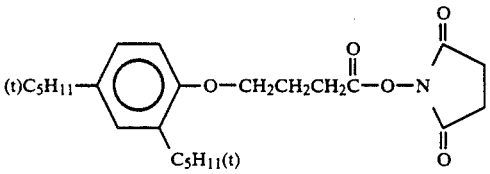

(Ia-2)

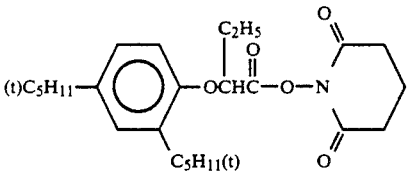

(Ia-3)

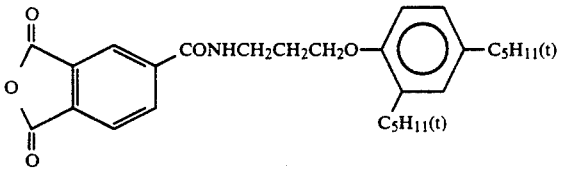

(Ia-4)

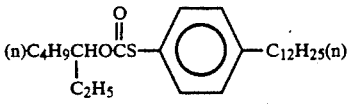

(Ia-5)

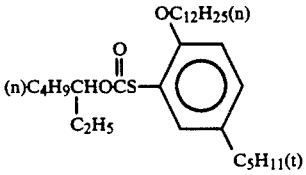

(Ia-6)

$(n)C_{18}H_{37}I$ (Ia-7)

$(n)C_{18}H_{37}Br$ (Ia-8)

-continued
(Ia-9)
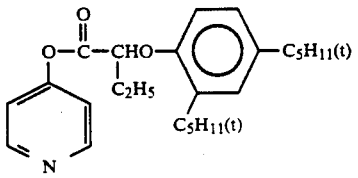
(Ia-10)
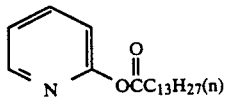
(Ia-11)
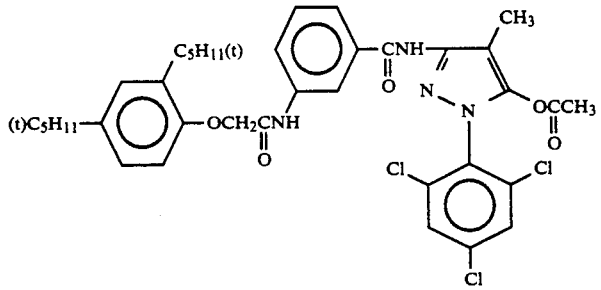
(Ia-12)
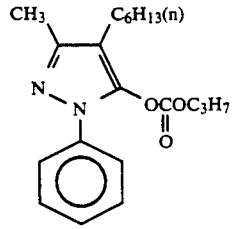
(Ia-13)
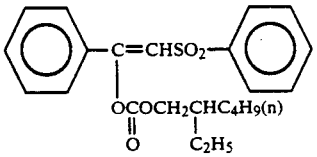
(Ia-14)
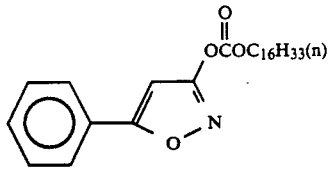
(Ia-15)
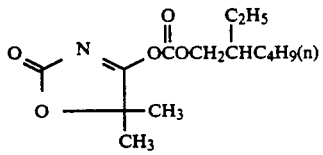
(Ia-16)
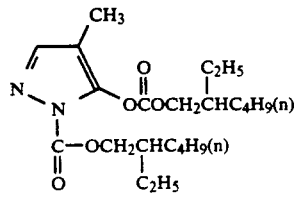

-continued
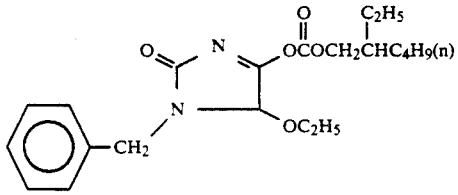
(Ia-17)
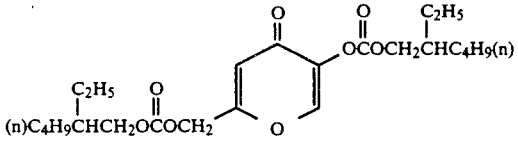
(Ia-18)
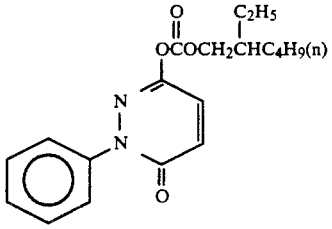
(Ia-19)
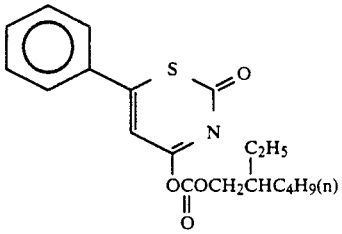
(Ia-20)
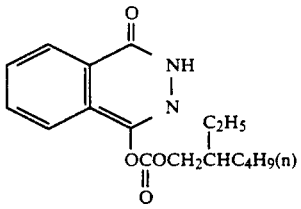
(Ia-21)
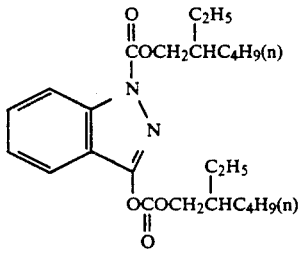
(Ia-22)
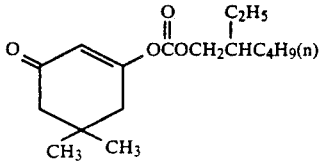
(Ia-23)

-continued
(Ia-24)
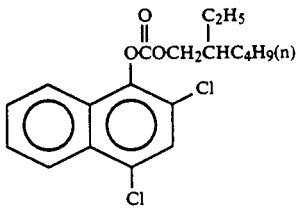
(Ia-25)
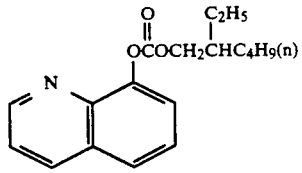
(Ia-26)
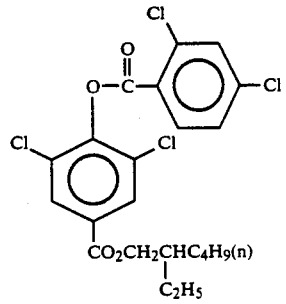
(Ia-27)
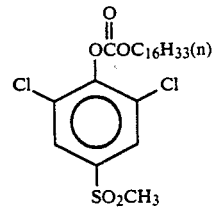
(Ia-28)
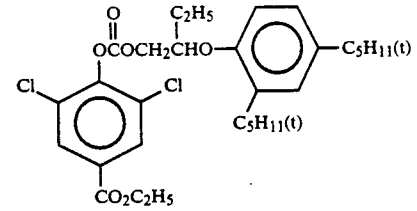
(Ia-29)
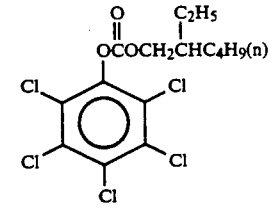
(Ia-30)
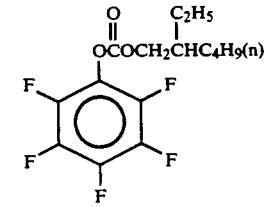

-continued
(Ia-31)
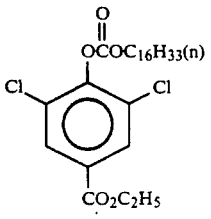
(Ia-32)
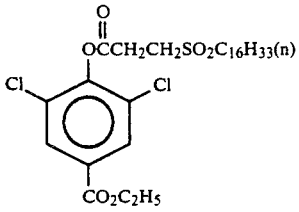
(Ia-33)
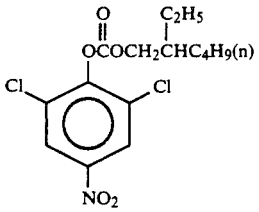
(Ia-34)
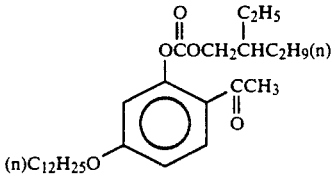
(Ia-35)
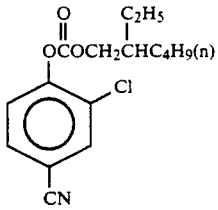
(Ia-36)
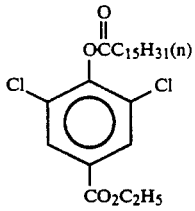
(Ia-37)
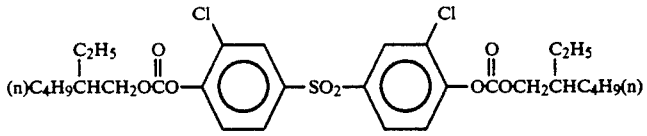
(Ia-38)
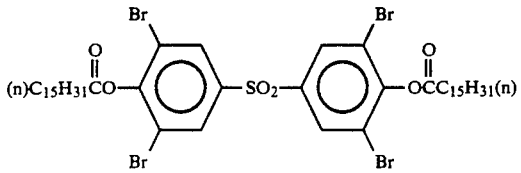

-continued
(Ia-39)
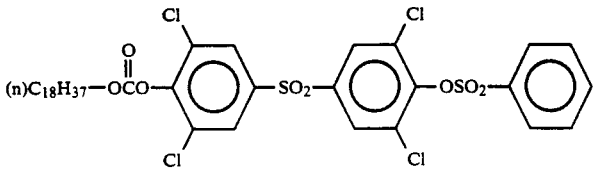
(Ia-40)
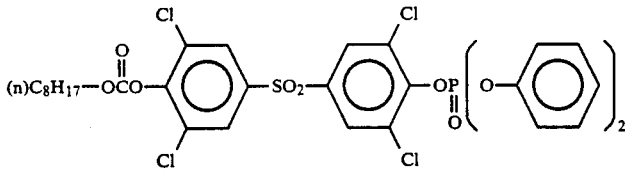
(Ia-41)
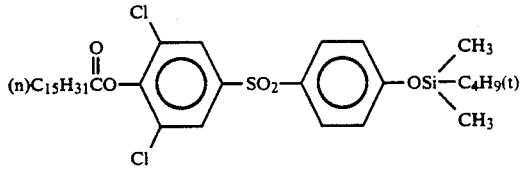
(Ia-42)
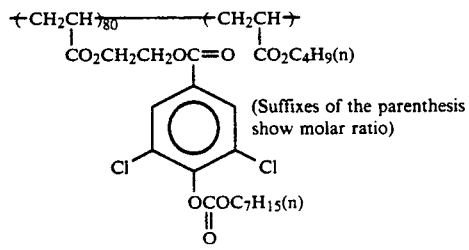
(Suffixes of the parenthesis show molar ratio)
(Ia-43)
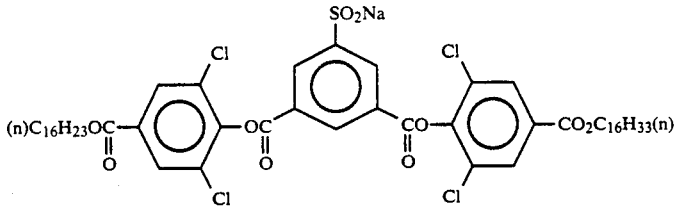
(Ia-44)
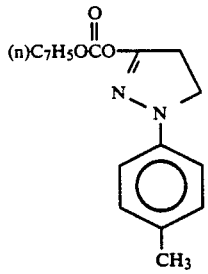
(Ia-45)
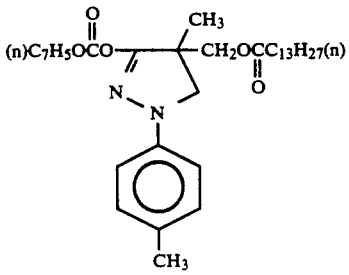

-continued
(Ia-46)
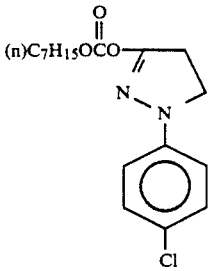
(Ia-47)
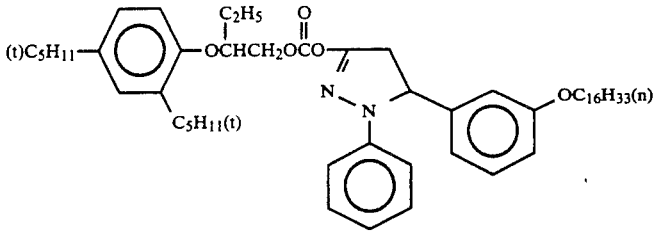
(Ia-48)
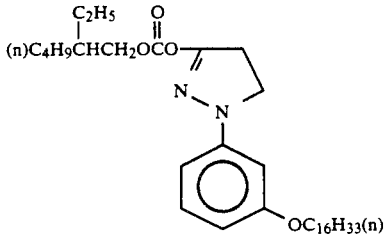
(Ia-49)
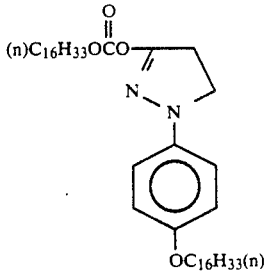
(Ia-50)
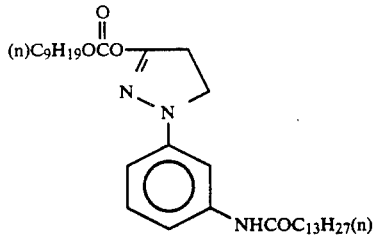
(Ia-51)
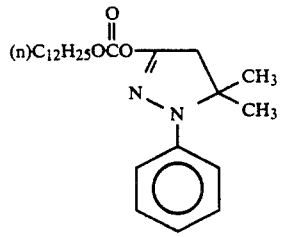

(IIa-1)
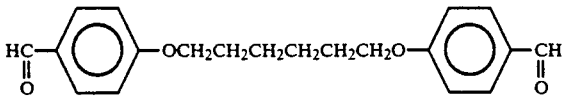
(IIa-2)
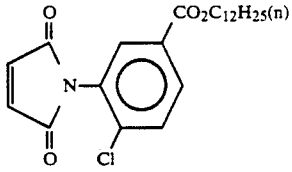
(IIa-3)
$CH_2{=}CH{-}SO_2{-}C_{18}H_{37}(n)$
(IIa-4)
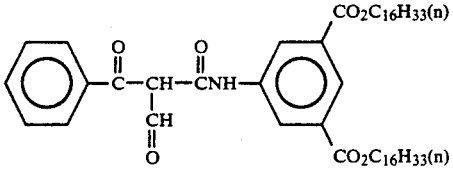
(IIa-5)
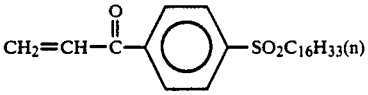
(IIIa-1)
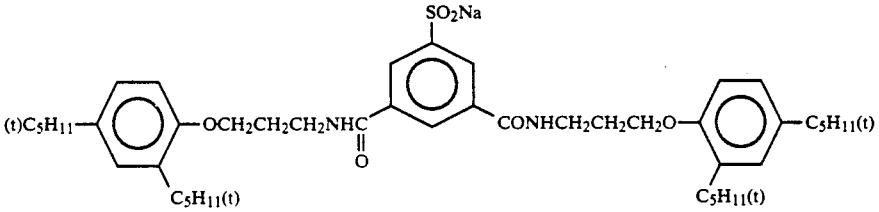
(IIIa-2)
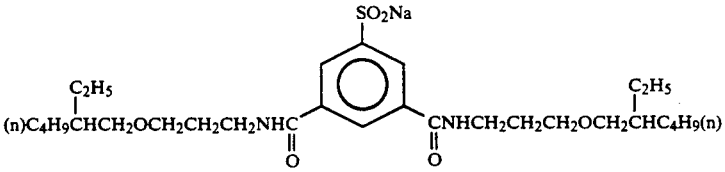
(IIIa-3)
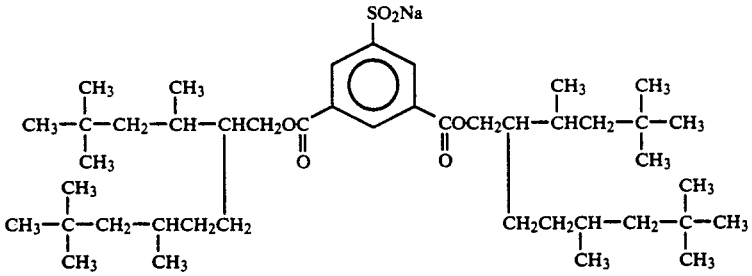
(IIIa-4)
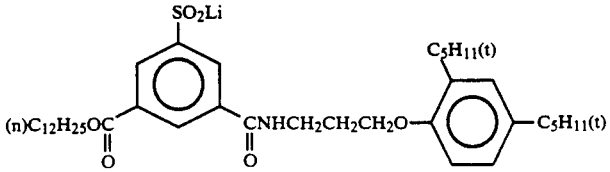

-continued
(IIIa-5)
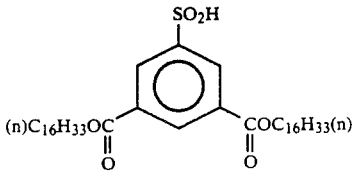
(IIIa-6)
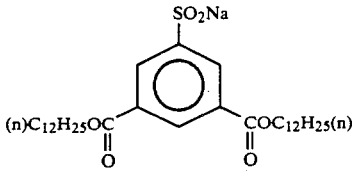
(IIIa-7)
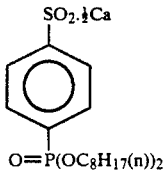
(IIIa-8)
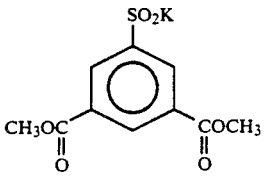
(IIIa-9)
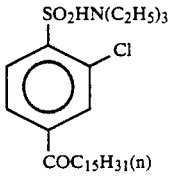
(IIIa-10)
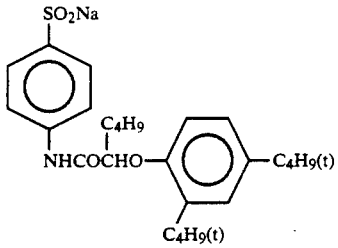
(IIIa-11)
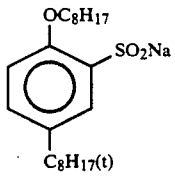
(IIIa-12)
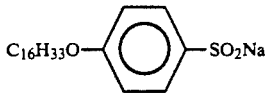
(IIIa-13)
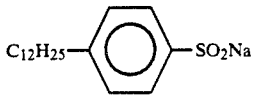

-continued
(IIIa-14)
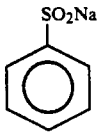
(IIIa-15)
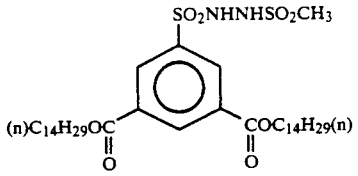
(IIIa-16)
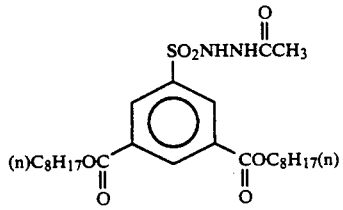
(IIIa-17)
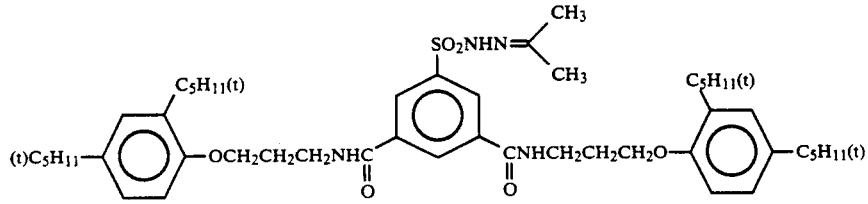
(IIIa-18)
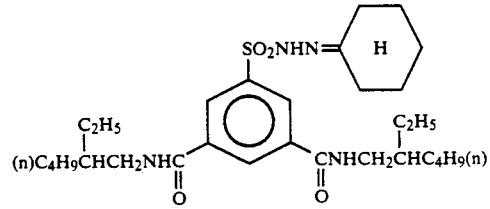
(IIIa-19)
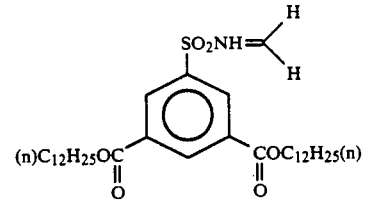
(IIIa-20)
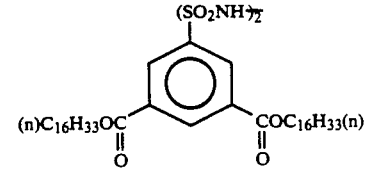
(IIIa-21)
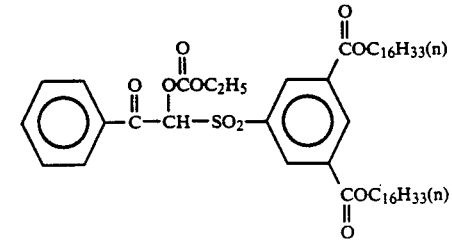

-continued
(IIIa-22)
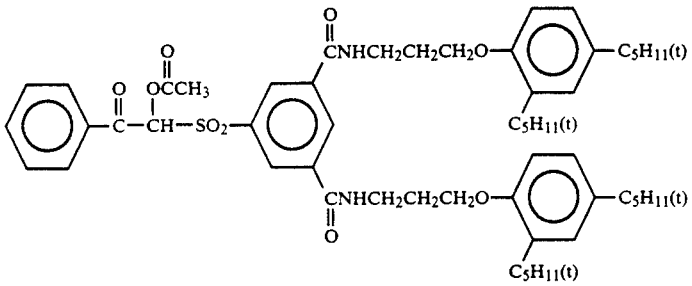
(IIIa-23)
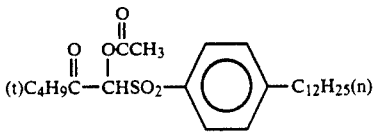
(IIIa-24)
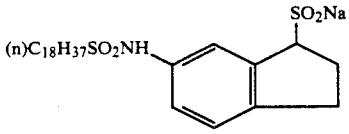
(IIIa-25)
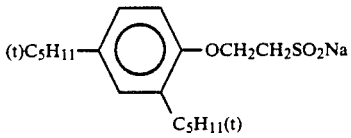
(IIIa-26)
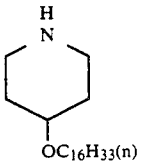
(IIIa-27)
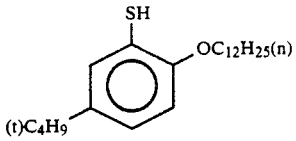
(IIIa-29)
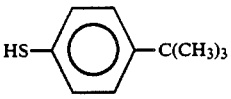
(IIIa-29)
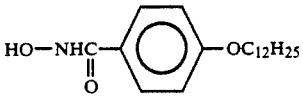
$NaN_3$ (IIIa-30)
(IIIa-31)
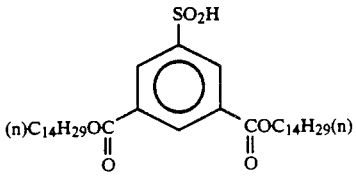

-continued
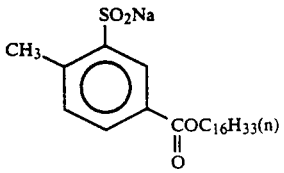
(IIIa-32)
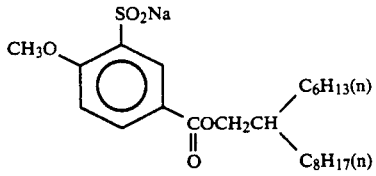
(IIIa-33)
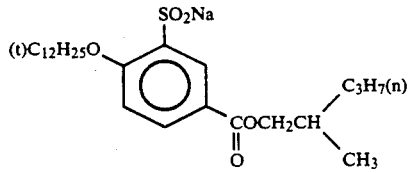
(IIIa-34)
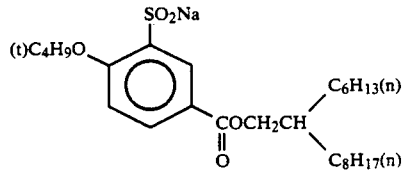
(IIIa-35)
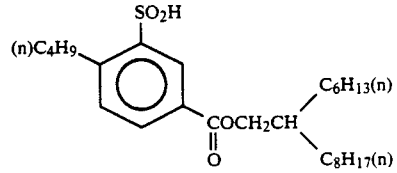
(IIIa-36)
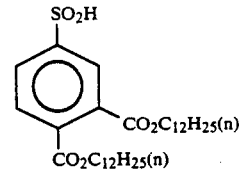
(IIIa-37)
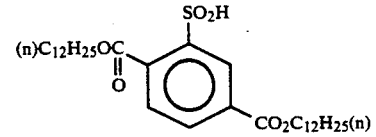
(IIIa-38)
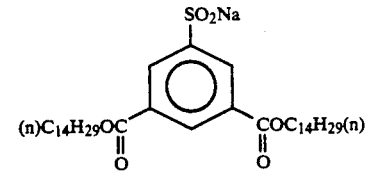
(IIIa-39)
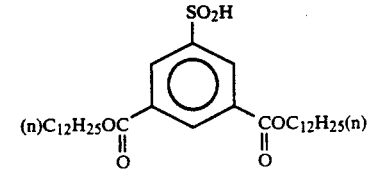
(IIIa-40)

-continued

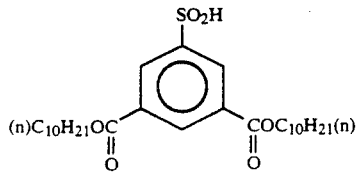

(IIIa-41)

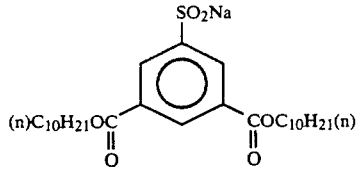

(IIIa-42)

These compounds can be prepared using the methods disclosed in JP-A0143048 (corresponding to U.S. Pat. No. 4,770,987), JP-A-63-115855, JP-A-63-115866, JP-A-63-158545 (corresponding to European Patent 0258662A) and European Patent (Laid Open) 255,722, and methods based upon these methods.

The preferred compounds of this present invention also include the compounds desclosed as examples in the above mentioned patents and in the specifications of JP-A-62-283338 and JP-A-62-229145 (corresponding to U.S. Pat. No. 4,704,350).

Of the compounds represented by formulae (IV), (V) and (VI), those of low molecular weight or which dissolve in water may be added to a processing bath for incorporation into the photosensitive material at the development processing stage. Methods in which they are added to the hydrophilic colloid layers of the photosensitive materials while the photosensitive material is being manufactured are preferred.

The coupler represented by formula (I) of the present invention can generally be used in an amount of from $1\times10^{-2}$ to 1 mol, and preferably in an amount of from $1\times10^{-1}$ to $5\times10^{-1}$ mol, per mol of silver halide. Furthermore, other types of magenta coupler can be used in combination with the couplers of the present invention, as required.

The compounds represented by formula (II) of this present invention are preferably added in an amount of from 0.5 to 150 mol %, and most preferably in an amount of from 1 to 100 mol %, with respect to the molar amount of the coupler of formula (I) of the present invention. The compounds represented by formula (III) are preferably added in an amount of from 10 to 500 mol %, and most preferably in an amount of from 10 to 200 mol %, with respect to the molar amount of the coupler of formula (I) of the present invention.

The compounds represented by formula (II) or (III) is incorporated into the silver halide emulsion layer containing the compound represented by formula (I).

The compounds represented by the general formulae (IV), (V) and (VI) of the present invention are preferably dissolved in a high boiling point organic solvent and they are preferably added in a total amount of from $1\times10^{-2}$ to 10 mol, and most desirably in an amount of from $3\times10^{-2}$ to 5 mol, per mol of the coupler of general formula (I) of the present invention. These compounds are preferably coemulsified with a magenta coupler using the high boiling point organic solvent.

When the compounds represented by formula (II) to (VI) are used exceeding the amounts described above dispersability thereof tends to be insufficient and it is not desired in photographic characteristics.

Although it is preferred that the compounds represented by formula (IV), (V) or (VI) is added to a silver halide emulsion layer containing the compound represented by formula (I), it may also be incorporated into at least one light-insensitive layer adjacent to the emulsion layer or into both of these layers. Examples of the light-insensitive layer includes a protective layer, an interlayer, antihalation layer and antiirradiation layer.

When at least one of compounds represented by formulae (IV), (V) and (VI) is incorporated into the photographic material during developing processes, it is preferred that the compound is incorporated into a processing solution for development or which is used after development. It is more preferred that the compound is incorporated into a stabilizing bath or a washing bath. The amount of the compound in the solution is preferably from 0.1 to 10 g/l, more preferably from 0.5 to 5 g/l.

The color couplers used in the present invention are preferably rendered fast to diffusion by having ballast groups or by polymerization. The coated weight of silver can be reduced by using two-equivalent color couplers which are substituted with a coupling-off group at the coupling active position rather than four-equivalent couplers which have a hydrogen atom at the active coupling position.

Yellow couplers, magenta couplers and cyan couplers which form yellow, magenta and cyan colors respectively on coupling with the oxidized product of an aromatic amine color developing agent are normally used in the color photographic materials of the present invention.

Of the yellow couplers which can be used in this present invention, the acylacetamide derivatives, such as benzoylacetanilide and pivaloylacetanilide, are preferred.

Yellow couplers which are presented by formulae (Y-I) and (Y-II) below are preferred:

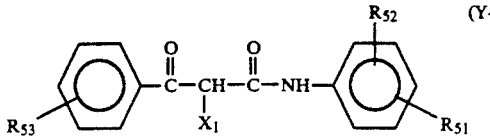

(Y-1)

-continued (Y-2)

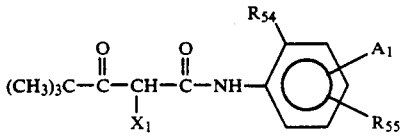

In these formulae, $X_1$ represents a hydrogen atom or a coupling-off group are defined above. $R_{51}$ represents a ballast group which has a total of from 8 to 32 carbon atoms, $R_{52}$ represents a hydrogen atom, or one or more halogen atoms, lower alkyl groups, lower alkoxy groups or ballast groups which have from 8 to 32 carbon atoms (total). $R_{53}$ represents a hydrogen atom or a substituent group. In those cases where there are two or more $R_{53}$ groups these may be the same or different groups.

$R_{54}$ represents a halogen atom, an alkoxy group, a trifluoromethyl group or an aryl group, and $R_{55}$ represents a hydrogen atom, a halogen atom or an alkoxy group. $A_1$ represents $-NHCOR_{56}$, $-NHSO_2-R_{56}$, $-SO_2NHR_{56}$, $-COOR_{56}$, or

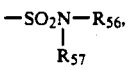

wherein $R_{56}$ and $R_{57}$, which may be the same or different, each represents an alkyl group, an aryl group or an acyl group. The coupling-off group $X_1$ is preferably of the type with which elimination occurs at either an oxygen atom or a nitrogen atom, and it is most desirably of the nitrogen atom elimination type.

Details of these pivaloylacetanilide yellow couplers are disclosed from column 3, line 15, to column 8, line 39, of U.S. Pat. No. 4,622,287 and from column 14, line 50, to column 19, line 41 of U.S. Pat. No. 4,623,616.

Details of such pivaloylacetanilide yellow couplers are also disclosed, for example, in U.S. Pat. Nos. 3,408,194, 3,933,501, 4,046,575, 4,133,958 and 4,401,752.

The illustrated compounds (Y-1) to (Y-39) disclosed in columns 37 to 54 of U.S. Pat. No. 4,622,287 are specific examples of pivaloylacetanilide yellow couplers and, of these, (Y-1), (Y-4), (Y-6), (Y-7), (Y-15), (Y-21), (Y-22), (Y-23), (Y-26), (Y-35), (Y-36), (Y-37), (Y-38) and (Y-39), for example, are preferred.

Furthermore, compounds (Y-1) to (Y-33) disclosed in columns 19 to 24 of U.S. Pat. No. 4,623,616, including (Y-2), (Y-7), (Y-8), (Y-12), (Y-20), (Y-21), (Y-23) and (Y-29), are preferred.

Example (34) disclosed in column 6 of U.S. Pat. No. 3,408,194, illustrative compounds (16) and (19) disclosed in column 8 of U.S. Pat. No. 3,933,501, illustrative compound (9) disclosed in columns 7 to 8 of U.S. Pat. No. 4,046,575, illustrative compound (1) disclosed in columns 5 to 6 of U.S. Pat. No. 4,133,958, illustrative compound 1 disclosed in column 5 of U.S. Pat. No. 4,401,752, and compounds represented by the formula indicated below with examples a) to h) are also preferred yellow couplers in the present invention, but the present invention is not to be construed as being limited thereto.

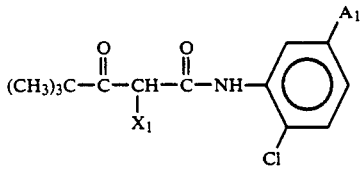

| Compound | $A_1$ | $X_1$ |
|---|---|---|
| a | $-COOCH(CH_3)COOC_{12}H_{25}$ | 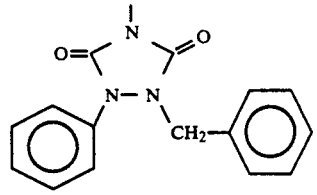 |
| b | $-COOCH(C_4H_9)COOC_{12}H_{25}$ | same as compound a |
| c | 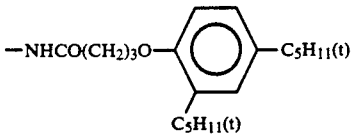 | 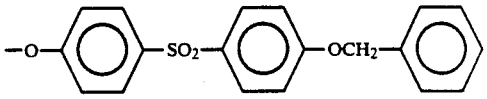 |
| d | 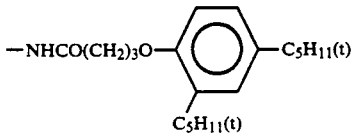 | 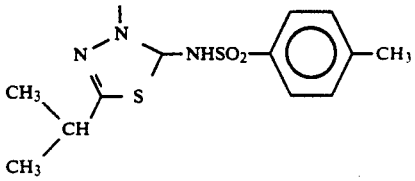 |

-continued

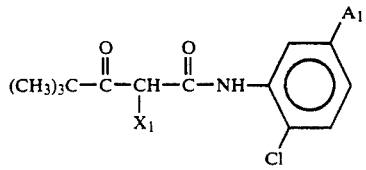

| Compound | $A_1$ | $X_1$ |
|---|---|---|
| e | same as compound d | 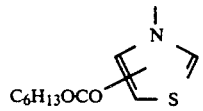 |
| f | $-NHSO_2C_{12}H_{25}$ | 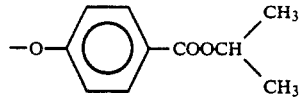 |
| g | $-NHSO_2C_{16}H_{33}$ | 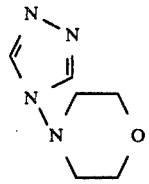 |
| h | $-NH\overset{O}{\overset{\|\|}{C}}\underset{CH_3}{\underset{\|}{C}}H-CH_2SO_2C_{12}H_{25}$ | 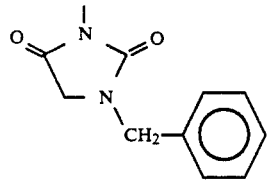 |

A nitrogen atom is especially desirable a the leaving atom in the above mentioned couplers.

Phenol cyan couplers and naphthol cyan couplers are the most typical cyan couplers.

The phenol couplers (including polymeric couplers) which have an acyl amino group in the 2-position of the phenol ring and an alkyl group in the 5-position disclosed, for example, in U.S. Pat. Nos. 2,369,929, 4,518,687, 4,511,647 and 3,772,002 can be used as phenol cyan couplers, and actual examples of such couplers include the coupler of Example 2 disclosed in Canadian Patent 625,822, compound (1) disclosed in U.S. Pat. No. 3,772,002, compounds (I-4) and (I-5) disclosed in U.S. Pat. No. 4,564,590, compounds (1), (2), (3) and (24) disclosed in JP-A-61-39045, and compound (C-2) disclosed in JP-A-62-70846.

The 2,5-diacylaminophenol couplers disclosed in U.S. Pat. Nos. 2,772,162, 2,895,826, 4,334,011 and 4,500,653, and JP-A-59-164555 can be used as phenol cyan couplers, and examples include compound (V) disclosed in U.S. Pat. No. 2,895,826, compound (17) disclosed in U.S. Pat. No. 4,557,999 compounds (2) and (12) disclosed in U.S. Pat. No. 4,565,777, compound (4) disclosed in U.S. Pat. No. 4,124,396, and compound (I-19) disclosed in U.S. Pat. No. 4,613,564.

The couplers which have a nitrogen containing heterocyclic ring condensed with the phenol ring disclosed in U.S. Pat. Nos. 4,372,173, 4,564,586, and 4,430,423, JP-A-61-390441 and JP-A-62-257158 can be used as phenol based cyan couplers, and examples include couplers (1) and (3) disclosed in U.S. Pat. No. 4,327,173, compounds (3) and (16) disclosed in U.S. Pat. No. 4,564,586, compounds (1) and (3) disclosed in U.S. Pat. No. 4,430,423, and the compounds indicated below but the present invention is not to be construed as being limited thereto.

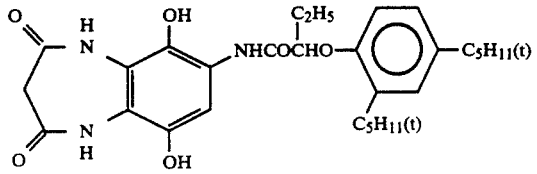

-continued
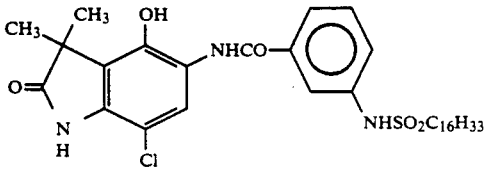
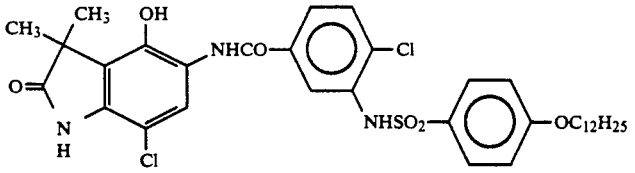
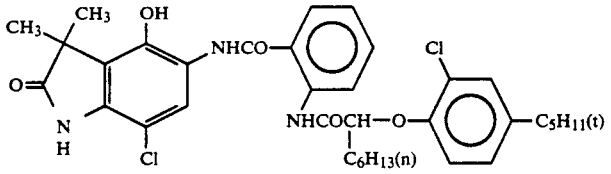
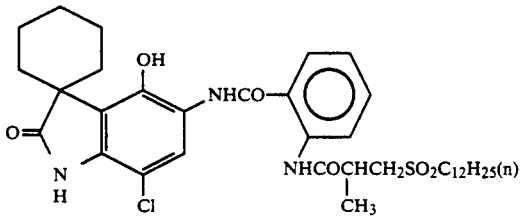
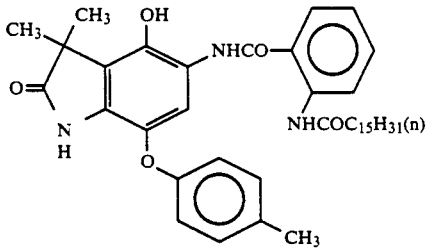
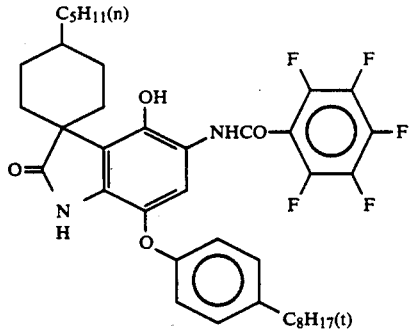
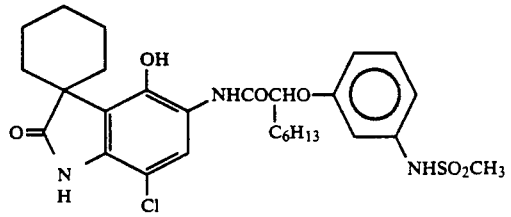

The following diphenylimidazole cyan couplers disclosed in European Patent (Laid Open) EP 0,249,453A2, for example, can also be used in addition to the above cyan couplers:

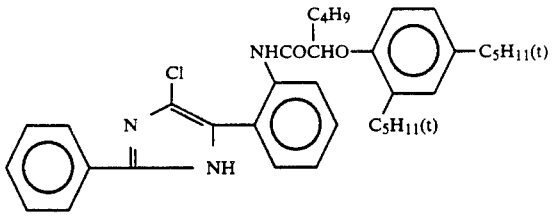

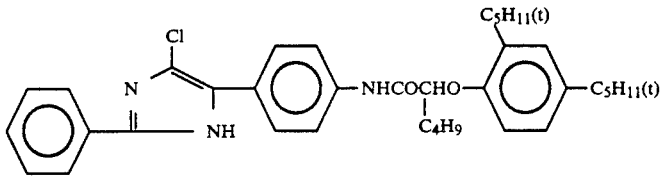

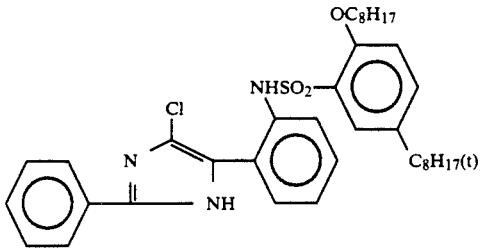

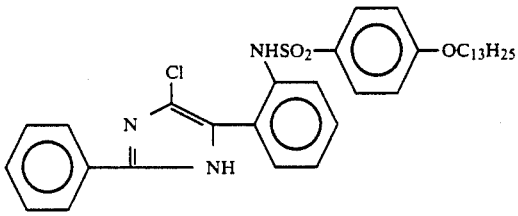

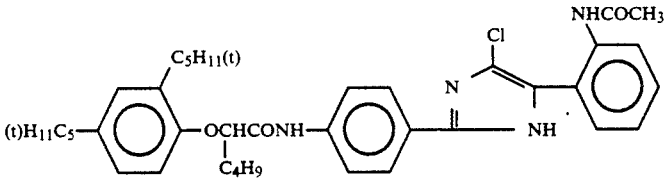

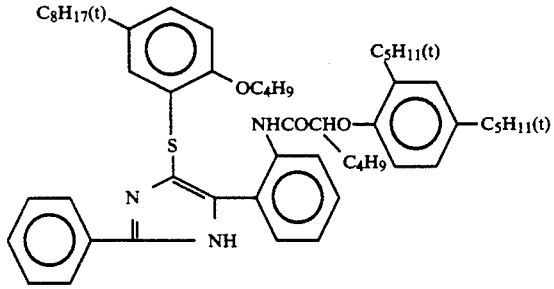

The ureido couplers disclosed, for example, in U.S. Pat. Nos. 4,333,999, 4,451,559, 4,444,872, 4,427,767 and 4,579,813, and European Patent 067,689B1 can also be used as phenol cyan couplers and examples include coupler (7) disclosed in U.S. Pat. No. 4,333,999, coupler (1) disclosed in U.S. Pat. No. 4,451,559, coupler (14) disclosed in U.S. Pat. No. 4,444,872, coupler (3) disclosed in U.S. Pat. No. 4,427,767, compounds (6) and (24) disclosed in U.S. Pat. No. 4,609,619, couplers (1) and (11) disclosed in U.S. Pat. No. 4,579,813, couplers (45) and (50) disclosed in European Patent (EP) 067,689B1, and coupler (3) disclosed in JP-A-61-42658.

The naphthol couplers which have a N-alkyl-N-arylcarbamoyl group in the 2-position of the naphthol nucleus (for example, U.S. Pat. No. 2,313,586), the naphthol couplers which have an alkylcarbamoyl group in the 2-position (for example, U.S. Pat. Nos. 2,474,293 and 4,282,312), the naphthol couplers which have an arylcarbamoyl group in the 2-position (for example, JP-B-50-14523), the naphthol couplers which have a carbonamido group or a sulfonamido group in the 5-position (for example, JP-A-60-237448, JP-A-61-145557 and JP-A-61-153640), the naphthol couplers which have an aryloxy coupling-off group (for example, U.S. Pat. No. 3,476,563), the naphthol couplers which have a substituted alkoxy coupling-off group (for example, U.S. Pat. No. 4,296,199) and the naphthol couplers which have a glycolic acid coupling-off group (for example, JP-B-60-39217) for example, can be used as naphthol cyan couplers.

The magenta couplers represented by formula (I) and anti-color fading agents (represented by formula (II) or (III)) and anti-color staining agents (represented by formula (V), (V) or (VI)) of the present invention can be introduced into the photographic material using various known methods of dispersion, and typical methods include, for example, the solid dispersion method, the alkali dispersion method and, preferably, the polymer dispersion method and the oil in water dispersion method. In the oil in water dispersion method they are dispersed in the presence of at least one type of high boiling point organic solvent. The use of high boiling point organic solvents represented by formulae (A) to (E) indicated below is preferred:

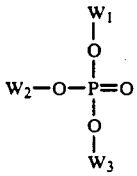
(A)

$W_1-COO-W_2$ (B)

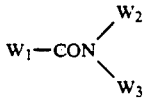
(C)

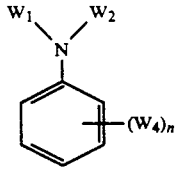
(D)

$W_1-O-W_2$ (E)

wherein $W_1$, $W_2$ and $W_3$ each represents a substituted or unsubstituted alkyl group, cycloalkyl group, alkenyl group, aryl group or heterocyclic group; $W_4$ represents $W_1$, $OW_1$ or $S-W_1$, and n is an integer of 1 to 5, and when n is 2 or more the $W_4$ groups may be the same or different. Moreover, $W_1$ and $W_2$ in general formula (E) may form a condensed ring.

Details of these high boiling point organic solvents are disclosed from the lower right hand column on page 137 to the upper right hand column on page 144 of JP-A-62-215272.

No particular limitation is imposed upon the particle size of the emulsified and dispersed particles obtained using a high boiling point organic solvent in this way, but it is preferably from 0.05 μm to 0.5 μm, and most desirably from 0.1 μm to 0.3 μm.

The inclusion of hydroquinones represented by formula (HQ) or non-color forming compounds represented by formula (RD) is preferred (in order to obtain the effects of the present invention) in silver halide emulsion layers which contain magenta couplers represented by formula (I) of the present invention.

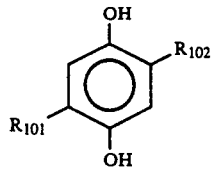
(HQ)

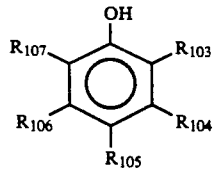
(RD)

In these formulae, $R_{101}$ to $R_{107}$, which may be the same or different, each represents a hydrogen atom, an alkyl group, an aryl group, a heterocyclic group, an alkoxy group, an aryloxy group, a heterocyclic oxy group, an alkylthio group, an arylthio group a heterocyclic thio group, a hydroxyl group, an amido group, a sulfo group, a sulfonyl group, a sulfinyl group, a carboxyl group, an acyl group, $R_{100}OCO-$, $R_{100}OSO_2-$, $R_{100}COO-$, $R_{100}SO_2O-$, $R_{100}OCONH-$ (wherein $R_{100}$ represents an alkyl group or an aryl group), a ureido group, a sulfamoyl group, a carbamoyl group, a cyano group, a nitro group or a halogen atom. However, in formulae (HQ) and (RD), both $R_{101}$ and R102, and the groups $R_{103}$ to $R_{107}$, cannot all be hydrogen atoms at the same time. In general formula (HQ), the total number of carbon atoms in $R_{101}$ and $R_{102}$ is at least 4, and in formula (RD) the total number of carbon atoms in $R_{103}$ to $R_{107}$ is at least 4.

Examples of compounds represented by formulae (HQ) and (RD) are indicated below, but the invention is not to be construed as being limited to these examples.

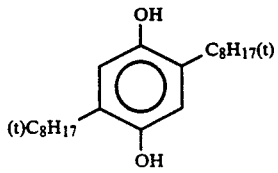
(HQ-1)

-continued
(HQ-2)
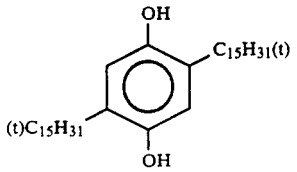
(HQ-3)
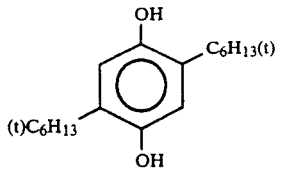
(HQ-4)
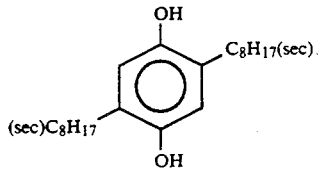
(HQ-5)
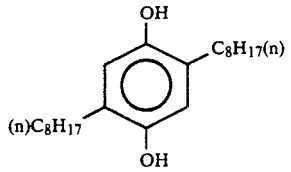
(HQ-6)
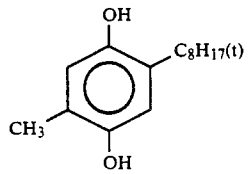
(HQ-7)
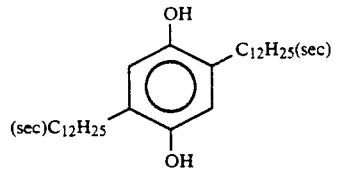
(HQ-8)
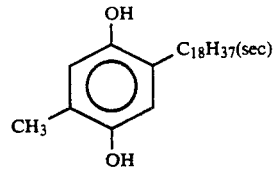
(HQ-9)
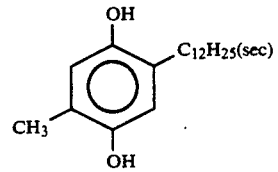
(HQ-10)
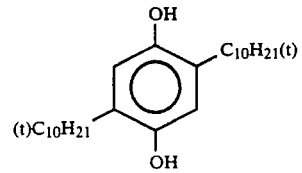

-continued
(HQ-11)
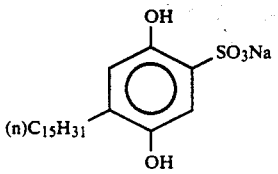
(HQ-12)
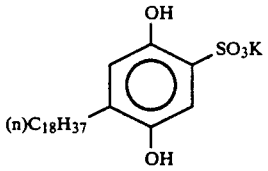
(HQ-13)
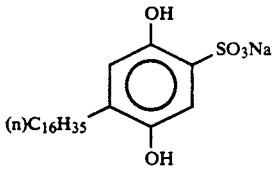
(HQ-14)
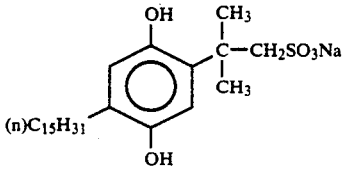
(HQ-15)
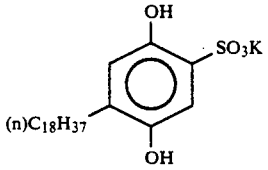
(HQ-16)
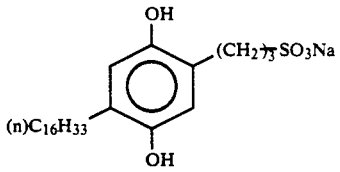
(HQ-17)
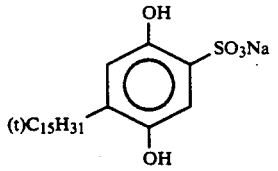
(HQ-18)
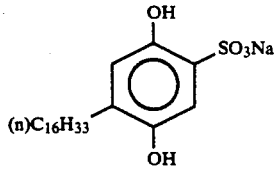
(HQ-19)
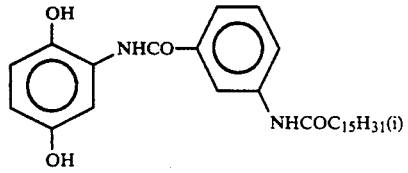

-continued
(HQ-20)
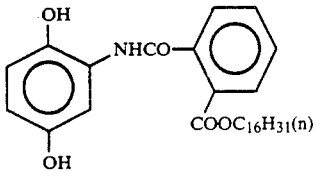
(HQ-21)
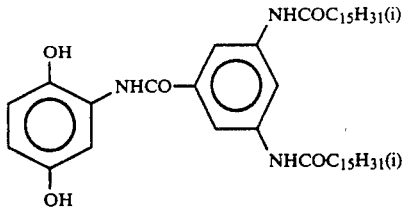
(HQ-22)
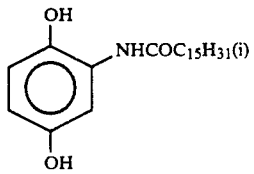
(HQ-23)
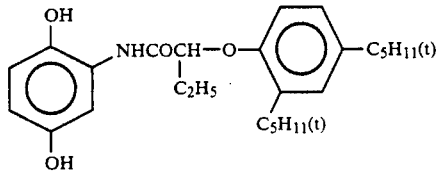
(HQ-24)
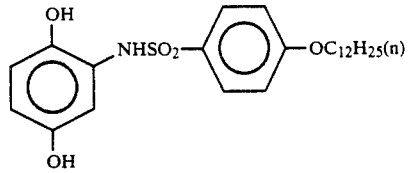
(HQ-25)
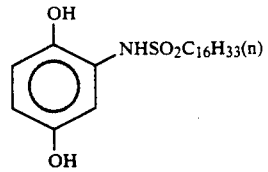
(HQ-26)
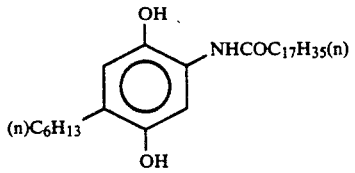
(HQ-27)
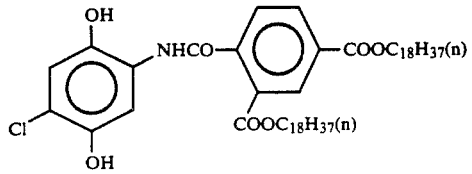

-continued
(HQ-28)
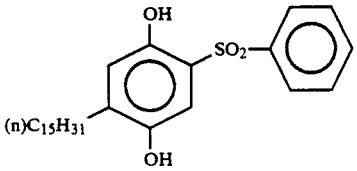
(HQ-29)
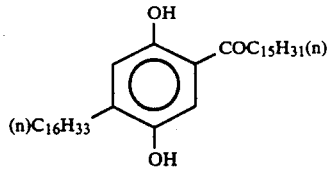
(HQ-30)
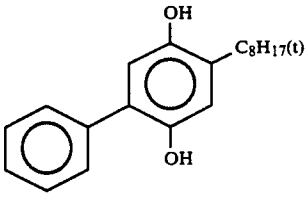
(HQ-31)
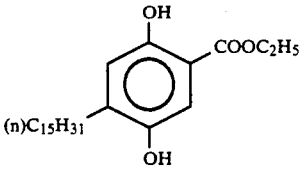
(HQ-32)
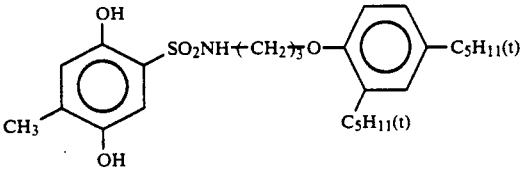
(HQ-33)
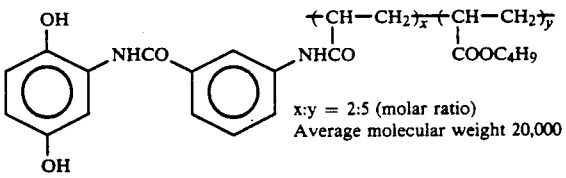
x:y = 2:5 (molar ratio)
Average molecular weight 20,000
(HQ-34)
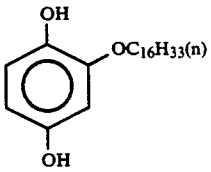
(HQ-35)
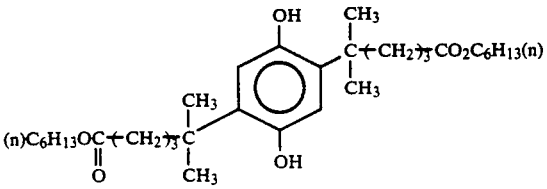

-continued
(RD-1)
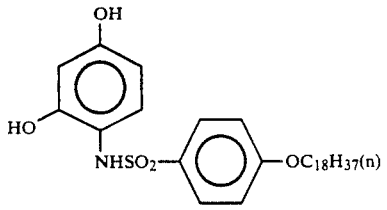
(RD-2)
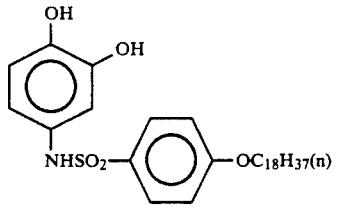
(RD-3)
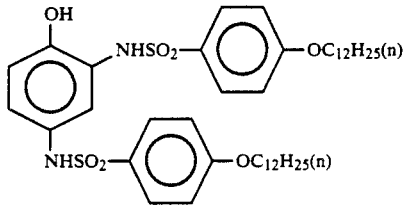
(RD-4)
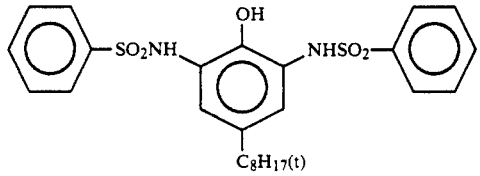
(RD-5)
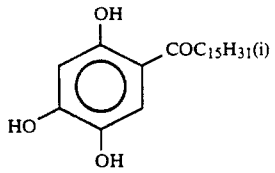
(RD-6)
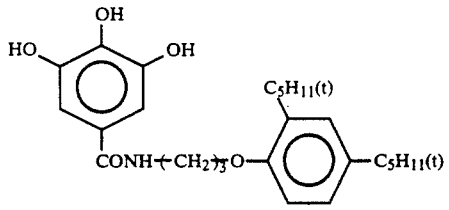
(RD-7)
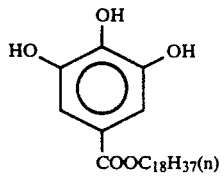
(RD-8)
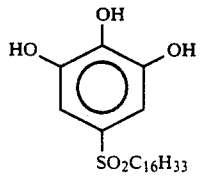

-continued (RD-9)

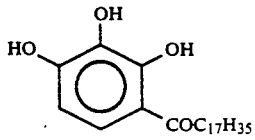

(RD-10)

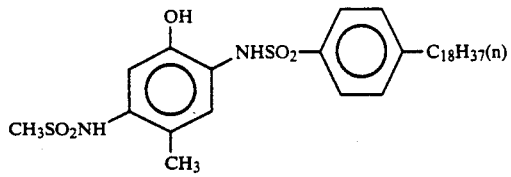

These compounds are preferably added in an amount of from $1\times10^{-4}$ to $1\times10^{-1}$ mol, and most preferably in an amount of from $1\times10^{-3}$ to $5\times10^{-2}$ mol, per mol of magenta coupler represented by formula (I) of the present invention.

The couplers used in the present invention can be loaded onto a loadable latex polymer with or without the aforementioned high boiling point solvents (as disclosed, for example, in U.S. Pat. No. 4,203,716), or they may be dissolved in a water insoluble but organic solvent soluble polymer and emulsified and dispersed in an aqueous hydrophilic colloid solution.

Use of the homopolymers and copolymers disclosed on pages 12 to 30 of the specification of International Patent (Laid Open) WO88/00723 is preferred, and the use of acrylamide polymers is especially desirable from the viewpoint of colored image stabilization for example.

Photographic materials of the present invention may contain hydroquinone derivatives, aminophenol derivatives, gallic acid derivatives and ascorbic acid derivatives, for example, as anti-color fogging agents.

Various anti-color fading agents can be used together with the compounds represented by formula (II) and formula (III) in a photosensitive material of the present invention. That is to say, hydroquinones, 6-hydroxychromans, 5-hydroxycoumarans, spirochromans, p-alkoxyphenols, hindered phenols such as bisphenols, gallic acid derivatives, methylenedioxybenzenes, aminophenols, hindered amines and ether and ester derivatives in which the phenolic hydroxyl groups of these compounds have been silylated or alkylated are typical organic anti-color fading agents which can be used for cyan, magenta and/or yellow images. Furthermore, metal complexes as typified by (bis-salicylaldoximato)-nickel and (bis-N,N-dialkyldithiocarbamato)nickel complexes, for example, can also be used for this purpose.

Examples of organic anti-color fading agents are disclosed in the patent indicated below.

Hydroquinones are disclosed, for example, in U.S. Pat. Nos. 2,360,290, 2,418,613, 2,700,453, 2,701,197, 2,728,659, 2,732,300, 2,735,765, 3,982,944 and 4,430,425, British Patent 1,363,921, and U.S. Pat. Nos. 2,710,810 and 2,816,028; 6-hydroxychromans, 5-hydroxy-coumarans and spirochromans are disclosed, for example, in U.S. Pat. Nos. 3,432,300, 3,573,050, 3,574,627, 3,698,909 and 3,764,337, and JP-A-52-152225; spiroindanes are disclosed in U.S. Pat. No. 4,360,589; p-alkoxyphenols are disclosed, for example, in U.S. Pat. No. 2,735,765, British Patent 2,066,975, JP-A-59-10539 and JP-B-57-19765; hindered phenols are disclosed, for example, in U.S. Pat. No. 3,700,455, JP-A-52-72224, U.S. Pat. No. 4,228,235, and JP-B-52-6623; gallic acid derivatives, methylenedioxybenzenes and aminophenols are disclosed, for example, in U.S. Pat. Nos. 3,457,079 and 4,332,886, and JP-B-56-21144, respectively; hindered amines are disclosed, for example, in U.S. Pat. Nos. 3,336,135 and 4,268,593, British Patents 1,326,889, 1,354,313 and 1,410,846, JP-B-51-1420, JP-A 58-114036, JP-A-59-53846 and JP-A-59-78344; and metal complexes are disclosed, for example, U.S. Pat. Nos. 4,245,018, 4,684,603, 4,050,938 and 4,241,155, and British Patent 2,027,731(A). These compounds can be used to achieve the intended purpose by addition to the photosensitive layer after co-emulsification with the corresponding color coupler, generally in an amount of from 5 to 100 wt % with respect to the coupler. The inclusion of ultraviolet absorbers in the layers on both sides adjacent to the cyan color forming layer is effective for preventing degradation of the cyan dye image by heat and, more especially, by light.

Ultraviolet absorbers can be included in the hydrophilic colloid layers of a photographic material prepared using the present invention. For example, benzotriazole compounds (for example, those disclosed in JP-B-62-13658 and JP-A-55-50245), 4-thiazolidone compounds (for example, those disclosed in U.S. Pat. Nos. 3,314,794 and 3,352,681), benzophenone compounds (for example, those disclosed in JP-A-46-2784), cinnamic acid ester compounds (for example, those disclosed in U.S. Pat. Nos. 3,705,805 and 3,707,375), butadiene compounds (for example, those disclosed in U.S. Pat. No. 4,045,229), or benzoxidol compounds (for example, those disclosed in U.S. Pat. No. 3,700,455) can be used for this purpose. Ultraviolet absorbing couplers (for example, α-naphthol cyan dye forming couplers) and ultraviolet absorbing polymers, for example, can also be used for this purpose. These ultraviolet absorbers can be mordanted in a specified layer. The use of ultraviolet absorbers represented by formula (UV) indicated below is preferred.

(UV)

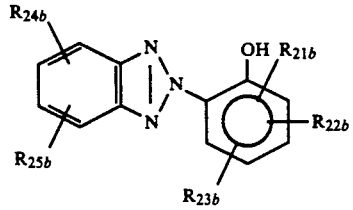

In this formula, $R_{21b}$, $R_{22b}$, $R_{23b}$, $R_{24b}$ and $R_{25b}$, which may be the same or different, each represents a hydrogen atom or a substituent group. The substituent groups defined for R, $R^{41}$ and $R^{42}$ in the description of general formulae (Ia to Ie) can be used for the substituent groups. $R_{24b}$ and $R_{25b}$ may undergo ring closure to form a five or six membered aromatic ring comprised of carbon atoms. These groups and aromatic rings may be further substituted with substituent groups.

Compounds represented by formula (UV) described above can be used independently or in the form of mixtures of two or more such compounds. Compounds which are typical of the ultraviolet absorbers which can be used in the present invention are described below. In these chemical structural formulae, the

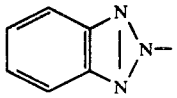

nucleus can become a

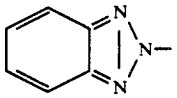

structure which is one of the resonance structures.

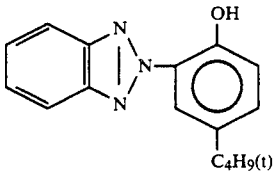

(UV-1)

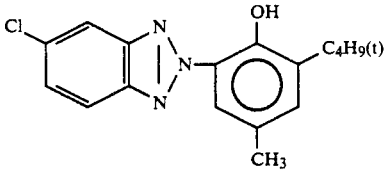

(UV-2)

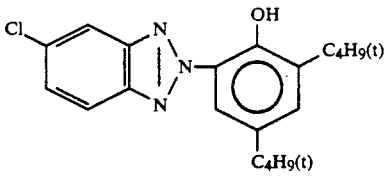

(UV-3)

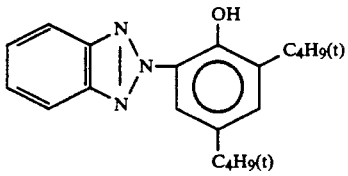

(UV-4)

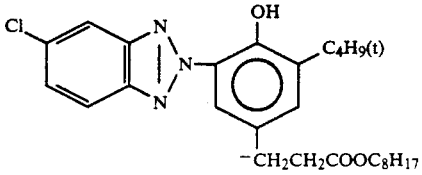

(UV-5)

-continued

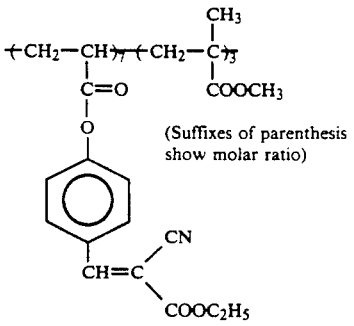

(UV-6)

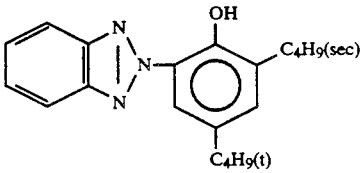

(UV-7)

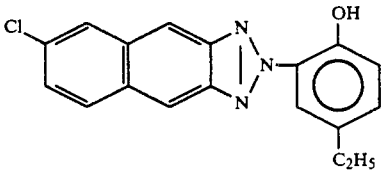

(UV-8)

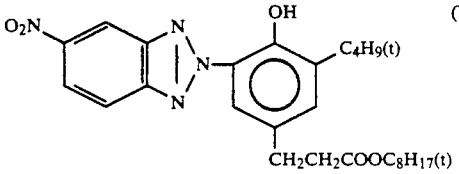

(UV-9)

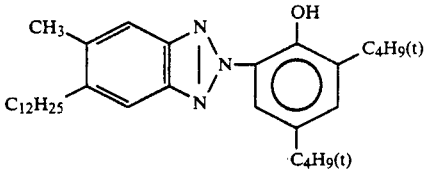

(UV-10)

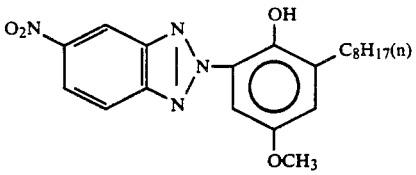

(UV-11)

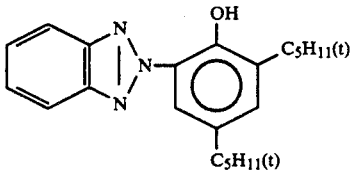

(UV-12)

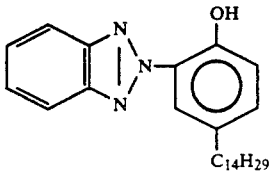

(UV-13)

-continued

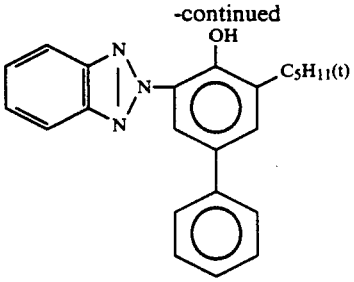

(UV-14)

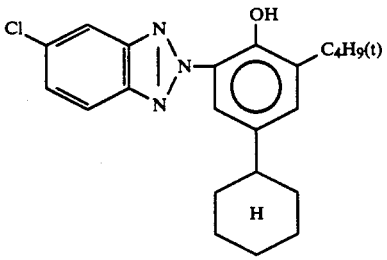

(UV-15)

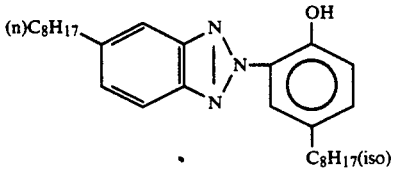

(UV-16)

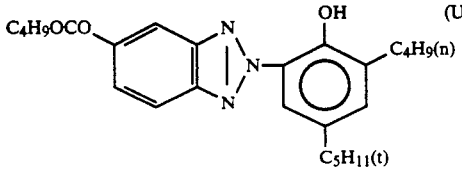

(UV-17)

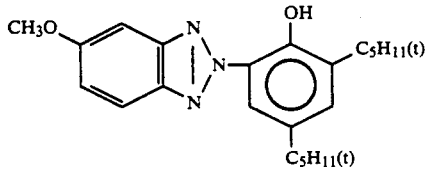

(UV-18)

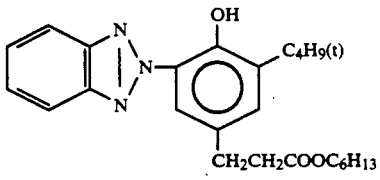

(UV-19)

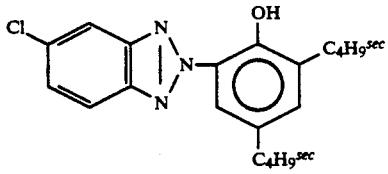

(UV-20)

Methods for the preparation of compounds represented by formula (UV) and other illustrative compounds are disclosed, for example, in JP-B-44-29620, JP-A-50-151149, JP-A-54-95233, U.S. Pat. No. 3,766,205, EP 0,057,160, and *Research Disclosure* No. 22519 (1983). Furthermore, the high molecular weight ultraviolet absorbers disclosed in JP-A-58-111942, JP-A-58-178351 (British Patent 2,118,315A), U.S. Pat. No. 4,455,368, JP-A-59-19945 and JP-A-59-23344 (British Patent 2,127,569A) can also be used, and an example is shown as UV-6. Low molecular weight and macromolecular ultraviolet absorbers can also be used together.

The amount of ultraviolet absorber coated should be sufficient to provide the dye image with light stability, but if too much is used it can result in a yellowing of the unexposed parts (white backgrounds) of the color photographic material and so it is preferably coated in an amount of from $1\times10^{-4}$ to $2\times10^{-3}$ mol/m$^2$, and most desirably in an amount of from $5\times10^{-4}$ to $1.5\times10^{-3}$ mol/m$^2$.

Water soluble dyes can be included in the hydrophilic colloid layers of photosensitive materials of the present invention as filter dyes or for anti-irradiation or a variety of other purposes. Dyes of this type include oxonol dyes, hemi-oxonol dyes, styryl dyes, merocyanine dyes, cyanine dyes and azo dyes. Oxonol dyes, hemi-oxonol dyes and merocyanine dyes are useful from among these dyes.

Gelatin is useful as a binder or protective colloid which can be used in the photosensitive layers of a photographic material of this present invention but other hydrophilic colloids, either alone or in combination with gelatin, can be used for this purpose.

The gelatin used in the invention may be a lime treated gelatin, or it may be a gelatin which is treated using acids. Details of the preparation of gelatins is disclosed by Arthur Weise in *The Macromolecular Chemistry of Gelatin* (Academic Press, 1964).

The transparent films, such as cellulose nitrate films and poly(ethylene terephthalate) films, and reflective supports generally used in photographic materials can be used as the supports used in the present invention. The use of reflective supports is preferred in view of the aims of the invention.

The "reflective supports" used in the present invention have a high reflectivity so that the dye image formed in the silver halide emulsion layer is sharp, and these include supports which have been covered with a hydrophobic resin which contains a dispersion of light reflecting materials such as titanium oxide, zinc oxide, calcium carbonate or calcium sulfate and supports comprising a hydrophobic resin which contains a dispersion of a light reflecting substance. Examples of such supports include baryta paper, polyethylene coated paper, polypropylene synthetic paper and transparent supports, such as glass plates, polyester films such as poly(ethylene terephthalate), cellulose triacetate or cellulose nitrate films, polyamide films, polycarbonate films, polystyrene films, and polyvinyl chloride resins, on which a reflective layer has been established or in which a reflective substance is combined, and these supports can be selected appropriately according to the intended application of the material.

The use of a white pigment which has been thoroughly milled in the presence of a surfactant or of which the surface of the pigment particles has been treated with a dihydric—tetrahydric alcohol is desirable for the light reflecting substance.

The occupied surface ratio (%) of fine white pigment particles per specified unit area can be determined by dividing the area under observation into adjoining $6\times6$ μm unit areas and measuring the occupied area ratio (%) ($R_i$) for the fine particles projected in each unit area. The variation coefficient of the occupied area ratio (%) can be obtained by means of the ratio ($s/\bar{R}$) of the standard deviation s of $R_i$ with respect to the average value ($\overline{R}$) of $R_i$. The number (n) of unit areas taken for observation is preferably at least six. Hence, the variation coefficient $s/\overline{R}$ can be obtained from the expression:

$$\sqrt{\frac{\sum_{i=1}^{n}(R_i-\overline{R})^2}{n-1}} \Big/ \frac{\sum_{i=1}^{n} R_i}{n}$$

In the present invention, the variation coefficient of the occupied area ratio (%) of the fine pigment particles is preferably not more than 0.15, and more preferably not more than 0.12. The dispersion of the particles can be said to be uniform in practice when the value is 0.08 or less.

The color photographic photosensitive materials of this present invention can be made by coating layer by layer on a support at least one blue sensitive silver halide emulsion layer, at least one green sensitive silver halide emulsion layer and at least one red sensitive silver halide emulsion layer. In a general color printing paper, the layers are usually established by coating on the support in the order indicated above, but they may be coated in a different order. Furthermore, some or all of these emulsion layes can be replaced by infrared sensitive silver halide emulsion layers. Color reproduction by the subtractive method can be achieved by including silver halide emulsions which are sensitive to the respective wavelength regions and color couplers which form dyes which are complementary to the color of the actinic light, which is to say yellow dyes for the blue, magenta dyes for the green and cyan dyes for the red sensitive layers, in the photosensitive emulsion layers. However the structure of the material may be such that the colors developed of the photosensitive layer and the coupler do not have the relationship indicated above.

The user of essentially silver iodide free silver chlorobromide or silver chloride for the silver halide emulsions which are used in the present invention is preferred. Here, the term "essentially silver iodide free" signifies that the silver iodide content is not more than 1 mol %, and preferably not more than 0.2 mol %. The halogen composition of the emulsion may differ from grain to grain, or it may be uniform, but it is easier to make the nature of the grains uniform when emulsions in which the halogen composition is the same from grain to grain are used. Furthermore, the silver halide composition distribution within the silver halide emulsion grains may be such that grains have a uniform structure in which the composition is uniform throughout the grains, grains which have a layer type structure in which the halogen composition in the core which forms the interior of the silver halide grains and in the surrounding shell part of the grains (the shell may be a single layer or a plurality of layers) is different, or grains which have a structure in which there are parts which have a different halogen composition in a non-layer like form within the grains or on the surfaces of the grains (structures such that parts which have a different halogen composition are joined onto the edges, corners or planes of the grains where the parts which have a different composition are at the surface of the grains), can be selected appropriately for use. The use of grains of either of the latter two types is preferred to the use of grains which have a uniform structure for obtaining a high photographic speed, and it is also preferred from the point of view of pressure resisting properties. In those cases where the silver halide grains have a structure such as those indicated above, the boundary region between the parts which have different halogen compositions may be a distinct boundary, or it may be an indistinct boundary where a mixed crystal is formed due to the difference in composition, or it may be such that there is a positive and continuous change in the structure.

Silver chlorobromides which have any silver bromide/silver chloride ratio can be used. A wide range of composition ratios can be accommodated, depending on the intended purpose of the material, but the use of emulsions which have a silver chloride content of at least 2 mol % is preferred.

Furthermore, the use of so-called high silver chloride emulsions which have a high silver chloride content is preferred in photographic materials which are suited to rapid processing. The silver chloride content of these high silver chloride emulsions is preferably at least 90 mol %, and most desirably at least 95 mol %.

Structures in which the grains in these high silver chloride emulsions have a silver bromide local phase in the form of a layer or in a form other than a layer as described earlier within the silver halide grains and/or at the grain surface are preferred. The halogen composition of the local phase preferably has a silver bromide content of at least 10 mol %, and most desirably it has a silver bromide content in excess of 20 mol %. These local phases can be within the grains or at the edges or corners of the grain surface or on the planes of the grains, and most desirably the phase is grown epitaxially in the corners of the grains.

On the other hand, the use of grains which have a uniform structure with a small halogen composition distribution within the grains is preferred even with high silver chloride emulsions which have a silver chloride content of at least 90 mol % to suppress the loss of photographic speed which arises when pressure is applied to a photographic material.

Furthermore, a higher silver chloride content in the silver halide emulsion is also effective for reducing the replenishment rate of the development processing bath. In such a case the use of virtually pure silver chloride emulsions which have a silver chloride content of from 98 to 100 mol % is preferred. Silver chlorobromide emulsions of which the silver chloride content is from 98 to 99.9 mol % is also desirable in consideration of photographic speed and fogging.

The average grain size of the silver halide grains which are included in the silver halide emulsions used in the present invention is preferably from 0.1 to 2 μm (the average grain size is the numerical average of the grain size which is taken to be the diameter of the circle of area equal to the projected area of the grain).

Furthermore, the grain size distribution is preferably a mono-dispersion in which the variation coefficient (the value obtained by dividing the standard deviation of the grain size by the average grain size) is not more than 20%, and most desirably not more than 15%. The use of blends of the above mentioned mono-dispersions in the same layer, or the lamination coating of mono-dispersions, is desirable for obtaining a wide latitude.

The silver halide grains which are included in the photographic emulsion may have a regular crystalline form, such as a cubic, tetradecahedral or octahedral form, an irregular crystalline form such as a spherical or tabular form, or a form which is a composite of such crystalline forms. Furthermore, mixtures of grains which have different crystalline forms can be used. Emulsions in which at least 50%, preferably at least 70%, and most desirably at least 90%, of the grains have a regular crystalline form are preferred in the present invention.

Furthermore, the use of emulsions in which tabular grains which have an average aspect ratio (diameter of the calculated circle/thickness) of at least 5, and preferably of at least 8, account for more than 50% of all the grains in terms of projected area is also desirable.

The silver chlorobromide emulsions used in this present invention can be prepared using the methods disclosed, for example, by P. Glafkides in *Chimie et Physique Photographique,* (Paul Montel, 1967), by G. F. Duffin in *Photographic Emulsion Chemistry,* (Focal Press), 1966, and by V. L. Zelikmann et al. in *Making and Coating Photographic Emulsions,* (Focal Press), 1964. That is to say, they can be prepared using acidic methods, neutral methods and ammonia methods for example, and a single jet mixing procedure, a double jet mixing procedure, or a combination of such procedures, can be used for reacting the soluble silver salt with the soluble halide. Methods in which the grains are formed in the presence of an excess of silver ions ("reverse mixing" methods) can also be used. The method in which the pAg value in the liquid phase in which the silver halide is being formed is held constant, ("controlled double jet" method), can be also used as one type of double jet mixing procedure. It is possible to obtain regular silver halide emulsions with an almost uniform grain size when this method is used.

Various multi-valent metal ion impurities can be introduced into the silver halide emulsions which are used in the present invention during the formation or physical ripening of the emulsion grains. For example, salts of cadmium, zinc, lead, copper or thallium, or salts or complex salts of metals of group VIII of the periodic table, such as iron, ruthenium, rhodium, palladium, osmium, iridium and platinum, for example, can be used as compounds of this type. The use of the above mentioned group VIII elements is especially desirable. The amount of these compounds added varies over a wide range, depending on the intended purpose, but an amount of from $10^{-9}$ to $10^{-2}$ mol per mol of silver halide is preferred.

The silver halide emulsions used in the present invention are generally subjected to chemical sensitization and spectral sensitization.

Sulfur sensitization typified by the addition of unstable sulfur compounds, precious metal sensitization typified by gold sensitization, and reduction sensitization, for example, can be used individually or cojointly for the purpose of chemical sensitization. Use of the compounds disclosed from the lower right hand column on page 18 to the upper right hand column on page 22 of the specification of JP-A-62-215272 for chemical sensitization purposes is preferred.

Spectral sensitization is carried out with a view to rendering each emulsion layer in a photographic material of the present invention sensitive to light of a prescribed wavelength region. In the present invention, this is preferably achieved by adding dyes, spectrally sensitizing dyes, which absorb light in the wavelength regions corresponding to the target spectral sensitivity. Examples of spectrally sensitizing dyes which can be used are disclosed, for example, by F. M. Harmer in *Heterocyclic Compounds, Cyanine Dyes and Related Compounds,* (John Wiley & Sons [New York, London], 1964). Examples of preferred compounds which can be used are disclosed from the upper right hand column on page 22 to page 38 of JP-A-62-215272.

Various compounds or precursors thereof can be added to the silver halide emulsions which are used in the present invention with a view to preventing the occurrence of fogging during the manufacture, storage or photographic processing of the photographic material or with a view to stabilizing photographic performance. These are generally called photographic stabilizers. Examples of such compounds are disclosed on pages 39 to 72 of JP-A-62-215272, and the use of these compounds is preferred.

The emulsions used in the present invention may be of the surface latent image type in which the latent image is formed principally on the grain surfaces, or of the internal latent image type in which the latent image is formed principally within the grains.

A color photographic material of the present invention is preferably subjected to color development, bleach-fixing and water washing (or stabilization) processes. Bleaching and fixing may also be carried out separately rather than in one bath as indicated above.

In the case of continuous processing, the rate of replenishment of the development bath is preferably as low as possible from the viewpoints of resource conservation and reduced levels of pollution.

The preferred rate of replenishment for a color developer is not more than 200 ml per square meter of photographic material. Moreover, a replenishment rate of not more than 120 ml per square meter is more desirable, and a replenishment rate of not more than 100 ml per square meter is most desirable. Here the replenishment rate signifies the amount of color development replenisher which is used for replenishment, and the amount of additive added for compensating for deterioration due to ageing and concentration is outside the scope of this replenishment rate. Moreover, here an additive signifies, for example, water for dilution of solutions condensed, preservatives which are liable to deteriorate with the passage of time or alkalis for increasing pH.

The color development baths used in the present invention are preferably aqueous alkaline solutions which contain a primary aromatic amine based color developing agent as the principal component. Aminophenol compounds can also be used as color developing agents, but the use of p-phenylenediamine compounds is preferred. Typical examples of these compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfate, hydrochloride and p-toluenesulfonate salts of these compounds. Two or more of these compounds can be used together, according to the intended purpose.

Moreover, pH buffers such as alkali metal carbonates, borates or phosphates, and development inhibitors or anti-foggants, such as bromide, iodide, benzimidazoles, benzothiazoles or mercapto compounds are generally included in the color development bath. Various preservatives such as hydroxylamine, diethylhydroxylamine, sulfites, hydrazine salts such as N,N-biscarboxymethyl hydrazine, phenylsemicarbazides, triethanolamine, catecholsulfonic acids and triethylenediamine(1,4-diazabicyclo[2,2,2]octane), organic solvents such as ethylene glycol and diethylene glycol, development accelerators such as benzyl alcohol, polyethylene glycol, quaternary ammonium salts and amines, dye forming couplers, competitive couplers, fogging agents such as sodium borohydride, auxiliary developing agents such as 1-phenyl-3-pyrazolidone, thickeners, various chelating agents as typified by the aminopolycarboxylic acids, aminopolyphosphonic acids, alkylphosphonic acids and phosphonocarboxylic acids, for example ethylenediamine tetra-acetic acid, nitrilotriacetic acid, diethylenetriamine penta-acetic acid, cyclohexanediamine tetra-acetic acid, hydroxyethylimino diacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid) and salts thereof, can be used, as required.

Color development is carried out after normal black and white development in the case of reversal processing. Known black and white developing agents such as dihydroxybenzenes, for example hydroquinone, 3-pyrazolidones, for example 1-phenyl-3-pyrazolidone, or aminophenols, for example N-methyl-p-aminophenol, can be used either individually or in combinations in such black and white development baths.

The pH value of these color development baths and black and white development baths is generally from 9 to 12. Furthermore, the replenishment rate of these development baths depends of the color photographic material which is being processed but, in general, it is not more than 3 liters per square meter of photographic material, and it can be set to less than 500 ml per square meter of photographic material by reducing the bromide ion concentration of the replenisher. It is desirable that evaporation and aerial oxidation of the bath should be prevented by minimizing the contact area with the air of the processing layer when the rate of replenishment is low. The replenishment rate can be further reduced by preventing the accumulation of bromide ion in the development bath.

The photographic emulsion layer is generally subjected to a bleaching process after color development. The bleaching process may be carried out at the same time as a fixing process (bleach-fix process) or it may be carried out separately. Moreover, a method of processing in which bleach-fixing is carried out after a bleaching process may be used in order to speed up processing. Furthermore, processing can be carried out with two connected bleach-fix baths, a fixing process can be carried out prior to a bleach-fix process, or a bleaching process may be carried out after a bleach-fix process, in accordance with the intended purpose of the processing. Compounds of poly valent metals, such as iron(III), cobalt(III), chromium(VI) and copper(II) for example, peracids, quinones and nitro compounds, for example, can be used as bleaching agents. For example, ferricyanides; dichromates; organic complex salts of iron(III) or cobalt(III), for example complex salts with aminopolycarboxylic acids such as ethylenediamine tetra acetic acid, diethylenetriamine penta-acetic acid, cyclohexanediamine tetra-acetic acid, methylimino diacetic acid, 1,3-diaminopropane tetra-acetic acid and glycol ether diamine tetra-acetic acid, or citric acid, tartaric acid or malic acid for example; persulfates; bromates; permanganates; and nitrobenzenes can be used as bleaching agents. Of these, the aminopolycarboxylic acid iron(III) complex salts, including ethylenediamine tetra-acetic acid, and persulfate are preferred from the viewpoints of rapid processing and the prevention of environmental pollution. Moreover, the aminopolycarboxylic acid iron(III) complex salts are effective in both bleach baths and bleach-fix baths. The pH of bleach baths and bleach-fix baths in which these aminopolycarboxylic acid iron(III) complex salts are used is generally from 5.5 to 8, but processing can be carried out at lower pH values in order to speed up processing.

Bleaching accelerators can be used, as required, in bleach baths, bleach-fix baths or bleach or bleach-fix prebaths. Actual examples of useful bleach accelerators are disclosed in the following specifications: The compounds which have a mercapto group or a disulfide group disclosed, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *Research Disclosure* No. 17129 (July 1978); the thiazolidine derivatives disclosed in JP-A-50-140129; the thiourea derivatives disclosed in JP-B-45-8506, JP-A-52-20832, JP-A-53-32735, and U.S. Pat. No. 3,706,561; the iodides disclosed in West German Patent 1,127,715 and JP-A-58-16235; the polyoxyethylene compounds disclosed in West German Patents 966,410 and 2,748,430; the polyamine compounds disclosed in JP-B-45-8836; the other compounds disclosed in JP-A-49-42434, JP A-49-59644, JP-A-53-94927, JP-A-54-35727, JP-A-55-26560 and JP-A-58-163940; and bromide ion. Among these compounds, those which have a mercapto group or a disulfide group are preferred from the viewpoint of their large accelerating effect, and the compounds disclosed in U.S. Pat. No. 3,893,858, West German Patent 1,290,812 and JP-A-53-95630 are especially preferred. Moreover, the compounds disclosed in U.S. Pat. No. 4,552,834 are also preferred. These bleaching agents may be added to the photographic material. These bleaching agents are especially effective when bleach-fixing color photographic materials for photographing.

Thiosulfate, thiocyanate, thioether compounds, thioureas and large amounts of iodide can be used, for example, as fixing agents, but thiosulfate is generally used, and ammonium thiosulfate in particular can be used in the widest range of applications. Sulfite, bisulfite, or carbonyl/bisulfite addition compounds are preferred as preservatives for bleach-fix baths.

The silver halide color photographic materials of the present invention are generally subjected to a water washing process and/or stabilization process after the desilvering process. The amount of wash water used in a washing process can be fixed within a wide range, depending on the characteristics (for example, the materials such a couplers used therein) and application of the photographic material, the wash water temperature, the number of water washing tanks (the number of water washing stages), the replenishment system, i.e. whether a counter-flow or sequential flow system is used, and various other factors. The relationship between the amount of water used and the number of washing tanks in a multi-stage counter-flow system can be obtained using the method outlined on pages 248 to 253 of the *Journal of the Society of Motion Picture and Television Engineers*, Vol. 64 (May 1955).

The amount of wash water can be greatly reduced by using the multi-stage counter-flow system noted in this article, but bacteria proliferate due to the increased residence time of the water in the tanks and problems arise with attachment of the suspended matter which is produced to the photographic material. The method in which the calcium ion and magnesium ion concentrations are reduced, as disclosed in JP-A-62-28838, can be used very effectively as a means of overcoming this problem when processing color photographic materials of this present invention. Furthermore, the isothiazolone compounds disclosed in JP-A-57-8542, thiabendazoles, chlorine based disinfectants such as chlorinated sodium isocyanurate, and benzotriazole, for example, and the disinfectants disclosed in "Bokin Bobai no Kaqaku" (Antibacterial and Antifungal Chemistry) by Hiroshi Horiguchi, in "Biseibutsu no Genkin, Sakkin Bobai Gijutsu" (Sterilization, Bactericidal and Antifungal Techniques for Microorganisms) published by the Health and Hygiene Technical Society, and in "Bokin Bobaizai Jiten" (Dictionary of Antibacterial and Antifungal Agents) published by th Antibacterial and Antifungal Research Association of Japan, can also be used in this connection.

The pH value of the wash water when processing photographic materials of the present invention is from 4 to 9, and preferably from 5 to 8. The washing water temperature and the washing time can be set variously in accordance with the characteristics and application of the photographic material but, in general, washing conditions of from 20 seconds to 10 minutes at a temperature of from 15° C. to 45° C., and preferably of from 30 seconds to 5 minutes at a temperature of from 25° C. to 40° C., are selected. Moreover, the photographic materials of the invention can be processed directly in a stabilizing bath instead of being subjected to a water wash as described above. The known methods disclosed in JP-A-57-8543, JP-A-58-14834 and JP-A-60-220345 can all be used for such stabilization processes.

Furthermore, in some cases a stabilization process is carried out following the water washing process, and the use of a stabilizing bath which contains formalin and a surfactant as used as a final bath for camera color photographic materials can be cited as an example of this type of process. Various chelating agents and fungicides can be added to these stabilizing baths.

The overflow which accompanies replenishment of the above mentioned water washing and/or stabilizing baths can be reused in other processes, such as the desilvering process.

Color developing agents can be incorporated into a silver halide color photographic material of the present invention with a view to simplifying and speeding up processing. The use of various color developing agent precursors is preferred for incorporation. For example, the indoaniline compounds disclosed in U.S. Pat. No. 3,342,597, the Schiff's base type compounds disclosed in U.S. Pat. No. 3,342,599 and *Research Disclosure,* No. 14850, and ibid, No. 15159, the aldol compounds disclosed in *Research Disclosure,* No. 13924, the metal complex salts disclosed in U.S. Pat. No. 3,719,492, and the urethane based compounds disclosed in JP-A-53-135628, can be used for this purpose.

Various 1-phenyl-3-pyrazolidones can be incorporated, as required, into the silver halide color photosensitive materials of the present invention with a view to accelerating color development. Typical compounds have been disclosed, for example, in JP-A-56-64339, JP-A-57-144547 and JP-A-58-115438.

The various processing baths in the invention are used at a temperature of from 10° C. to 50° C. The standard temperature is generally from 33° C. to 38° C., but accelerated processing and shorter processing times can be realized at higher temperatures while increased picture quality and improved processing bath stability can be achieved at lower temperatures. Furthermore, processes using cobalt intensification or hydrogen peroxide intensification, as disclosed in West German Patent 2,226,770 or U.S. Pat. No. 3,674,499, can be used in order to economize on silver in the photographic material.

Processing with a development time of not more than 2 minutes 30 seconds in a color development bath which is essentially benzyl alcohol free and which contains not more than 0.002 mol/liter of bromide ion is preferred for a silver halide photographic material of the present invention.

The term "essentially benzyl alcohol free" as used above signifies that the benzyl alcohol content is not more than 2 ml, and preferably not more than 0.5 ml per liter of color development bath, and most desirably that the color development bath contains no benzyl alcohol at al.

EXAMPLES

The invention is now described in greater detail with reference to specific examples, but the invention is not to be construed as being limited to these examples.

EXAMPLE 1

A multi-layer color printing paper having the layer structure described below was prepared on a paper support which had been laminated on both sides with polyethylene. The coating liquids were prepared in the way described below.

Preparation of the First Layer Coating Liquid

Ethyl acetate (27.2 ml) and 4.1 grams of each of the solvents (Solv-3) and (Solv-6) were added to 19.1 gram of yellow coupler (ExY) and 4.4 grams of colored image stabilizer (Cpd-1) to form a solution which was then emulsified and dispersed in 185 ml of a 10% aqueous gelatin solution which contained 8 ml of 10% sodium dodecylbenzenesulfonate. Separately, a silver chlorobromide emulsion (a 1:3 (Ag mol ratio) mixture of a cubic emulsion of silver chlorobromide having silver bromide content 80.0 mol %, average grain size 0.85 μm and variation coefficient 0.08, and a cubic emulsion of silver chlorobromide having silver bromide content 80.0 mol %, average grain size 0.62 μm, variation coefficient 0.07) was sulfur sensitized and the blue sensitive sensitizing dye indicated hereinafter was added in an amount of $5.0\times10^{-4}$ mol per mol of silver to prepare an emulsion. This emulsion was mixed with the aforementioned emulsified dispersion to prepare the first layer coating liquid having the composition indicated below.

The coating liquids for the second to the seventh layers were prepared using the same procedure as for the first layer coating liquid. 1-Oxy-3,5-dichloro-s-triazine sodium salt was used as a gelatin hardening agents for each layer.

The spectrally sensitizing dyes indicated below were used for each layer.

Blue Sensitive Emulsion Layer

-continued

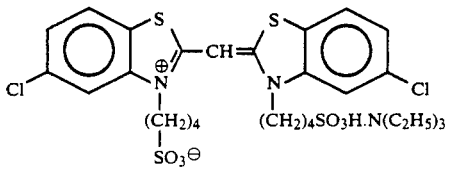

(5.0 × $10^{-4}$ mol per mol of silver halide)

Green Sensitive Emulsion Layer

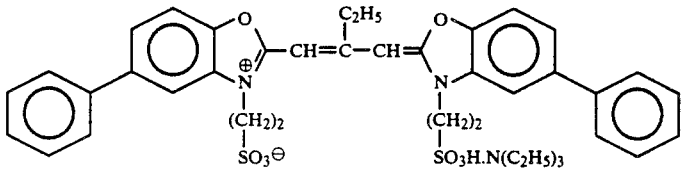

(4.0 × $10^{-4}$ mol per mol of silver halide)

and

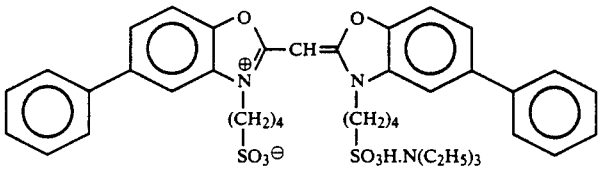

(7.0 × $10^{-5}$ mol per mol of silver halide)

Red Sensitive Emulsion Layer

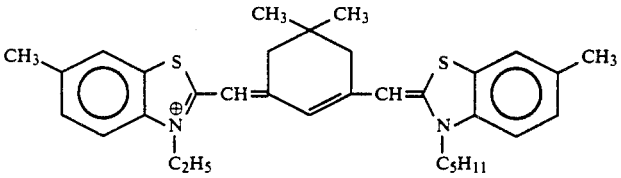

(0.9 × $10^{-4}$ mol per mol of silver halide)

The compound indicated below was added in an amount of $2.6\times10^{-3}$ mol per mol of silver halide to the red sensitive emulsion layer

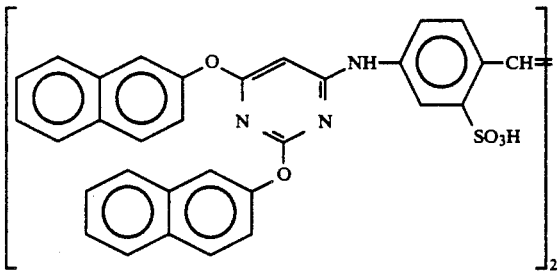

Furthermore, 1-(5-Methylureidophenyl)-5-mercaptotetrazole was added to the blue, green and red sensitive emulsion layers in amounts, per mol of silver halide, of $4.0\times10^{-6}$ mol, $3.0\times10^{-5}$ mol and $1.0\times10^{-5}$ mol respectively, and 2-methyl-5-tert-octylhydroquinone was added to the blue, green and red sensitive emulsion layers in amounts, per mol of silver halide, of $8\times10^{-3}$ mol, $2\times10^{-2}$ mol and $2\times10^{-2}$ mol respectively.

Furthermore, 4-hydroxy-6-methyl-1,3,3a,7-tetraazaindene was added to the blue and green sensitive emulsion layers in amounts, per mol of silver halide, of $1.2\times10^{-2}$ mol and $1.1\times10^{-2}$ mol respectively.

Furthermore, the mercaptoimidazole indicated below was added in an amount, per mol of silver halide, of $2\times10^{-4}$ mol, and the mercaptodiazole indicated below was added in an amount, per mol of silver halide, of $4\times10^{-4}$ mol, to the red sensitive emulsion layer.

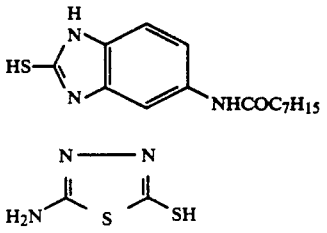

The dyes indicated below were added to the emulsion layers for anti-irradiation purposes.

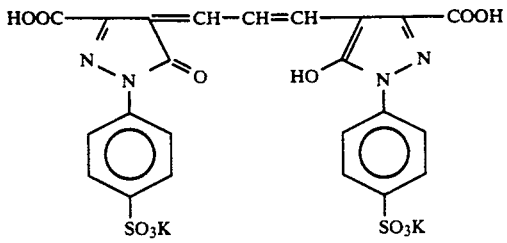

and

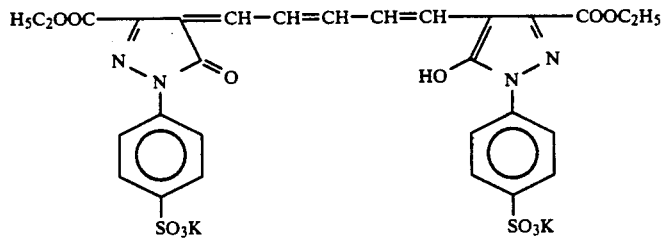

Layer Structure

The composition of each layer was as indicated below. The numerical values indicate coated weights ($g/m^2$). In the case of silver halide emulsions the coated weight is shown as the calculated coated weight of silver.

| | |
|---|---|
| **Support** | |
| Polyethylene laminated paper [White pigment ($TiO_2$) and blue dye (ultramarine) included in the polyethylene layer on the first layer side] | |
| **First Layer (Blue Sensitive Layer)** | |
| The aforementioned silver chlorobromide emulsion (AgBr: 80 mol %) | 0.26 |
| Gelatin | 1.83 |
| Yellow coupler (ExY) | 0.83 |
| Colored image stabilizer (Cpd-1) | 0.19 |
| Colored image stabilizer (Cpd-7) | 0.08 |
| Solvent (Solv-3) | 0.18 |
| Solvent (Solv-6) | 0.18 |
| **Second Layer (Anti-color Mixing Layer)** | |
| Gelatin | 0.99 |
| Anti-color mixing agent (Cpd-5) | 0.08 |
| Solvent (Solv-1) | 0.16 |
| Solvent (Solv-4) | 0.08 |
| **Third Layer (Green Sensitive Layer)** | |
| Silver chlorobromide emulsion (a 1:1 (silver mol ratio) mixture of a cubic emulsion of AgBr 90 mol %, average grain size 0.47 μm and variation coefficient 0.12, and a cubic emulsion of AgBr 90 mol %. average grain size 0.36 μm and variation coefficient 0.09) | 0.16 |
| Gelatin | 1.79 |
| Magenta coupler (ExM) | 0.32 |
| Color image stabilizer (Cpd-4) | 0.01 |
| Solvent (Solv-2) | 0.65 |
| **Fourth Layer (Ultraviolet Absorbing Layer)** | |
| Gelatin | 1.58 |
| Ultraviolet absorber (UV-1) | 0.47 |
| Anti-color mixing agent (Cpd-5) | 0.05 |
| Solvent (Solv-5) | 0.24 |
| **Fifth Layer (Red Sensitive Layer)** | |
| Silver chlorobromide emulsion (a 1:2 (silver mol ratio) mixture of a cubic emulsion of AgBr 70 mol %, average grain size 0.49 μm and variation coefficient 0.08, and a cubic emulsion of AgBr 70 mol %. average grain size 0.34 μm and variation coefficient 0.10) | 0.23 |
| Gelatin | 1.34 |
| Cyan coupler (ExC) | 0.30 |
| Color image stabilizer (Cpd-6) | 0.17 |
| Color image stabilizer (Cpd-7) | 0.40 |
| Solvent (Solv-6) | 0.20 |
| **Sixth Layer (Ultraviolet Absorbing Layer)** | |
| Gelatin | 0.53 |
| Ultraviolet absorber (UV-1) | 0.16 |
| Anti-color mixing agent (Cpd-5) | 0.02 |

-continued

| | |
|---|---|
| Solvent (Solv-5) | 0.08 |
| Seventh Layer (Protective Layer) | |
| Gelatin | 1.33 |
| Acrylic modified poly(vinyl alcohol) (17% modification) | 0.17 |
| Liquid paraffin | 0.03 |

(Cpd-1) Color Image Stabilizer

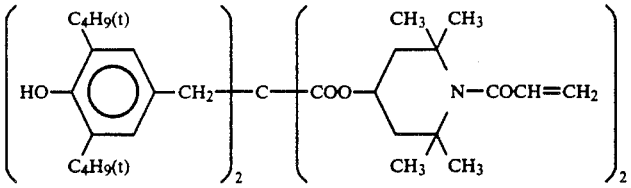

(Cpd-4) Color Image Stabilizer

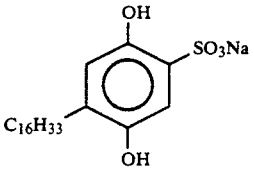

(Cpd-5) Anti-color Mixing Agent

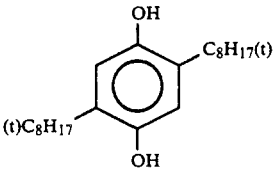

(Cpd-6) Color Image Stabilizer
A 2:4:4 (by weight) mixture of:

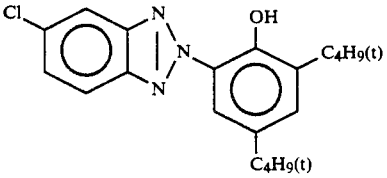

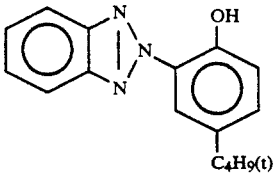

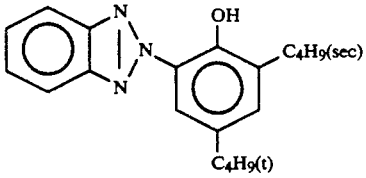

(Cpd-7) Color Image Stabilizer

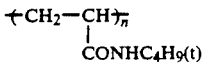

Averge Molecular Weight 80,000

(UV-1) Ultraviolet Absorber
A 4:2:4 (by weight) mixture of:

-continued
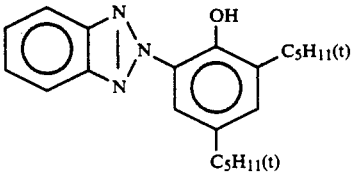
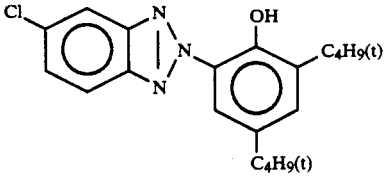
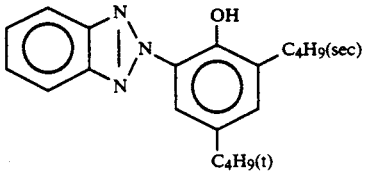
(Solv-1) Solvent
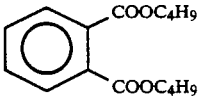
(Solv-2) Solvent
A 1:1:1 (by Weight) mixture of:
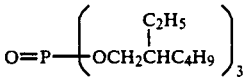
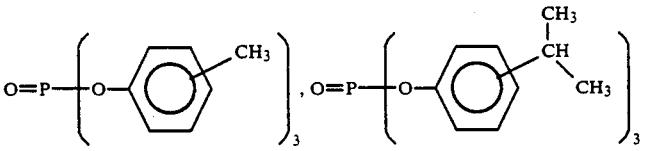
(Solv-3) Solvent
$O{=}P{+}O{-}C_9H_{19}(iso))_3$
(Solv-4) Solvent
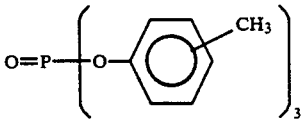
(Solv-5) Solvent
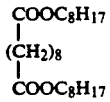
(Solv-6) Solvent
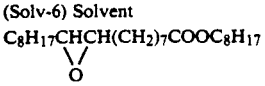
(ExY) Yellow Coupler
A 1:1 (mol) mixture of:

-continued

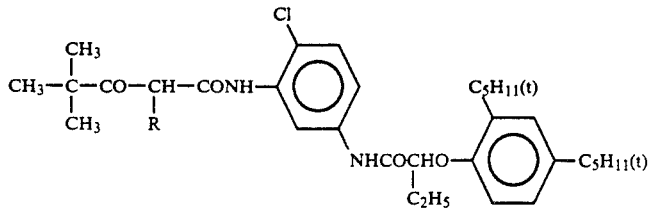

where R =

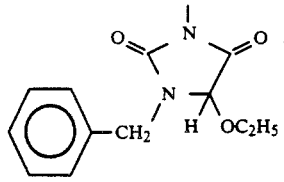

and R =

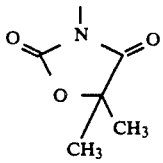

(ExM) Magenta Coupler

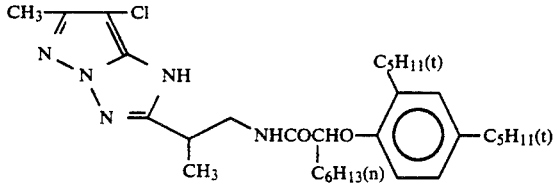

(ExC) Cyan Coupler
A 1:1 (mol) mixture of:

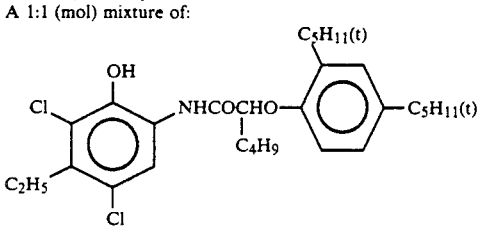

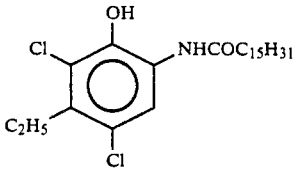

The multi-layer color photographic material prepared in this way was sample A, and other samples were prepared in the same way as sample A except that the magenta coupler in the third layer was changed and compounds represented by general formula (II) to (VI) of the present invention and comparative compounds were added, as indicated in table 1. Moreover, the amount of silver chlorobromide emulsion used in the third layer was doubled when preparing samples $A_{49}$ to $A_{66}$.

These samples were subjected to a graded exposure using sensitometric tri-color separation filters in a sensitometer (Model FWH, light source temperature 3200° K., made by the Fuji Photographic Film Co.). The exposure was carried out in such a way as to provide an exposure of 250 CMS with an exposure time of 0.1 second.

The exposed samples were processed in an automatic processor using the processing operations and processing bath compositions as indicated below.

| Processing Operation | Temperature | Time |
|---|---|---|
| Color development | 37° C. | 3 min. 30 sec. |
| Bleach-fix | 33° C. | 1 min. 30 sec. |
| Water wash | 24 to 34° C. | 3 min. |
| Drying | 70 to 80° C. | 1 min. |

| Color Development Bath | |
|---|---|
| Water | 800 ml |
| Diethylenetriamine penta-acetic acid | 1.0 gram |
| Nitrilotriacetic acid | 2.0 grams |
| Benzyl alcohol | 15 ml |
| Diethyleneglycol | 10 ml |
| Sodium sulfite | 2.0 grams |
| Potassium bromide | 1.0 grams |
| Potassium carbonate | 30 grams |
| N-Ethyl-N-(β-methanesulfonamidoethyl)-3-methyl-4-aminoaniline sulfate | 4.5 grams |
| Hydroxylamine sulfate | 3.0 grams |
| Fluorescent whitener (WHITEX 4B, made by Sumitomo Chemicals) | 1.0 gram |
| Water to make up to | 1000 ml |
| pH (25° C.) | 10.25 |
| Bleach-fix Bath | |
| Water | 400 ml |

-continued

| | |
|---|---|
| Ammonium thiosulfate (70% aqueous soltuion) | 150 ml |
| Sodium sulfite | 18 grams |
| Ethylenediamine tetra-acetic acid, iron(III) ammonium salt | 55 grams |
| Ethylenediamine tetra-acetic acid di-sodium salt | 5 grams |
| Water to make up to | 1000 ml |
| pH (25° C.) | 6.70 |

The samples A to $A_{66}$ obtained in this way were evaluated in respect of the dye retention at initial densities of 1.5 and 0.5 on irradiation for 3 weeks in a xenon color fading testing machine (100,000 lux).

On the other hand, the evaluation of color staining was carried out by measuring the magenta reflection density of the non-image parts of the developed and processed samples 1 hour after processing and then measuring the magenta reflection density of the non-image parts again after leaving the samples to stand in the dark for 50 days at room temperature after being stood for 10 days under conditions of 80° C., 70% RH. The results obtained are summarized in Table 1.

TABLE 1

| Sample | Magenta coupler | Color Image Stabilizer (Amount added with respect to the magenta coupler) | | Anti-staining Agent (Amount added with respect to the magenta coupler) | Dye retention in Xe Color Fading (%) Inital Density 1.5 | Dye retention in Xe Color Fading (%) Initial Density 0.5 | Evaluation of Color Staining Increase Magenta Density | Remarks |
|---|---|---|---|---|---|---|---|---|
| A | ExM (M-15) | — | — | — | 12 | 6 | 0.23 | Comparative Example |
| $A_1$ | " | (II-1) 50 mol % | — | — | 12 | 6 | 0.22 | Comparative Example |
| $A_2$ | " | (II-5) 50 mol % | — | — | 15 | 7 | 0.22 | Comparative Example |
| $A_3$ | " | (II-10) 50 mol % | — | — | 13 | 7 | 0.23 | Comparative Example |
| $A_4$ | " | (II-19) 50 mol % | — | — | 15 | 8 | 0.22 | Comparative Example |
| $A_5$ | " | (II-25) 50 mol % | — | — | 14 | 6 | 0.23 | Comparative Example |
| $A_6$ | " | (II-6) 50 mol % | — | (Ia-1) 20 mol % | 12 | 6 | 0.07 | Comparative Example |
| $A_7$ | " | (II-14) 50 mol % | — | (Ia-12) 20 mol % | 15 | 7 | 0.08 | Comparative Example |
| $A_8$ | " | (II-21) 50 mol % | — | (IIIa-11) 20 mol % | 14 | 8 | 0.06 | Comparative Example |
| $A_9$ | " | (II-29) 50 mol % | — | (Ia-33)/(IIIa-10) 10 mol %/10 mol % | 13 | 7 | 0.05 | Comparative Example |
| $A_{10}$ | " | (II-40) 50 mol % | — | (IIa-5)/(IIIa-25) 10 mol %/10 mol % | 12 | 7 | 0.06 | Comparative Example |
| $A_{11}$ | " | — | (III-2) 50 mol % | — | 71 | 13 | 0.23 | Comparative Example |
| $A_{12}$ | " | — | (III-6) 50 mol % | — | 70 | 10 | 0.23 | Comparative Example |
| $A_{13}$ | " | — | (III-9) 50 mol % | — | 74 | 14 | 0.22 | Comparative Example |
| $A_{14}$ | ExM (M-15) | — | (III-15) 50 mol % | — | 69 | 12 | 0.23 | Comparative Example |
| $A_{15}$ | " | — | (III-22) 50 mol % | — | 73 | 11 | 0.23 | Comparative Example |
| $A_{16}$ | " | — | (III-1) 50 mol % | (Ia-25) 20 mol % | 72 | 13 | 0.09 | Comparative Example |
| $A_{17}$ | " | — | (III-5) 50 mol % | (Ia-36) 20 mol % | 71 | 14 | 0.11 | Comparative Example |
| $A_{18}$ | " | — | (III-11) 50 mol % | (IIIa-27) 20 mol % | 69 | 12 | 0.10 | Comparative Example |
| $A_{19}$ | " | — | (III-23) 50 mol % | (Ia-4)/(IIIa-12) 10 mol %/10 mol % | 70 | 11 | 0.06 | Comparative Example |
| $A_{20}$ | " | — | (III-24) 50 mol % | (Ia-20)/(IIIa-29) | 73 | 12 | 0.05 | Comparative Example |
| $A_{21}$ | " | (II-1) 50 mol % | (III-1) 50 mol % | — | 73 | 64 | 0.23 | Comparative Example |
| $A_{22}$ | " | (II-2) 50 mol % | (III-7) 50 mol % | — | 72 | 63 | 0.23 | Comparative Example |
| $A_{23}$ | " | (II-15) 50 mol % | (III-19) 50 mol % | — | 74 | 61 | 0.22 | Comparative Example |
| $A_{24}$ | " | (II-21) 50 mol % | (III-20) 50 mol % | — | 71 | 64 | 0.23 | Comparative Example |
| $A_{25}$ | " | (II-38) 50 mol % | (III-21) 50 mol % | — | 70 | 61 | 0.23 | Comparative Example |
| $A_{26}$ | " | (II-5) 50 mol % | (III-3) 50 mol % | (Ia-31) 20 mol % | 81 | 79 | 0.01 | This invention |
| $A_{27}$ | " | (II-7) 50 mol % | (III-6) 50 mol % | (Ia-48) 20 mol % | 83 | 82 | 0.01 | " |
| $A_{28}$ | " | (II-10) 50 mol % | (III-9) 50 mol % | (IIIa-5) 20 mol % | 82 | 81 | 0.02 | " |
| $A_{29}$ | ExM (M-15) | (II-25) 50 mol % | (III-13) 50 mol % | (Ia-31)/(IIIa-1) 10 mol %/10 mol % | 84 | 84 | 0.01 | This invention |
| $A_{30}$ | " | (II-29) 50 mol % | (III-25) 50 mol % | (Ia-36)/(IIIa-40) 10 mol %/10 mol % | 83 | 84 | 0.01 | " |
| $A_{31}$ | M-13 | — | — | — | 14 | 7 | 0.20 | Comparative Example |

TABLE 1-continued

| Sample | Magenta coupler | Color Image Stabilizer (Amount added with respect to the magenta coupler) | | Anti-staining Agent (Amount added with respect to the magenta coupler) | Dye retention in Xe Color Fading (%) Inital Density 1.5 | Initial Density 0.5 | Evaluation of Color Staining Increase Magenta Density | Remarks |
|---|---|---|---|---|---|---|---|---|
| $A_{32}$ | " | (II-15) 50 mol % | — | — | 17 | 9 | 0.20 | Comparative Example |
| $A_{33}$ | " | (II-36) 50 mol % | — | — | 15 | 8 | 0.21 | Comparative Example |
| $A_{34}$ | " | — | (III-1) 50 mol % | — | 72 | 13 | 0.20 | Comparative Example |
| $A_{35}$ | " | — | (III-19) 50 mol % | — | 74 | 15 | 0.20 | Comparative Example |
| $A_{36}$ | " | (II-1) 50 mol % | (III-7) 50 mol % | — | 73 | 64 | 0.21 | Comparative Example |
| $A_{37}$ | " | (II-24) 50 mol % | (III-20) 50 mol % | — | 75 | 60 | 0.20 | Comparative Example |
| $A_{38}$ | " | (II-10) 50 mol % | (III-9) 50 mol % | (Ia-31)/(IIIa-1) 10 mol %/10 mol % | 81 | 80 | 0.01 | This invention |
| $A_{39}$ | " | (II-25) 50 mol % | (III-22) 50 mol % | (Ia-36)/(IIIa-18) 10 mol %/10 mol % | 83 | 82 | 0.01 | " |
| $A_{40}$ | M-24 | — | — | — | 8 | 5 | 0.19 | Comparative Example |
| $A_{41}$ | M-24 | (II-2) 50 mol % | — | — | 11 | 6 | 0.18 | Comparative Example |
| $A_{42}$ | " | (II-33) 50 mol % | — | — | 13 | 7 | 0.19 | Comparative Example |
| $A_{43}$ | " | — | (III-19) 50 mol % | — | 63 | 11 | 0.20 | Comparative Example |
| $A_{44}$ | " | — | (III-21) 50 mol % | — | 66 | 10 | 0.20 | Comparative Example |
| $A_{45}$ | " | (II-2) 50 mol % | (III-1) 50 mol % | — | 67 | 52 | 0.19 | Comparative Example |
| $A_{46}$ | " | (II-28) 50 mol % | (III-21) 50 mol % | — | 65 | 53 | 0.19 | Comparative Example |
| $A_{47}$ | " | (II-6) 50 mol % | (III-13) 50 mol % | (Ia-48) 20 mol % | 78 | 76 | 0.01 | This invention |
| $A_{48}$ | " | (II-14) 50 mol % | (III-17) 50 mol % | (IIIa-1) 20 mol % | 75 | 74 | 0.02 | " |
| $A_{49}$ | Comparative coupler-A | — | — | — | 19 | 20 | 0.10 | Comparative Example |
| $A_{50}$ | Comparative coupler-A | (II-1) 50 mol % | — | — | 40 | 39 | 0.11 | Comparative Example |
| $A_{51}$ | Comparative coupler-A | (II-36) 50 mol % | — | — | 37 | 36 | 0.09 | Comparative Example |
| $A_{52}$ | Comparative coupler-A | — | (III-18) 50 mol % | — | 51 | 32 | 0.10 | Comparative Example |
| $A_{53}$ | Comparative coupler-A | — | (III-23) 50 mol % | — | 53 | 34 | 0.09 | Comparative Example |
| $A_{54}$ | Comparative coupler-A | (II-3) 50 mol % | (III-1) 50 mol % | — | 51 | 35 | 0.09 | Comparative Example |
| $A_{55}$ | Comparative coupler-A | (II-10) 50 mol % | (III-24) 50 mol % | — | 52 | 31 | 0.11 | Comparative Example |
| $A_{56}$ | Comparative coupler-A | (II-26) 50 mol % | (III-15) 50 mol % | (Ia-20)/(IIIa-11) 10 mol %/10 mol % | 53 | 33 | 0.05 | Comparative Example |
| $A_{57}$ | Comparative coupler-A | (II-30) 50 mol % | (III-8) 50 mol % | (Ia-29)/(IIIa-25) 10 mol %/10 mol % | 54 | 30 | 0.04 | Comparative Example |
| $A_{58}$ | Comparative coupler-B | — | — | — | 18 | 19 | 0.12 | Comparative Example |
| $A_{59}$ | Comparative coupler-B | (II-4) 50 mol % | — | — | 36 | 37 | 0.12 | Comparative Example |
| $A_{60}$ | Comparative coupler-B | (II-30) 50 mol % | — | (Ia-6) 20 mol % | 34 | 30 | 0.06 | Comparative Example |
| $A_{61}$ | Comparative coupler-B | — | (III-8) 50 mol % | — | 52 | 39 | 0.13 | Comparative Example |
| $A_{62}$ | Comparative coupler-B | — | (III-26) 50 mol % | (IIa-3) 20 mol % | 53 | 45 | 0.05 | Comparative Example |
| $A_{63}$ | Comparative coupler-B | (II-13) 50 mol % | (III-1) 50 mol % | — | 51 | 37 | 0.12 | Comparative Example |
| $A_{64}$ | Comparative coupler-B | (II-26) 50 mol % | (III-24) 50 mol % | — | 54 | 41 | 0.12 | Comparative Example |
| $A_{65}$ | Comparative coupler-B | (II-1) 50 mol % | (III-7) 50 mol % | (Ia-45) 20 mol % | 53 | 43 | 0.05 | Comparative Example |
| $A_{66}$ | Comparative coupler-B | (II-15) 50 mol % | (III-19) 50 mol % | (IIIa-27) 20 mol % | 52 | 38 | 0.06 | Comparative Example |

Comparative Coupler A

-continued

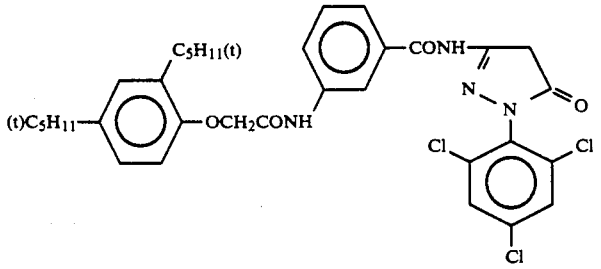

Coupler disclosed in European Patent (Laid Open) No. 176,845

Comparative Coupler B

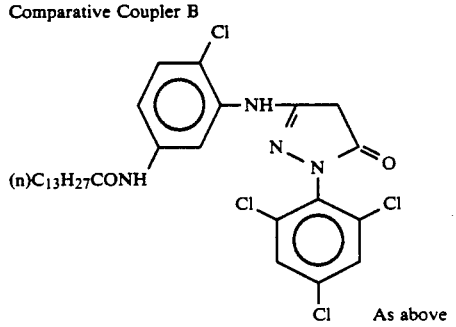

As above

Light fastness was inadequate with the compounds represented by formula (II) alone, and although the light fastness at an initial density of 1.5 was considerable when compounds represented by formula (III) were used alone, the light fastness at an initial density of 0.5 was inadequate. However, there was less staining when compounds represented by formula (IV), (V) and (VI) were used together with compounds represented by formula (II) or (III), but this was unsatisfactory.

On the other hand, samples in which compounds represented by formula (II), compounds represented by formula (III), and compounds represented by formula (IV), (V) or (VI), of the present invention, surprisingly eliminated staining in practice. Furthermore, the light fastness was improved not only in the high density parts but also in the low density parts. The extent of these improvements is very surprising and could not have been anticipated from the extent of the individual improvements and the 5-pyrazolone magenta couplers.

EXAMPLE 2

A multi-layer color printing paper having the layer structure described below was prepared on a paper support laminated on both sides with polyethylene. The coating liquids were prepared in the way described below.

Preparation of the First Layer Coating Liquid

Ethyl acetate (27.2 ml) and 8.2 grams of the solvent (Solv-1) were added to 19.1 gram of yellow coupler (ExY) and 4.4 grams of color image stabilizer (Cpd-1) to form a solution which was then emulsified and dispersed in 185 ml of a 10% aqueous gelatin solution which contained 8 ml of 10% sodium dodecylbenzenesulfonate. Separately, the blue sensitive sensitizing dyes indicated below were added to a silver chlorobromide emulsion (a 3:7 (Ag mol ratio) mixture of cubic emulsions of average grain size 0.88 μm and 0.70 μm; the variation coefficients of the grain size distributions were 0.08 and 0.10, and each emulsion had 0.2 mol % silver bromide included locally on the surface of the grains) in amounts of $2.0\times10^{-4}$ mol of each per mol of silver for the emulsion which had large grains and in amounts of $2.5\times10^{-4}$ mol of each per mol of silver halide for the emulsion which had small grains, after which the emulsion was sulfur sensitized. This emulsion was mixed with the aforementioned emulsified dispersion to prepare the first layer coating liquid of which the composition is indicated below.

The coating liquids for the second to the seventh layers were prepared using the same procedure as for the first layer coating liquid. 1-Oxy-3,5-dichloro-s-triazine sodium salt was used as a gelatin hardening agent for each layer.

The spectrally sensitizing dyes indicated below were used for each layer.

Blue Sensitive Emulsion Layer

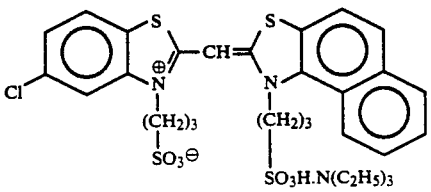

-continued

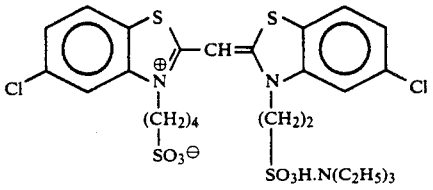

(2.0 × $10^{-4}$ mol of each per mol of silver halide for the large size emulsion and 2.5 × $10^{-4}$ mol of each per mol of silver halide for the small size emulsion)

Green Sensitive Emulsion Layer

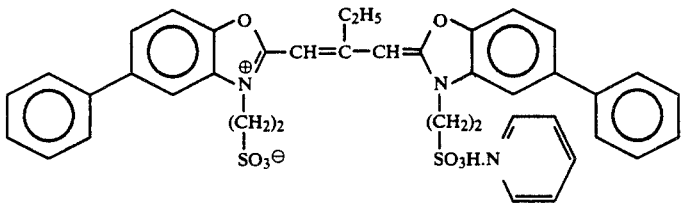

(4.0 × $10^{-4}$ mol per mol of silver halide for the large size emulsion and 5.6 × $10^{-4}$ mol per mol of silver halide for the small size emulsion)

and

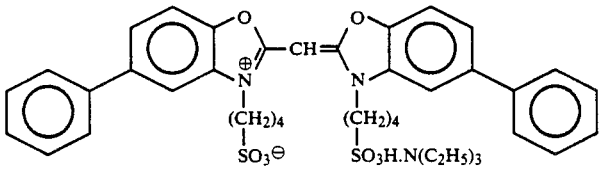

(7.0 × $10^{-5}$ mol per mol of silver halide for the large size emulsion and 1.0 × $10^{-5}$ mol per mol of silver halide for the small size emulsion)

Red Sensitive Emulsion Layer

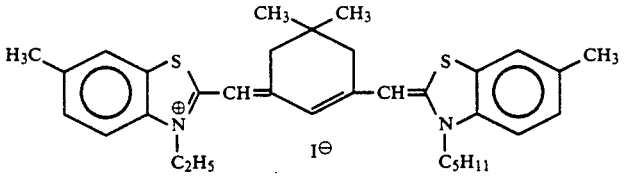

(0.9 × $10^{-4}$ mol per mol of silver halide for the large size emulsion and 1.1 × $10^{-4}$ mol per mol of silver halide for the small size emulsion)

The compound indicated below was added in an amount of $2.6 \times 10^{-3}$ mol per mol of silver halide to the red sensitive emulsion layer.

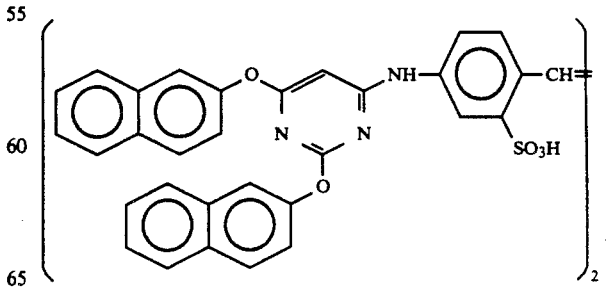

Furthermore, 1-(5-methylureidophenyl)-5-mercaptotetrazole was added to the blue, green and red sensitive emulsions layers in amounts, per mol of silver halide, of $8.5\times10^{-5}$ mol, $7.7\times10^{-4}$ mol and $2.5\times10^{-4}$ mol respectively.

Furthermore, 4-hydroxy-6-methyl-1,3,3a,7-tetraazaindene was added to the blue and green sensitive emulsion layers in amounts, per mol of silver halide, of $1\times10^{31\ 4}$ mol and $2\times10^{-4}$ mol respectively.

The dyes indicated below were added to the emulsion layers for anti-irradiation purpose.

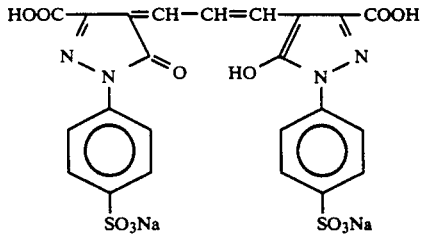

and

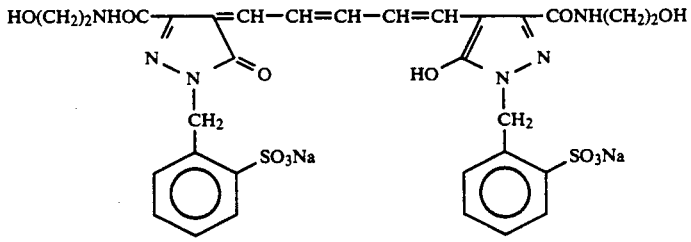

Layer Structure

The composition of each layer was as indicated below. The numerical values indicate coated weights ($g/m^2$). In the case of silver halide emulsions the coated weight is shown as the calculated coated weight of silver.

| | |
|---|---|
| Support | |
| Polyethylene laminated paper [White pigment ($TiO_2$) and blue dye (ultramarine) included in the polyethylene layer on the first layer side] | |
| First Layer (Blue Sensitive Layer) | |
| The aforementioned silver chlorobromide emulsion | 0.30 |
| Gelatin | 1.86 |
| Yellow coupler (ExY) | 0.82 |
| Colored image stabilizer (Cpd-1) | 0.19 |
| Solvent (Solv-1) | 0.35 |
| Colored image stabilizer (Cpd-7) | 0.06 |
| Second Layer (Anti-color Mixing Layer) | |
| Gelatin | 0.99 |
| Anti-color mixing agent (Cpd-5) | 0.08 |
| Solvent (Solv-1) | 0.16 |
| Solvent (Solv-4) | 0.08 |
| Third Layer (Green Sensitive Layer) | |
| Silver chlorobromide emulsion (a 1:3 (silver mol ratio) mixture of cubic emulsions of average grain size 0.55 μm and 0.39 μm; the variation coefficient of the grain size distributions were 0.10 and 0.08, and each emulsion had 0.8 mol % AgBr included locally on the grain surfaces) | 0.12 |
| Gelatin | 1.24 |
| Magenta coupler (ExM) | 0.20 |
| Anti-staining agent (Ia-31) | 0.03 |
| Anti-staining agent (IIIa-1) | 0.02 |
| Solvent (Solv-2) | 0.40 |
| Fourth Layer (Ultraviolet Absorbing Layer) | |
| Gelatin | 1.58 |
| Ultraviolet absorber (UV-1) | 0.47 |
| Anti-color mixing agent (Cpd-5) | 0.05 |
| Solvent (Solv-5) | 0.24 |
| Fifth Layer (Red Sensitive Layer) | |
| Silver chlorobromide emulsion (a 1:4 (silver mol ratio) mixture of cubic emulsions of average grain size 0.58 μm and 0.45 μm; the variation coefficient of the grain size distributions were 0.09 and 0.11, and each emulsion had 0.6 mol % AgBr included locally on the grain surfaces) | 0.23 |
| Gelatin | 1.34 |
| Cyan coupler (ExC) | 0.32 |

-continued

| | |
|---|---|
| Color image stabilizer (Cpd-6) | 0.17 |
| Color image stabilizer (Cpd-7) | 0.40 |
| Color image stabilizer (Cpd-8) | 0.04 |
| Solvent (Solv-6) | 0.15 |
| Sixth Layer (Ultraviolet Absorbing Layer) | |
| Gelatin | 0.53 |
| Ultraviolet absorber (UV-1) | 0.16 |
| Anti-color mixing agent (Cpd-5) | 0.02 |
| Solvent (Solv-5) | 0.08 |
| Seventh Layer (Protective Layer) | |
| Gelatin | 1.33 |
| Acrylic modified poly(vinyl alcohol) (17% modification) | 0.17 |
| Liquid paraffin | 0.03 |

(ExY) Yellow Coupler
A 1:1 (mol ratio) mixture of:

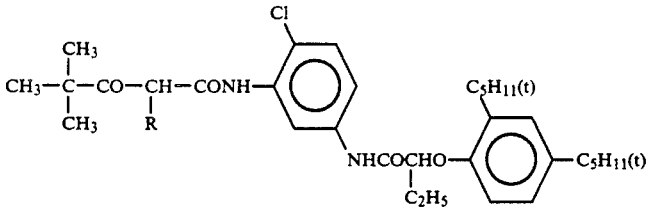

R = 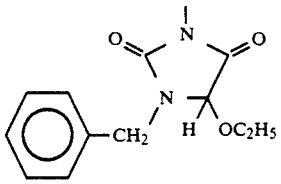 and R = 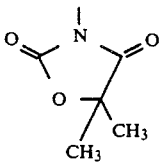

(ExM) Magenta Coupler
A 1:1 (mol ratio) mixture of:

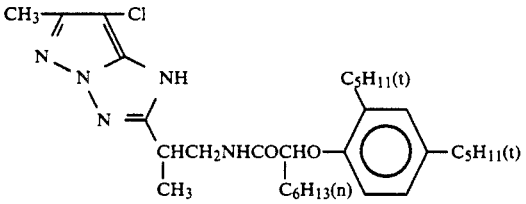

and

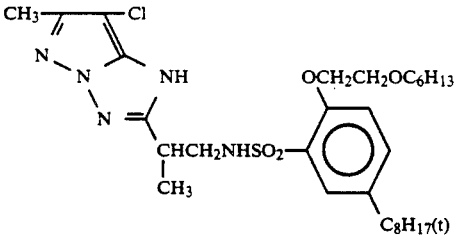

(ExC) Cyan Coupler
A 2:4:4 (by weight) mixture of:

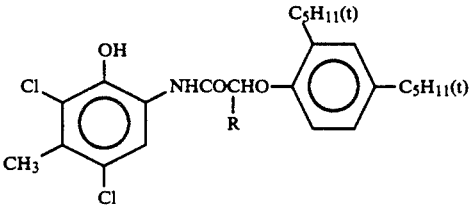

R = $C_2H_5$ and $C_4H_9$
and

-continued
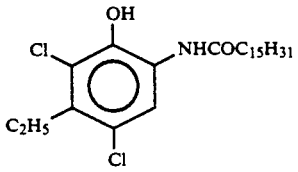
(Cpd-1) Color Image Stabilizer
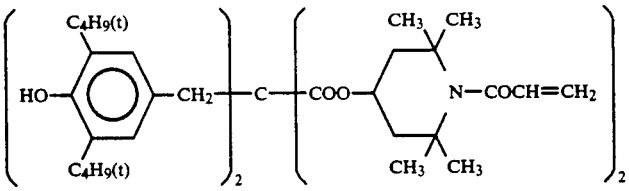
(Cpd-5) Anti-color Mixing Agent
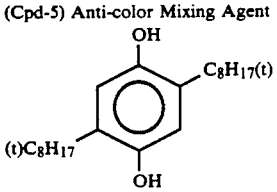
(Cpd-6) Color Image Stabilizer
A 2:4:4 (by weight) mixture of:
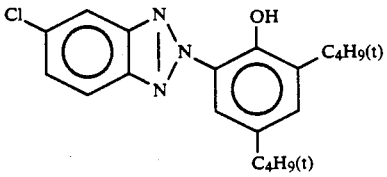
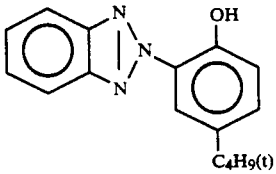
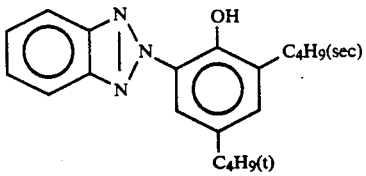
(Cpd-7) Color Image Stabilizer
$$\left(CH_2-\underset{\substack{|\\ CONHC_4H_9(t)}}{CH}\right)_n$$
Averge Molecular Weight 60,000
(Cpd-8) Color Image Stabilizer
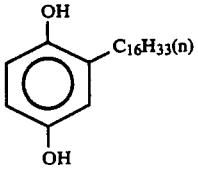
(UV-1) Ultraviolet Absorber
A 4:2:4 (by weight) mixture of:

-continued
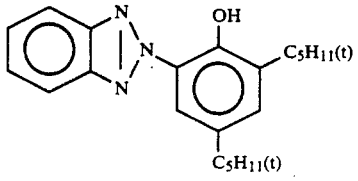
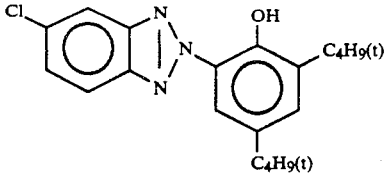
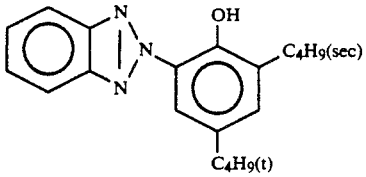
(Solv-1) Solvent
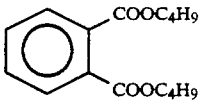
(Solv-2) Solvent
A 1:1:1 (by volume) mixture of:
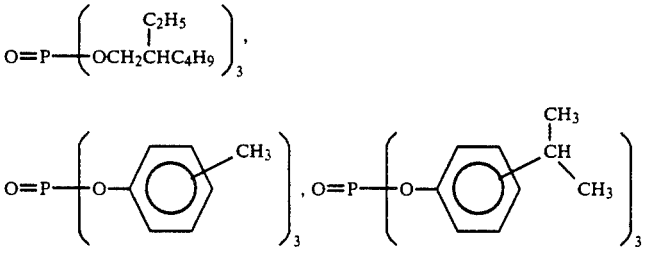
(Solv-4) Solvent
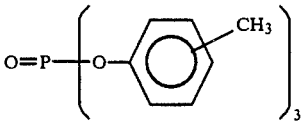
(Solv-5) Solvent
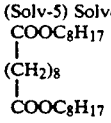
(Solv-6) Solvent
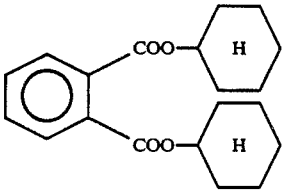
The multi-layer color photographic material prepared in this way was sample B, and other samples were prepared in just the same way as sample B except that the magenta coupler in the third layer was changed and compounds represented by general formulae (II) and (III) of this present invention, and comparative compounds, were added, as shown in Table 2.

Each sample was exposed using the method described in example 1. The exposed samples were subjected to continuous processing (a running test) using a paper processor until replenishment had been carried out to twice the color development tank capacity in the processing operations indicated below.

| Processing Operation | Temperature (°C.) | Time (sec.) | Replenishment Rate* | Tank Capacity |
|---|---|---|---|---|
| Color Development | 35 | 45 | 161 ml | 17 liters |
| Bleach-fix | 30 to 35 | 45 | 215 ml | 17 liters |
| Rinse (1) | 30 to 35 | 20 | — | 10 liters |
| Rinse (2) | 30 to 35 | 20 | — | 10 liters |
| Rinse (3) | 30 to 35 | 20 | 350 ml | 10 liters |
| Drying | 70 to 80 | 60 | | |

*Replenishment rate per square meter of photographic material.
(A three tank counter flow system from rinse (3) → Rinse (1) was used)

The composition of each processing bath was as indicated below.

| | Tank Solution | Replenisher |
|---|---|---|
| Color Development Bath | | |
| Water | 800 ml | 800 ml |
| Ethylenediamine-N,N,N',N'-tetramethylenephosphonic acid | 1.5 grams | 2.0 grams |
| Triethanolamine | 8.0 grams | 12.0 grams |
| Sodium chloride | 1.4 grams | — |
| Potassium carbonate | 25 grams | 25 grams |
| N-Ethyl-N-(β-methanesulfonamidoethyl)-3-methyl-4-aminoaniline sulfate | 5.0 grams | 7.0 grams |
| N,N-Bis(carboxymethyl)-hydrazine | 5.5 grams | 7.0 grams |
| Fluorescent whitener (WHITEX 4B, made by Sumitomo Chemicals) | 1.0 gram | 2.0 grams |
| Water to make up to | 1000 ml | 1000 ml |
| pH (25° C.) | 10.05 | 10.45 |
| Bleach-fix Bath (Tank Solution = Replenisher) | | |
| Water | | 400 ml |
| Ammonium thiosulfate (70% aqueous solution) | | 100 ml |
| Sodium sulfite | | 17 grams |
| Ethylenediamine tetra-acetic acid iron(III) ammonium salt | | 55 grams |
| Ethylenediamine tetra-acetic acid, di-sodium salt | | 5 grams |
| Ammonium bromide | | 40 grams |
| Water to make up to | | 1000 ml |
| pH (25° C.) | | 6.0 |
| Rinse Bath (Tank Solution = Replenisher) | | |
| Ion exchanged water (Calcium and magnesium both less than 3 ppm) | | |

The samples obtained in this way were tested in respect of light fading of the magenta image in the same way as in Example 1.

The results obtained are shown in Table 2.

TABLE 2

| Sample | Magenta coupler | Color Image Stabilizer (Amount added with respect to the magenta coupler) | | Dye Retention (%) Initial Density 1.5 | Dye Retention (%) Initial Density 0.5 | Remarks |
|---|---|---|---|---|---|---|
| B | ExM(M-10/M-15) | — | — | 13 | 7 | Comparative Example |
| $B_1$ | " | — | (III-1) 50 mol % | 73 | 14 | Comparative Example |
| $B_2$ | " | — | (III-5) 50 mol % | 75 | 13 | Comparative Example |
| $B_3$ | " | — | (III-23) 50 mol % | 71 | 15 | Comparative Example |
| $B_4$ | " | Comparative Compound (a) 50 mol % | (III-24) 50 mol % | 53 | 11 | Comparative Example |
| $B_5$ | " | Comparative Compound (b) 50 mol % | " | 52 | 51 | Comparative Example |
| $B_6$ | " | Comparative Compound (c) 50 mol % | " | 54 | 12 | Comparative Example |
| $B_7$ | " | (II-1) 50 mol % | (II-5) 50 mol % | 20 | 12 | Comparative Example |
| $B_8$ | " | (II-7) 50 mol % | (II-38) 50 mol % | 21 | 13 | Comparative Example |
| $B_9$ | " | (II-14) 50 mol % | (II-29) 50 mol % | 25 | 14 | Comparative Example |
| $B_{10}$ | " | (II-5) 50 mol % | (III-3) 50 mol % | 83 | 82 | This invention |
| $B_{11}$ | " | (II-7) 50 mol % | (III-6) 50 mol % | 81 | 80 | " |
| $B_{12}$ | ExM(M-10/M-15) | (II-10) 50 mol % | (III-9) 50 mol % | 81 | 82 | Comparative Example |
| $B_{13}$ | M-12 | — | — | 12 | 6 | Comparative Example |
| $B_{14}$ | " | — | (III-1) 50 mol % | 71 | 13 | Comparative Example |
| $B_{15}$ | " | — | (III-15) 50 mol % | 73 | 15 | Comparative Example |
| $B_{16}$ | " | — | (III-19) 50 mol % | 70 | 10 | Comparative Example |
| $B_{17}$ | " | Comparative Compound (d) 50 mol % | (III-1) 50 mol % | 55 | 11 | Comparative Example |
| $B_{18}$ | " | Comparative Compound (e) 50 mol % | " | 52 | 13 | Comparative Example |
| $B_{19}$ | " | Comparative Compound (f) 50 mol % | " | 50 | 14 | Comparative Example |
| $B_{20}$ | " | (III-1) 50 mol % | (III-7) 50 mol % | 76 | 17 | Comparative |

TABLE 2-continued

| Sample | Magenta coupler | Color Image Stabilizer (Amount added with respect to the magenta coupler | | Dye Retention (%) Initial Density 1.5 | Initial Density 0.5 | Remarks |
|---|---|---|---|---|---|---|
| | | | | | | Example |
| $B_{21}$ | " | " | (III-19) 50 mol % | 74 | 19 | Comparative Example |
| $B_{22}$ | " | " | (III-22) 50 mol % | 72 | 13 | Comparative Example |
| $B_{23}$ | M-12 | (II-7) 50 mol % | (III-9) 50 mol % | 83 | 84 | This invention |
| $B_{24}$ | " | (II-14) 50 mol % | " | 85 | 83 | " |
| $B_{25}$ | " | (II-25) 50 mol % | " | 84 | 83 | " |
| $B_{26}$ | M-27 | — | — | 9 | 6 | Comparative Example |
| $B_{27}$ | " | — | (III-8) 50 mol % | 62 | 19 | Comparative Example |
| $B_{28}$ | " | Comparative Compound (c) 50 mol % | Comparative Compound (d) 50 mol % | 43 | 13 | Comparative Example |
| $B_{29}$ | " | (II-10) 50 mol % | (III-12) 50 mol % | 89 | 87 | This invention |

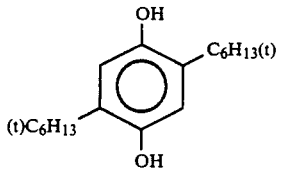

Comparative Compound (a)

The compound disclosed in JP-A-62-85247 and JP-A-62-98352

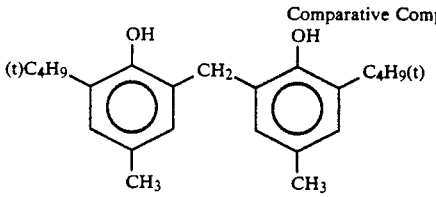

Comparative Compound (b)

The compound disclosed in JP-A-62-81639 and JP-A-62-85247 and JP-A-62-98352

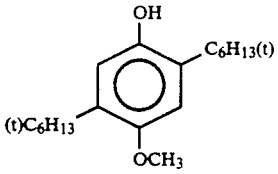

Comparative Compound (c)

The compound disclosed in European Patent (Laid Open) No. 278,312

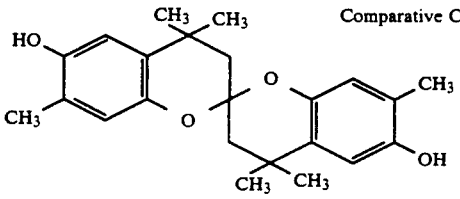

Comparative Compound (d)

The compound disclosed in U.S. Pat. No. 4,588,679 and European Patent (Laid Open) No. 278,312

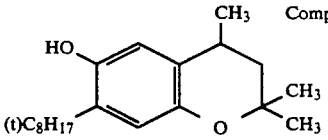

Comparative Compound (e)

The compound disclosed in European Patent (Laid Open) No. 278,312

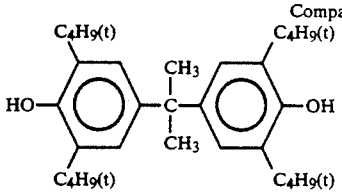

Comparative Compound (f)

The compound disclosed in European Patent (Laid Open) No. 278,312

It is clear from Table 2 that the improvement in light fastness obtained with the use of combinations of compounds represented by formula (III) with other known compounds, combinations of compounds represented by formula (II), or compounds represented by formula (III) was inadequate, and that pronounced improvement in light fastness was only achieved with combinations of compounds represented by formula (III) with compounds represented by formula (II). The level of light fastness achieved was approximately the same as the level of light fastness of the yellow in the third layer and the cyan in the fifth layer.

Furthermore, on evaluating color staining in the same way as described in Example 1 it was found that while there was no increase in the magenta density in practical terms with Samples $B_{10}$ to $B_{12}$, $B_{23}$ to $B_{25}$ and $B_{29}$, although there was some magenta staining with the other samples.

EXAMPLE 3

A multi-layer color printing paper having the layer structure is indicated below was prepared on a paper support which had been laminated on both sides with polyethylene, where the surface had been subjected o a corona discharge treatment. The coating liquids were prepared in the way described below.

Preparation of the First Layer Coating Liquid

Ethyl acetate (150 ml), 1.0 ml of the solvent (Solv-3) and 3.0 ml of the solvent (Solv-4) were added to 60.0 grams of yellow coupler (ExY) and 28.0 grams of anti-color fading agent (Cpd-1) to form a solution which was added to 450 ml of 10% aqueous gelatin solution which contained sodium dodecylbenzenesulfonate and dispersed in an ultrasonic homogenizer. The dispersion so obtained was then mixed with 420 grams of a silver chlorobromide emulsion (0.7 mol % silver bromide) which contained the blue sensitive sensitizing dye indicated below to provide the first layer coating liquid.

The coating liquids for the second to seventh layers were prepared in the same way as the first layer coating liquid. 1,2-Bis(vinylsulfonyl)ethane was used as a gelatin hardening agent in each layer.

Furthermore, the spectrally sensitizing dyes indicated below were used in each layer.

Blue Sensitive Emulsion Layer: Anhydro-5,5'-dichloro-3,3'-disulfoethylthiacyanine hydroxide Green Sensitive Emulsion Layer: Anhydro-9-ethyl-5,5'-diphenyl-3,3'-disulfoethyloxacarbocyanine hydroxide Red Sensitive Emulsion Layer: 3,3'-Diethyl-5-methoxy-9,11-neopentylazicarbocyanine iodide Furthermore, the following substances were used as stabilizers in each emulsion layer, A 7:2:1 (mol ratio) mixture of 1-(2-acetaminophenyl)-5-mercaptotetrazole, 1-phenyl-5-mercaptotetrazole and 1-(p-methoxyphenyl)-5-mercaptotetrazole.

Furthermore, the substances indicated below were used as anti-irradiation dyes.

[3-Carboxy-5-hydroxy-4-(3-(3-carboxy-5-oxo-1-(2,5-disulfonatophenyl)-2-pyrazolin-4-ylidene)-1-propenyl)-1-pyrazolyl]benzene-2,5-disulfonate disodium salt N,N'-(4,8-Dihydroxy-9,10-dioxo-3,7-disulfonatoanthracen-1,5-diyl)bis(aminomethanesulfonate) tetrasodium salt

[3-Cyano-5-hydroxy-4-(3-(3-cyano-5-oxo-1-(4-sulfonatophenyl)-2-pyrazolin-4-ylidene)-1-pentanyl)-1-pyrazolyl]benzene-4-sulfonate sodium salt

Layer Structure

The composition of each layer was as indicated below. The numerical values indicate coated weights (g/m$^2$). In the case of the silver halides, the calculated coated silver weights are shown

| | |
|---|---|
| **Support** | |
| A paper support which had been laminated on both sides with polyethylene and of which the surface had been subjected to a corona discharge treatment. | |
| **First Layer (Blue Sensitive Layer)** | |
| The above silver chlorobromide emulsion (AgBr 0.7 mol %, cubic, average grain size 0.9 μm) | 0.29 |
| Gelatin | 1.80 |
| Yellow coupler (ExY) | 0.60 |
| Anti-color fading agent (Cpd-1) | 0.28 |
| Solvent (Solv-3) | 0.01 |
| Solvent (Solv-4) | 0.03 |
| **Second Layer (Anti-color Mixing Layer)** | |
| Gelatin | 0.80 |
| Anti-color mixing agent (Cpd-2) | 0.055 |
| Solvent (Solv-1) | 0.03 |
| Solvent (Solv-2) | 0.15 |
| **Third Layer (Green Sensitive Layer)** | |
| The above silver chlorobromide emulsion (AgBr 0.7 mol %, cubic, average grain size 0.45 μm) | 0.18 |
| Gelatin | 1.86 |
| Magenta coupler (ExM) | 0.27 |
| Anti-staining agent (Ia-31) | 0.10 |
| Anti-staining agent (IIIa-5) | 0.05 |
| Solvent (Solv-1) | 0.2 |
| Solvent (Solv-2) | 0.03 |
| **Fourth Layer (Anti-color Mixing Layer)** | |
| Gelatin | 1.70 |
| Anti-color mixing agent (Cpd-2) | 0.065 |
| Ultraviolet absorber (UV-1) | 0.45 |
| Ultraviolet absorber (UV-2) | 0.23 |
| Solvent (Solv-1) | 0.05 |
| Solvent (Solv-2) | 0.05 |
| **Fifth Layer (Red Sensitive Layer)** | |
| The above silver chlorobromide emulsion (AgBr 4 mol %, cubic, average grain size 0.5 μm) | 0.21 |
| Gelatin | 1.80 |
| Cyan coupler (ExC-1) | 0.26 |
| Cyan coupler (ExC-2) | 0.12 |
| Anti-color fading agents (Cpd-1) | 0.20 |
| Solvent (Solv-1) | 0.16 |
| Solvent (Solv-2) | 0.09 |
| Color development accelerator (Cpd-5) | 0.15 |
| **Sixth Layer (Ultraviolet Absorbing Layer)** | |
| Gelatin | 0.70 |
| Ultraviolet absorber (UV-1) | 0.26 |
| Ultraviolet absorber (UV-2) | 0.07 |
| Solvent (Solv-1) | 0.30 |
| Solvent (Solv-2) | 0.09 |
| **Seventh Layer (Protective Layer)** | |
| Gelatin | 1.07 |

(ExY) Yellow Coupler
α-Pivaloyl-α-(3-benzyl-1-hydantoinyl)-2-chloro-5-[β-dodecylsulfonyl)butylamido]acetanilide
(ExM) Magenta Coupler
7-Chloro-6-isopropyl-3-{3-[(2-butoxy-5-tert-octyl)benzenesulfonyl]propyl}-1H-pyrazolo[5,1-c]-1,2,4-triazole
(ExC-1) Cyan Coupler
2-Pentafluorobenzamido-4-chloro-5-[2-(2,4-di-tert-amylphenoxy)-3-methylbutylamido]phenol
(ExC-2) Cyan Coupler
2,4-Dichloro-3-methyl-6-[α-(2,4-di-tert-amylphenoxy)butylamido]phenol (Cpd-1) Anti-color Fading Agent $$\left(CH_2-\underset{\underset{CONHC_4H_9(t)}{|}}{CH}\right)_n$$

Average Molecular Weight 80,000

(Cpd-2) Anti-color Mixing Agent
2,5-Di-tert-octylhydroquinone
(Cpd-5) Color Development Accelerator
p-(p-Toluenesulfonamido)phenyldodecane
(Solv-1) Solvent
Di-(2-ethylhexyl)phthalate
(Solv-2) Solvent
Dibutyl phthalate
(Solv-3) Solvent
Di-(iso-nonyl) phthalate
(Solv-4) Solvent
N,N-Diethylcarboxamidomethoxy-2,4-di-tert-amylbenzene
(UV-1) Ultraviolet Absorber
2-(2-Hydroxy-3,5-di-tert-amylphenyl)benzotriazole
(UV-2) Ultraviolet Absorber
2-(2-Hydroxy-3,5-di-tert-butylphenyl)benzotriazole The sample prepared in this way was sample C, and other samples were prepared in the same way as sample C except that 50 mol % of (II-10) and 100 mol % of (III-2), (III-5), (III-9), (III-16), (III-18), (III-20), (III-21) or (III-26) were added and used together in the third layer.

These samples were exposed using the method described in Example 1, and samples of the above mentioned photographic materials which had been subjected separately to an imagewise exposure were processed continuously (in a running test) using a paper processor with the processing operations indicated below until replenished to twice the color development tank capacity and colored images were obtained.

| Processing Operation | Temperature (°C.) | Time (sec.) | Replenishment Rate* | Tank Capacity |
|---|---|---|---|---|
| Color Development | 35 | 45 | 161 ml | 17 liters |
| Bleach-fix | 30 to 36 | 45 | 215 ml | 17 liters |
| Stabilization (1) | 30 to 37 | 20 | — | 10 liters |
| Stabilization (2) | 30 to 37 | 20 | — | 10 liters |
| Stabilization (3) | 30 to 37 | 20 | — | 10 liters |
| Stabilization (4) | 30 to 37 | 30 | 248 ml | 10 liters |
| Drying | 70 to 85 | 60 | | |

*Replenishment rate per square meter of photographic material.
(A four tank counter flow system from Stabilization (4) → Stabilization (1) was used)

The composition of each processing bath was as indicated below.

| Color Development Bath | Tank Solution | Replenisher |
|---|---|---|
| Water | 800 ml | 800 ml |
| Ethylenediamine tetra-acetic acid | 2.0 grams | 2.0 grams |
| 5,6-Dihydroxybenzene-1,2,4-trisulfonic acid | 0.3 gram | 0.3 gram |
| Triethanolamine | 8.0 grams | 8.0 grams |
| Sodium chloride | 1.4 grams | — |
| Potassium carbonate | 25 grams | 25 grams |
| N-Ethyl-N-(β-methanesulfonamidoethyl)-3-methyl-4-aminoaniline sulfate | 5.0 grams | 7.0 grams |
| Diethylhydroxylamine | 4.2 grams | 6.0 grams |
| Fluorescent whitener (4,4'-diaminostilbene based) | 2.0 gram | 2.5 grams |
| Water to make up to | 1000 ml | 1000 ml |
| pH (25° C.) | 10.05 | 10.45 |
| Bleach-fix Bath (Tank Solution = Replenisher) | | |
| Water | | 400 ml |
| Ammonium thiosulfate (70% aqueous solution) | | 100 ml |
| Sodium sulfite | | 17 grams |
| Ethylenediamine tetra-acetic acid, iron(III) ammonium salt | | 55 grams |
| Ethylenediamine tetra-acetic acid, di-sodium salt | | 5 grams |
| Glacial acetic acid | | 9 grams |
| Water to make up to | | 1000 ml |
| pH (25° C.) | | 5.40 |
| Stabilizer Bath (Tank Solution = Replenisher) | | |
| Formalin (37%) | | 0.1 gram |
| Formalin/sulfurous acid adduct | | 0.7 gram |
| 5-Chloro-2-methyl-4-isothiazolin-3-one | | 0.02 gram |
| 2-Methyl-4-isothiazolin-3-one | | 0.01 gram |
| Copper sulfate | | 0.005 gram |
| Water to make up to | | 1000 ml |
| pH (25° C.) | | 4.0 |

The samples obtained in this way were evaluated with light fading tests of the magenta image and in respect of magenta staining in the non-image parts in the same way as described in Example 1, whereupon it was found that while the light fastness of sample C was very poor and an increase in staining (an increase in magenta density) was observed, with the other samples the color retentions at initial densities of 1.5 and 0.5 were approximately even; there was a marked improvement in light fastness; and there was n increased staining (increase in the magenta density) for practical purposes.

This invention can be also preferably applied to other various kinds of color photographic light-sensitive materials such as reversal color photographic papers, reversal color photographic films, etc. Practical examples thereof are explained below.

EXAMPLE 4

A color photographic light-sensitive material (reversal color photographic paper) as described in Example 2 of JP-A-1-158431 was prepared. In this photographic material, in each of the 6th and 7th layers ExM-1 (0.11 g/m$^2$), ExM-2 (0.11 g/m$^2$), anti-color fading agents Cpd-9 (0.10 g/m$^2$), Cpd-10 (0.013 g/m$^2$) and Cpd-22 (0.013 g/m$^2$) were contained. Furthermore, the 6th layer contained Cpd-12 (0.001 g/m$^2$) and the 7th layer contained Cpd-12 (0.01 g/m$^2$). In this case, however, to each of the 6th layer (low-sensitive green-sensitive layer) and the 7th layer (high-sensitive green-sensitive layer) was added 0.01 g/m$^2$ of Cpd-25 shown below as stain inhibitor.

ExM-1: Magenta Coupler M-9 of the present invention
ExM-2: Magenta Coupler M-34 of the present invention
Cpd-9: Compound III-9 of the present invention
Cpd-10: Compound Ia-48 of the present invention
Cpd-22: Compound Ia-31 of he present invention
Cpd-12: Compound IIIa-1 of the present invention Cpd-25:

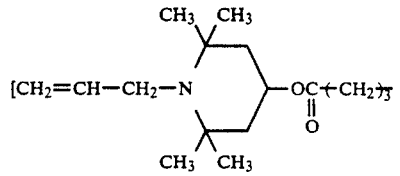

Thus, a sample D was prepared and also by adding each of the compounds shown by formula (II) shown in Table 3 to the 6th layer and the 7th layer in an amount of 50 mol % to the magenta coupler, samples shown in Table 3 were prepared.

Each of the samples was exposed using a sensitometric continuous wedge and processed by the following processing steps.

| Processing Steps | | |
|---|---|---|
| 1st Development (black and white development) | 38° C. | 75 sec. |
| Wash | 38° C. | 90 sec. |
| Reversal Exposure | >100 lux | >60 sec. |
| Color Development | 38° C. | 135 sec. |
| Wash | 38° C. | 45 sec. |
| Blix | 38° C. | 120 sec. |
| Wash | 38° C. | 135 sec. |
| Drying | | |

The compositions of the processing liquids used for the above processing steps were as follows.

| | |
|---|---|
| Nitrilo-N,N,N-trimethylene phosphonic acid.penta-sodium salt | 0.6 g |
| Diethylenetriaminepentaacetic acid.penta-sodium salt | 4.0 g |
| Potassium sulfite | 30.0 g |
| Potassium thiocyanate | 1.2 g |
| Potassium carbonate | 35.0 g |
| Hydroquinone mono-sulfonate.potassium salt | 25.0 g |

-continued

| | |
|---|---|
| Diethylene glycol | 15.0 ml |
| 1-Phenyl-4-hydroxymethyl-4-methyl-3-pyrazolidone | 2.0 g |
| Potassium bromide | 0.5 g |
| Potassium iodide | 5.0 mg |
| Water to make | 1 liter (pH 9.70) |
| Color Developer | |
| Benzyl alcohol | 15.0 ml |
| Diethylene glycol | 12.0 ml |
| 3,6-Dithia-1,8-octanediol | 0.2 g |
| Nitrilo-N,N,N-trimethylene-phosphonic acid.penta-sodium salt | 0.5 g |
| Diethylenetriaminepentaacetic acid.penta-sodium salt | 2.0 g |
| Sodium sulfite | 2.0 g |
| Potassium carbonate | 25.0 g |
| Hydroxylamine sulfate | 3.0 g |
| N-ethyl-N-(β-methanesulfonamido-ethyl)-3-methyl-4-aminoaniline sulfate | 5.0 g |
| Potassium bromide | 0.5 g |
| Potassium iodide | 1.0 mg |
| Water to make | 1 liter (pH 10.40) |
| Blix Liquid | |
| 2-Mercapto-1,3,4-triazole | 1.0 g |
| Ethylenediaminetetraacetic acid.-disodium salt.dihydrate | 5.0 g |
| Ethylenediaminetetraacetic acid.-Fe(III).ammonium monohydrate | 80.0 g |
| Sodium sulfite | 15.0 g |
| Sodium thiosulfate (700 g/liter) | 160.0 ml |
| Glacial acetic acid | 5.0 ml |
| Water to make | 1 liter (pH 6.50) |

Each sample thus processed was exposed to a xenon tester (Xe) at an illuminance of 200,000 lux for 10 days and thereafter, the residual ratio of the magenta dye was evaluated at the initial densities of 1.5 and 0.5. The results are shown in Table 3.

TABLE 3

| Sample | Dye Image Stabilizer of Formula (II) | Magenta Dye Residual Ratio (%) Initial Density 1.5 | Initial Density 0.5 | Remarks |
|---|---|---|---|---|
| D | — | 62 | 45 | Comparison |
| $D_1$ | II-5 | 85 | 84 | Example of the Invention |
| $D_2$ | II-10 | 83 | 83 | Example of the Invention |
| $D_3$ | II 18 | 84 | 83 | Example of the Invention |
| $D_4$ | II-17 | 82 | 80 | Example of the Invention |
| $D_5$ | II-19 | 81 | 81 | Example of the Invention |

As is clear from the results in Table 3, Samples $D_1$ to $D_5$ each being the combination of this invention are excellent in the effect of improving light fastness at both the high density and the low density.

EXAMPLE 5

A color photographic light-sensitive material (reversal color photographic film) was prepared according to the manner of preparing Sample 101 in Example 1 of JP-A-2-854. In this case, however, to each of the 7th layer (1st green-sensitive emulsion layer), the 8th layer (2nd green-sensitive emulsion layer), and the 9th layer (3rd green-sensitive emulsion layer) was added Magenta Coupler M-33 (0.10 g/m$^2$), and further the compounds of the present invention, III-9 (0.03) g/m$^2$, Ia-48 (0.1 g/m$^2$), IIIa-1 (0.1 g/m$^2$), and Ia-31 (0.05 g/m$^2$) were added to each of the aforesaid layer together with Cpd-26 (0.05 g/m$^2$) shown below.

Thus Sample $E_0$ was prepared.

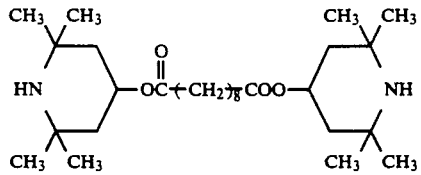

Cpd-26

Furthermore, by adding each of the compounds of the present invention shown by formula (II) to each of the 7th layer, the 8th layer, and the 9th layer as shown in Table 4 below, Sample $E_1$ to $E_5$ were prepared.

Each of the samples was exposed through a sensitometric continuous wedge and then processed by the processing steps described in Example 1 of aforesaid JP-A-2-854.

Each of the samples thus processed was exposed to a xenon tester (Xe) at an illuminance of 200,000 lux for 4 days and thereafter, the residual ratio of the magenta dye was evaluated at the initial densities of 1.5 and 0.5. The results are shown in Table 4.

TABLE 4

| Sample | Dye-Image Stabilizer of Formula (II) 50 mol % to Compound III-9 | Magenta Dye Residual Ratio (%) Initial Density 1.5 | Initial Density 0.5 | Remarks |
|---|---|---|---|---|
| E | — | 51 | 28 | Comparison |
| $E_1$ | II-5 | 75 | 74 | Example of the Invention |
| $E_2$ | II-10 | 76 | 75 | Example of the Invention |
| $E_3$ | II-13 | 73 | 73 | Example of the Invention |
| $E_4$ | II-25 | 74 | 75 | Example of the Invention |
| $E_5$ | II-27 | 75 | 73 | Example of the Invention |

As is clear from the results shown in Table 4, Samples $E_1$ to $E_5$ being the combination of the invention are excellent in the effect for improving the light fastness at both the high density and the low density.

These results domonstrate that color photographs which have good color reproduction, which have excellent light fastness in all color density regions ranging from the areas of high color density to the areas of low color density, and exhibiting little staining, can be obtained by using a combination of compounds of formula (I), formula (II) and (III), and compounds of formula (IV), (V) or (VI) in accordance with the present invention.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one light-sensitive silver halide emulsion layer comprising a dispersion of silver halide grains in a hydrophilic colloid, wherein the silver halide emulsion layer contains (a) at least one coupler represented by formula (I) in an amount of from $1\times10^{-2}$ to 1 mol per mol of silver halide, (b) at least one compound represented by formula (II) in an amount from 0.5 to 150 mol % based on the molar amount of the coupler, (c) at least one compound represented by formula (III) in an amount of from 10 to 500 mol % based on the molar amount of the coupler, and (d) at least one compound selected from the group consisting of compounds represented by formulae (IV), (V) or (VI) in an amount of from $1\times10^{-2}$ to 10 mol per mol of the coupler:

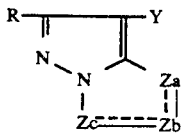

(I)

wherein R represents a hydrogen atom or a substituent group; Za, Zb and Zc each represents a methine group, a substituted methine group, =N— or —NH—; and Y represents a hydrogen atom, a coupling-off group capable of being eliminated in a coupling reaction with the oxidized product of a developing agent, or a non-coupling-off substituent group; couplers having at least two moieties may be formed via R, Y or a substituted methine group represented by Za, Zb or Zc, and when Y is a non-coupling-off substituent group, any of Za, Zb or Zc is a methine group or a substituted methine group which is substituted with a coupling-off group capable of being eliminated in a coupling reaction with the oxidized product of a developing agent;

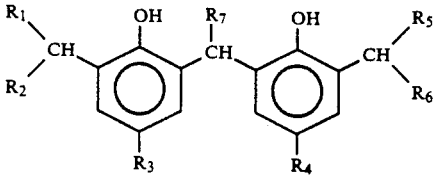

(II)

wherein $R_1$, $R_2$, $R_5$ and $R_6$, which may be the same or different, each represents a hydrogen atom, an alkyl group, an alkenyl group or an aryl group, and $R_1$ and $R_2$ or $R_5$ and $R_6$ may be linked to form a 5-membered to 7-membered ring; $R_3$ and $R_4$ each represents a hydrogen atom or an alkyl group or an aryl group; and $R_7$ represents a hydrogen atom or an alkyl group, provided that the total number of carbon atoms in $R_1$, $R_2$, $R_3$, $R_4$, $R_5$ and $R_6$ is at most 30; said groups and rings may be substituted:

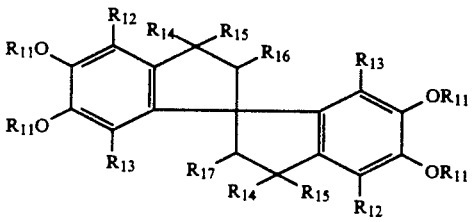

(III)

wherein $R_{11}$ represents an alkyl group, an alkenyl group or an aryl group; $R_{12}$ and $R_{13}$, which may be the same or different, each represents a hydrogen atom, an alkyl group, an alkenyl group, an aryl group, an acylamino group, a mono-alkylamino group, a dialkylamino group, —$OR_{18}$, —$SR_{18}$ or a halogen atom; $R_{14}$, $R_{15}$, $R_{16}$ and $R_{17}$, which may be the same or different, each represents a hydrogen atom, an alkyl group or an aryl group; and $R_{18}$ has the same definition as those for $R_{11}$; said groups may be substituted;

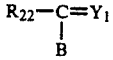

(IV)

(V)

wherein $R_{21}$ and $R_{22}$ each represents an aliphatic group, an aromatic group or a heterocyclic group; X represents a group capable of being eliminated by reaction with an aromatic amine developing agent; A represents a group capable of reacting with an aromatic amine developing agent to form a chemical bond; n is 1 or O provided that n is O when X is a halogen atom; B represents a hydrogen atom, an aliphatic group, an aromatic group, a heterocyclic group, an acyl group or a sulfonyl group; and $Y_1$ represents a group capable of promoting the addition of an aromatic amine developing agent to the compound represented by formula (V); provided that $R_{21}$ and X in formula (IV) and $Y_1$ and $R_{22}$ or B in formula (V), may be linked to form a ring; said groups and rings may be substituted; compounds having at least two moieties may be formed via $R_{21}$ or X in formula (IV) and $R_{22}$, B or $Y_1$ in formula (V); and

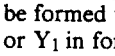

(VI)

wherein $R_{30}$ represents an aliphatic group, an aromatic group or a heterocyclic group; said groups may be substituted; and Z represents a nucleophilic group or a group capable of decomposing in the photographic material to release a nucleophilic group; compounds having at least two moieties may be formed via $R_{30}$ or Z.

2. The silver halide color photographic material as claimed in claim 1, wherein said coupler represented by formula (I) is a magenta coupler represented by formulae (Ia), (Ib), (Ic), (Id) or (Ie):

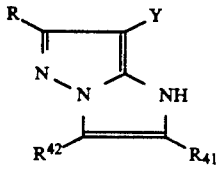

(Ia)

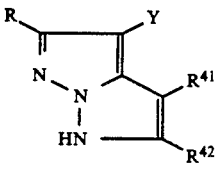

(Ib)

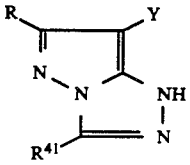

(Ic)

-continued

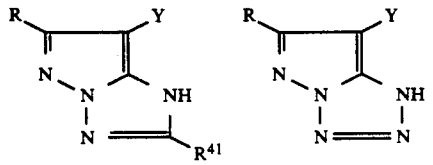

(Id) (Ie)

wherein R, $R^{41}$, and $R^{42}$ each represents a hydrogen atom or a substituent, and Y has the same definition as in formula (I).

3. The silver halide color photographic material as claimed in claim 2, wherein said substituent represented by R, $R^{41}$ and $R^{42}$ is an aliphatic group, an aromatic group, a heterocyclic group bonding via a carbon atoms, a coupling-off group, $R^{44}O$—, $R^{44}C(=O)$—, $R^{44}CO$—, $R^{44}S$—, $R^{44}$—SO—, $R^{44}SO_2$—, $R^{44}SO_2NH$—, $R^{44}$—C(=O)NH—, $R^{44}NH$—, $R^{44}OC(=O)NH$—, a halogen atom, a cyano group or an imido group, a carbamoyl group, a ureido group, a sulfamoyl group, or a sulfamoylamino group, wherein $R^{44}$ represents an alkyl group, an aryl group or a heterocyclic group; and said substituent represented by R, $R^{41}$ and $R^{42}$ may be further substituted.

4. The silver halide color photographic material as claimed in claim 1, wherein said compound represented by formula (II) is a represented by formula (IIa):

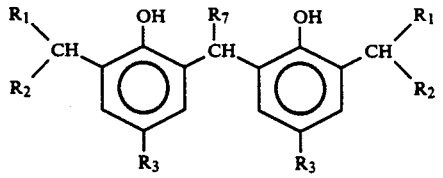

(IIa)

wherein $R_1$, $R_2$, $R_3$ and $R_7$ each has the same definition as in formula (II).

5. The silver halide color photographic material as claimed in claim 1, wherein said compound represented by formula (II) is represented by formula (IIb):

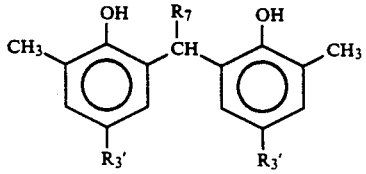

(IIb)

wherein $R_3'$ represents an alkyl group; and $R_7$ represents a hydrogen atom or an alkyl group containing 1 to 20 carbon atoms; said groups may be substituted.

6. The silver halide color photographic material as claimed in claim 1, wherein each of said compounds represented by formulae (IV) and (V) has a second order reaction rate constant $k_2$ at 80° C. with p-anisidine with the range of from 1.0 l/mol·sec to $1\times10^{-5}$ l/mol·sec.

7. The silver halide color photographic material as claimed in claim 1, wherein X in formula (IV) represents a halogen atom or a coupling-off group which is bonded with A via O, S or N atom.

8. The silver halide color photographic material as claimed in claim 7, wherein said coupling-off group is a 2-pyridyloxy group, a 2-pyrimidyloxy group, a 4-pyrimidyloxy group, a 2-(1,2,3-triaazine)oxy group, a 2-benzimidazolyl group, a 2-imidazolyl group, a 2-thiazolyl group, a 2-benzthiozolyl group, a 2-furyloxy group, a 2-thiophenyloxy group, a 4-pyridyloxy group, a 3-isooxazolyloxy group, a 3-pyrazolidinyloxy group, a 3-oxo-2-pyrazolonyl group, a 2-oxo-1-pyridinyl group, a 4-oxo-1-pyridinyl group, a 1-benzimidazolyl group, a 3-pyrazolyloxy group, a 3H-1,2,4-oxadiazolin-5-oxy group, an aryloxy group, an alkoxy group, an alkylthio group, an arylthio group, or a substituted N-oxy group; said groups may be substituted.

9. The silver halide color photographic material as claimed in claim 1, wherein A in formula (IV) represents

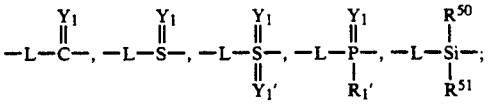

wherein L represents a single bond, an alkylene group,

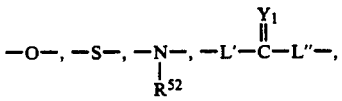

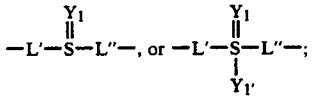

$Y_1$ has the same definition as $Y_1$ in formula (V), and $Y_1'$ has the same definition as $Y_1$; $R^{50}$ and $R^{51}$, which may be the same or different, each represents —L'''—$R_{21}$; $R^{52}$ represents a hydrogen atom, an aliphatic group, an aromatic group, a heterocyclic group, an acyl group or a sulfonyl group; L', L'' and L''', which may be the same or different, each represents —O—, —S— or

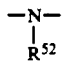

(wherein $R^{52}$ has the same definition as above); L''' may be a single bond; said groups may be substituted.

10. The silver halide color photographic material as claimed in claim 1, wherein X is a halogen atom.

11. The silver halide color photographic material as claimed in claim 1, wherein said compound represented by formula (IV) is represented by formulae (IV-a), (IV-b), (IV-c) or (IV-d) and has a second order reaction rate constant $k_2$ of the reaction with p-anisidine (at 80° C.) of from $1\times10^{-1}$ to $1\times10^{-5}$ l/mol·sec:

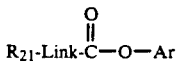

(IV-a)

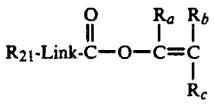

(IV-b)

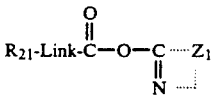

(IV-c)

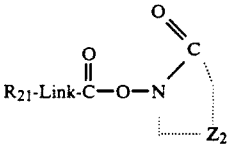

(IV-d)

wherein $R_{21}$ has the same definition as in formula (IV); Link represents a single bond or —O—; Ar represents an aromatic group as defined for $R_{21}$ in formula (IV); Ra, Rb and Rc, which may be the same or different, each represents a hydrogen atom, an aliphatic group, aromatic group, heterocyclic group, an alkoxy groups, aryloxy groups, a heterocyclic oxy group, an alkylthio group, an arylthio group, a heterocyclic thio group, amino groups, an alkylamino group, an acyl group, an amido group, a sulfonamido group, a sulfonyl group, an alkoxycarbonyl group, a sulfo group, a carboxyl group, a hydroxyl group, an acyloxy group, a ureido group, an alkoxycarbonylamino group, an aryloxycarbonylamino group, a carbamoyl group or a sulfamoyl group; Ra and Rb or Rb and Rc may be linked to form a five to seven membered heterocyclic ring, and this heterocyclic ring may be substituted with at least one substituent group: it may taken the form of a spiro ring or a bicyclo ring: or it may be condensed with an aromatic ring; $Z_1$ and $Z_2$ represent groups of non-metallic atoms which are necessary for forming a five to seven membered heterocyclic ring, and this ring may be substituted with at least one substituent group; it may take the form of a spiro or bicyclo ring; or it may be condensed with an aromatic ring; said groups and rings may be substituted.

12. The silver halide color photographic material as claimed in claim 11, wherein Ar represents a substituted carbocyclic aromatic group having the sum of the Hammett α-value for the substituent(s) of at least 0.2.

13. The silver halide color photographic material as claimed in claim 1, wherein in formula (V) $Y_1$ represents oxygen atom, a sulfur atom, $=N-R_{24}$ or

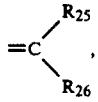

wherein $R_{24}$, $R_{25}$ and $R_{26}$, which may be the same or different, each represents a hydrogen atom, an aliphatic group, an aromatic group, a heterocyclic group, an acyl group or a sulfonyl group, and $R_{25}$ and $R_{26}$ may be linked to form a ring structure; said groups and rings may be substituted.

14. The silver halide color photographic material as claimed in claim 1, wherein in formula (VI) Z represents a group derived from a nucleophilic functional group having a Pearson nucleophilicity $^nCH_3I$ value of at least 5.

15. The silver halide color photographic material as claimed in claim 1, wherein Z represents a group in which the atom which chemically bonds directly with the oxidized product of an aromatic amine developing agent is an oxygen atom, a sulfur atom or a nitrogen atom.

16. The silver halide color photographic material as claimed in claim 1, wherein said compound represented by formula (VI) is represented by formula (VI-a):

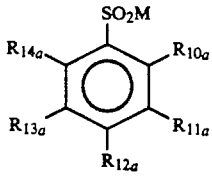

(VI-a)

wherein M represents an atom or an atomic group necessary for forming an inorganic or organic counter ion, or is

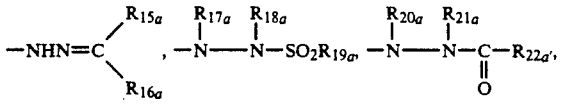

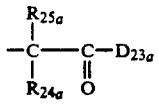

or a hydrogen atom, wherein $R_{15a}$ and $R_{16a}$, which may be the same or different, each represents a hydrogen atom, an aliphatic group, an aromatic group or a heterocyclic group; $R_{15a}$ and $R_{16a}$ may be linked to form a five to seven membered ring; $R_{17a}$, $R_{18a}$, $R_{20a}$ and $R_{21a}$, which may be the same or different, each represents a hydrogen atom, an aliphatic group, an aromatic group, a heterocyclic group, an acyl group, an alkoxycarbonyl group, a sulfonyl group, a ureido group, an alkoxycarbonylamino group, or an aryloxycarbonylamino group, provided that at least one of $R_{17a}$ and $R_{18a}$, and at least one of $R_{20a}$ and $R_{21a}$ represents a hydrogen atom; $R_{19a}$ and $R_{22a}$ represent a hydrogen atom, aliphatic groups, aromatic groups or heterocyclic groups; $R_{19a}$ may also represent an alkylamino group, an arylamino group, an alkoxy group, an aryloxy group, an acyl group, an alkoxycarbonyl group or an aryloxycarbonyl group; at least two of the groups represented by $R_{17a}$, $R_{18a}$ and $R_{19a}$ may be linked to form a five to seven membered ring, and at least two of the groups represented by $R_{20a}$, $R_{21a}$ and $R_{22a}$ may be linked to form a five to seven membered ring; $R_{23a}$ represents a hydrogen atom, a aliphatic group, an aromatic group or a heterocyclic group; and $R_{24a}$ represents a hydrogen atom, an aliphatic group, an aromatic group, a halogen atom, an acyloxy group or a sulfonyl group; $R_{25a}$ represents a hydrogen atom or a hydrolyzable group; $R_{10a}$, $R_{11a}$, $R_{12a}$, $R_{13a}$, and $R_{14a}$, which may be the same or different, each represents a hydrogen atom, an aliphatic group, an aromatic group, a heterocyclic group, a halogen atom, $-SR_{26a}$, $-OR_{26a}$,

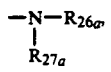

an acyl group, an alkoxycarbonyl group, an aryloxycarbonyl group, a sulfonyl group, a sulfonamido group, a sulfamoyl group, an alkoxycarbonylamino group, a aryloxycarbonylamino group, a carbamoyl group, a sulfo group, a carboxyl group, a nitro group, a cyano group, an alkoxalyl group, an aryloxalyl group, a sufonyloxy group

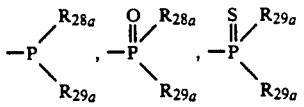

or a formyl group, wherein $R_{26a}$ and $R_{27a}$, which may be the same or different, each represents a hydrogen atom, an aliphatic group, an aromatic group, an acyl group or a sulfonyl group; and $R_{28a}$ and $R_{29}$, which may be the same or different, each represents a hydrogen atom, an aliphatic group, an aromatic group, an alkoxy group or an aryloxy group; said groups and rings may be substituted.

17. The silver halide color photographic material as claimed in claim 16, wherein the total sum of the Hammett $\alpha$ values of the benzene substituent groups with respect to the $-SO_2M$ group is at least 0.5.

18. The silver halide color photographic material as claimed in claim 1, wherein (i) at least one compound selected from the group consisting of compounds represented by formula (IV) or (V) (ii) and at least one compound selected from the group consisting of compounds represented by formula (VI) are used in combination.

19. The silver halide color photographic material as claimed in claim 1, wherein the silver halide color photographic material contains at least one ultraviolet absorber represented by formula (UV):

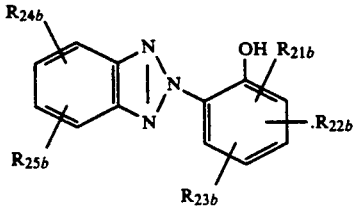

(UV)

where $R_{21b}$, $R_{22b}$, $R_{23b}$, $R_{24b}$ and $R_{25b}$, which may be the same or different, each represents a hydrogen atom or a substituent group, and $R_{24b}$ and $R_{25b}$ may undergo ring closure to form a five or six membered aromatic ring comprised of carbon atoms.

20. The silver halide photographic material as claimed in claim 19, wherein the substituent group represented by $R_{21b}$, $R_{22b}$, $R_{23b}$, $R_{24b}$, and $R_{25b}$ is an aliphatic group, an aromatic group, a heterocyclic group bonding via a carbon atom, a coupling-off group, $R^{44}O-$,

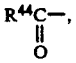

$R^{44}CO-$, $R^{44}S-$, $R^{44}SO-$, $R^{44}SO_2-$, $R^{44}SO_2NH-$,

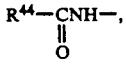

$R^{44}NH-$, $R^{43}OCNH-$, a halogen atom, a cyan group, an imido group, a carbamoyl group, a ureido group, a sulfamoyl group, or a sulfamoylamino group, wherein $R^{44}$ represents an alkyl group, an aryl group or a heterocyclic group; and said substituent represented by $R_{21b}$, $R_{22b}$, $R_{23b}$, $R_{24b}$, and $R_{25b}$ may be further substituted.

21. The silver halide color photographic material as claimed in claim 19, wherein a cyan color forming layer is present and said ultraviolet absorber is included in the layers on both sides adjacent to the cyan color forming layer.

22. The silver halide color photographic material as claimed in claim 19, wherein the ultraviolet absorber is present in an amount of from $1\times10^{-4}$ to $2\times10^{-3}$ mol/m$^2$.

23. The silver halide color photographic material as claimed in claim 1, wherein the silver halide emulsion layer containing the coupler represented by formula (I) further comprises at least one compound selected from the group consisting of compounds represented by formula (HQ) or (RD):

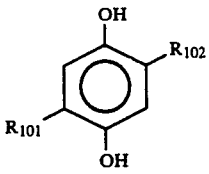

(HQ)

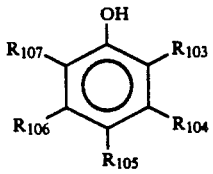

(RD)

wherein $R_{101}$ to $R_{107}$ may be the same or different, each represents a hydrogen atom, an alkyl group, an aryl group, a heterocyclic group, an alkoxy group, an aryloxy group, a heterocyclic oxy group, an alkylthio group, an arylthio group, a heterocyclic thio group, a hydroxyl group, an amido group, a sulfo group, a sulfonyl group, a sulfinyl group, a carboxyl group, an acyl group, $R_{100}OCO-$, $R_{100}OSO_2-$, $R_{100}COO-$, $R_{100}SO_2O-$, $R_{100}OCONH-$ wherein $R_{100}$ represents an alkyl group or an aryl group, a ureido group, a sulfamoyl group, a carbamoyl group, a cyano group, a nitro group or a halogen group, and at least one of $R_{101}$ and $R_{102}$, and $R_{103}$ to $R_{107}$ is not hydrogen, and in formula (HQ) the total number of carbon atoms in $R_{101}$ and $R_{102}$ is at least 4 and in formula (RD) the total number of carbon atoms in $R_{103}$ to $R_{107}$ is at least 4.

24. The silver halide color photographic material as claimed in claim 1, wherein the amount of the coupler represented by formula (I) is present in an amount of from $1\times10^{-1}$ mol to $5\times10^{-1}$ mol per mol of silver halide.

25. The silver halide color photographic material as claimed in claim 1, wherein the amount of the compound represented by formula (II) is present in an amount of from 1 to 100 mol % with respect to the molar amount of the coupler represented by formula (I).

26. The silver halide color photographic material as claimed in claim 1, wherein the compound represented by formula (III) is present in an amount of from 10 to 200 mol % with respect to the molar amount of the coupler represented by formula (I).

27. The silver halide color photographic material as claimed in claim 1, wherein the total amount of the at least one compound selected from the group consisting of compounds represented by formula (IV), (V) or (VI) is present in an amount of from $3\times10^{-2}$ to 5 mol per mol of the coupler represented by formula (I).

* * * * *